US007335833B2

(12) United States Patent
Smith et al.

(10) Patent No.: US 7,335,833 B2
(45) **Date of Patent: *Feb. 26, 2008**

(54) MUSIC PERFORMANCE SYSTEM

(75) Inventors: David Smith, Brooklyn, NY (US); Fred Bianchi, Camden, ME (US); Kojiro Umezaki, Montreal (CA)

(73) Assignee: Realtime Music Solutions, LLC, New York, NY (US)

( * ) Notice: Subject to any disclaimer, the term of this patent is extended or adjusted under 35 U.S.C. 154(b) by 383 days.

This patent is subject to a terminal disclaimer.

(21) Appl. No.: 10/731,085

(22) Filed: Dec. 10, 2003

(65) Prior Publication Data

US 2004/0112202 A1 Jun. 17, 2004

Related U.S. Application Data

(63) Continuation of application No. 10/137,392, filed on May 3, 2002, now Pat. No. 6,696,631.

(60) Provisional application No. 60/288,464, filed on May 4, 2001.

(51) Int. Cl.
*G10H 1/00* (2006.01)

(52) U.S. Cl. ..... 84/601; 84/615; 84/653; 84/645

(58) Field of Classification Search ..... 84/601, 84/602, 615, 653, 645
See application file for complete search history.

(56) References Cited

U.S. PATENT DOCUMENTS

| | | | | |
|---|---|---|---|---|
| 5,227,574 A | | 7/1993 | Mukaino | 84/652 |
| 5,296,641 A | | 3/1994 | Stelzel | 84/602 |
| 5,331,111 A | | 7/1994 | O'Connell | 84/602 |
| 5,693,903 A | * | 12/1997 | Heidorn et al. | 84/668 |
| 5,740,260 A | | 4/1998 | Odom | 381/119 |
| 5,792,971 A | | 8/1998 | Timis et al. | 84/609 |
| 5,801,694 A | | 9/1998 | Gershen | 345/339 |
| 5,852,251 A | * | 12/1998 | Su et al. | 84/645 |
| 5,952,598 A | * | 9/1999 | Goede | 84/609 |

(Continued)

FOREIGN PATENT DOCUMENTS

| | | |
|---|---|---|
| JP | 6-295269 | 10/1994 |

(Continued)

OTHER PUBLICATIONS

Cakewalk Professional for Windows (version 2.0 User's Manual. Twelve Tone Systems. 1992).*

(Continued)

*Primary Examiner*—Lincoln Donovan
*Assistant Examiner*—David S. Warren
(74) *Attorney, Agent, or Firm*—Edell, Shapiro & Finnan, LLC

(57) ABSTRACT

A method and apparatus for producing a musical output is disclosed. The method and apparatus permit the creation, storage and retrieval of a first data structure representing a musical piece. The first data structure includes digital music information that represent musical notes of the musical piece. A second data structure can be created, stored and retrieved as well. The second data structure can include information different than the first data structure and the second data structure can be used to modify the first data structure and to produce a modified musical output. The apparatus and method also permit reuse of the first data structure.

48 Claims, 42 Drawing Sheets

U.S. PATENT DOCUMENTS

| | | | | |
|---|---|---|---|---|
| 6,018,118 | A | 1/2000 | Smith et al. | 84/600 |
| 6,066,794 | A | 5/2000 | Longo | 84/626 |
| 6,386,985 | B1 | 5/2002 | Rackham | 472/75 |
| 6,696,631 | B2 * | 2/2004 | Smith et al. | 84/645 |
| 2002/0091004 | A1 | 7/2002 | Rackham | 472/60 |

FOREIGN PATENT DOCUMENTS

| | | |
|---|---|---|
| WO | WO 01/16931 | 3/2001 |

OTHER PUBLICATIONS

The MIDI File Format. View online on Apr. 13, 2007 at http://jedi.ks.uiuc.edu/~johns/links/music/midifile.htm.*
Cakewalk Pro Audio 9: User's Guide.*
English Language Abstract of JP 6-295269.
International Search Report.
Written Opinion.

* cited by examiner

| | | | | | | | |
|---|---|---|---|---|---|---|---|
| 25 | 1 | 0 | vol | 75 | | | |
| 25 | 1 | 0 | C5 | 85 | 160 | | |
| 25 | 1 | 160 | C5 | 65 | 160 | | |
| 25 | 1 | 320 | C5 | 60 | 160 | | |
| 25 | 2 | 0 | B4 | 75 | 240 | | |
| 25 | 2 | 240 | B4 | 60 | 240 | | |
| 26 | 1 | 0 | A4 | 75 | 240 | | |
| 26 | 1 | 240 | A4 | 55 | 240 | | |
| 26 | 2 | 0 | G4 | 75 | 240 | | |
| 26 | 2 | 240 | F#4 | 55 | 240 | | |

| | | | | | | | |
|---|---|---|---|---|---|---|---|
| 25 | 1 | 0 | vol | 75 | | | |
| 25 | 1 | 0 | D1 | 85 | 240 | | |
| 25 | 1 | 360 | Bb1 | 65 | 120 | | |
| 25 | 2 | 0 | G2 | 75 | 240 | | |
| 25 | 2 | 240 | Bb2 | 75 | 240 | | |
| 26 | 1 | 0 | D1 | 85 | 240 | | |
| 26 | 1 | 360 | Bb1 | 65 | 120 | | |
| 26 | 2 | 0 | G2 | 75 | 240 | | |
| 26 | 2 | 240 | Bb2 | 75 | 240 | | |

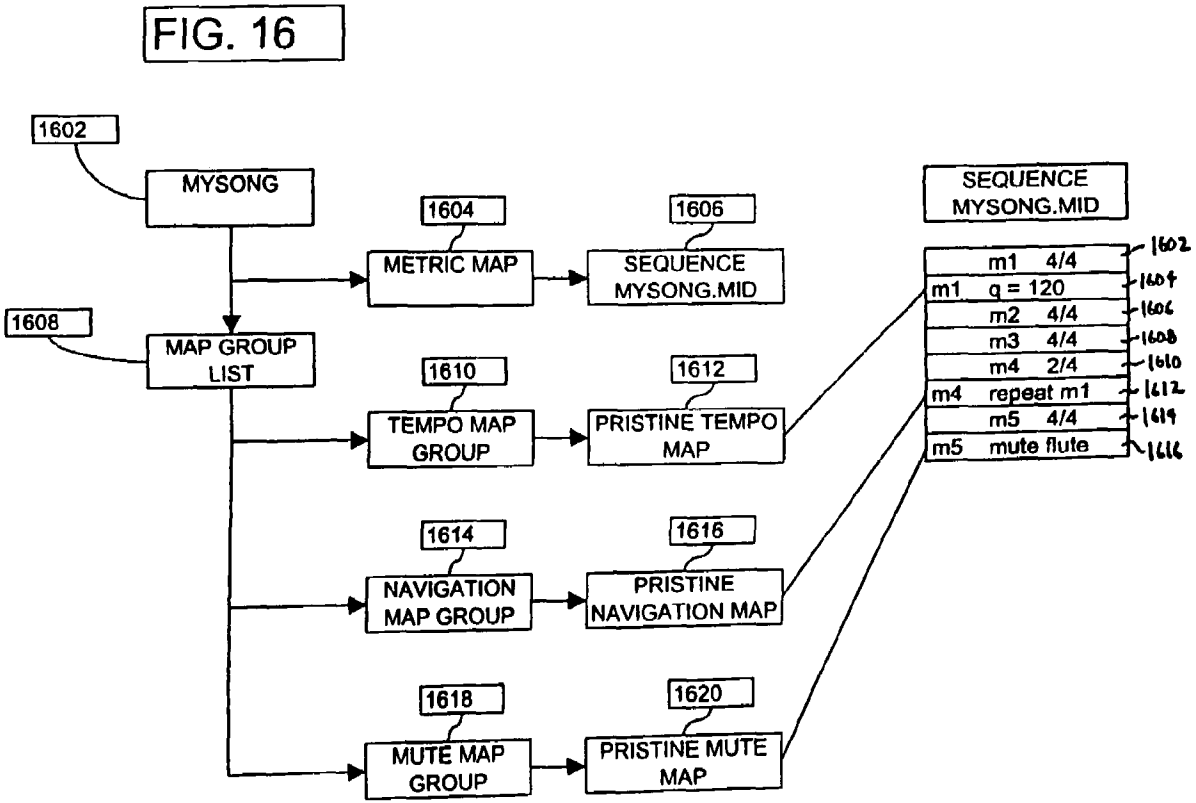
FIG. 16
1602
MYSONG
1608
MAP GROUP LIST
1604
METRIC MAP
1610
TEMPO MAP GROUP
1614
NAVIGATION MAP GROUP
1618
MUTE MAP GROUP
1606
SEQUENCE MYSONG.MID
1612
PRISTINE TEMPO MAP
1616
PRISTINE NAVIGATION MAP
1620
PRISTINE MUTE MAP
SEQUENCE MYSONG.MID
m1 4/4
m1 q = 120
m2 4/4
m3 4/4
m4 2/4
m4 repeat m1
m5 4/4
m5 mute flute

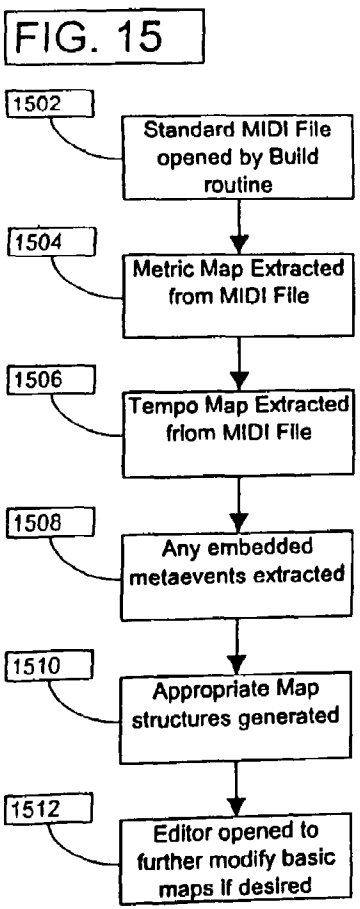
FIG. 15
1502
Standard MIDI File opened by Build routine
1504
Metric Map Extracted from MIDI File
1506
Tempo Map Extracted frlom MIDI File
1508
Any embedded metaevents extracted
1510
Appropriate Map structures generated
1512
Editor opened to further modify basic maps if desired

MUSIC PERFORMANCE SYSTEM

RELATED APPLICATIONS

This application is a continuation of application Ser. No. 10/137,392, filed May 3, 2002 (now U.S. Pat. No. 6,696,631), which claims priority to U.S. provisional patent application No. 60/288,464, filed May 4, 2001, both of which are incorporated herein by reference in their entireties.

REFERENCE TO APPENDIX

This application includes an appendix. The appendix is a part of the specification.

BACKGROUND

1. Field of the Invention

The present invention is directed to a musical device, in particular, to a music performance system.

2. Background of the Invention

The history of the performing arts has for many years associated multiple types of performance arts in conjunction with each other. For example, singing, instrumental music, dancing, acting, music, lights, costumes, and scenery. Each of these disciplines has its place, and appropriate importance, depending on the artistic discipline.

One of the most intimate relationships in many performing arts disciplines is between the action on stage, and an offstage orchestra, which provides music to support the activity seen and heard from the stage. Traditionally, this performing group has been a full orchestra. For centuries, operas, singspiels, ballets, masques, etc., have taken advantage of using medium to large number orchestras to perform the role of providing music.

However, in recent decades, issues of space and economics have rendered the large orchestras of previous eras impossible in all but the most fully financed of productions. Producers are faced with the choice between increasing the price of tickets to prohibitive amounts, or to reducing the size of the orchestra and sacrificing the quality of the orchestration, and therefore the audience's enjoyment. Different levels of productions will assume different proportions to these solutions.

Musical Theatre, particular, has addressed these issues on a number of levels. These productions lie on a variety of market levels, from Broadway, through National Tours, non-Equity productions, Regional Theatre, amateur, and educational markets. Each has its own tolerance level in terms of addressing this cost/performance relationship. It is a rare modern show, however, which has not had to make some adjustments to the economic realities of modern performance costs.

The problem of providing a solution to the problems of a smaller orchestra is compelling. There have been many attempts to solve the problem of lowered size of the pit orchestra. An ideal solution should produce a product indistinguishable from the original orchestration. In order to do this, the resulting technology needs to address the following list of problems.

1) "Fat" sound. The ability to realistically simulate the sound of the missing instruments.

2) Tempo Flexibility. The tempo (speed) of performance will vary constantly performance to performance. Any solution needs to be able to follow the tempo indications of the musical director, conductor or whoever is setting this.

3) Catastrophe recovery. Even in the most polished production, events can occur which interrupt the normal progression of the performance (Missed entrances, sticking scenery, forgotten lines, etc). The orchestra will need to adjust by jumping to locations out of order, by arbitrarily repeating sections determined on the site or following directions in a variety of different ways.

4) Orchestra size. Different productions will have different budgets, and can therefore afford different sizes of orchestras. Any solution should easily be able to accommodate to these changes in size, either between or within productions.

5) Transposition. At times, a different performer may need to be introduced, with resulting changes in performance styles and capabilities. One of these is to change the key of the piece.

6) Modifications to the Mix. Performances that travel to different venues find that each performing hall has different acoustics, and therefore different instruments will respond differently (be too loud, to bright, etc). Any solution needs to provide the capability of making these types of adjustments.

7) Changes during rehearsals. There has never been a production that has gone through the rehearsal process without making changes to the performance. These adjustments need to be made quickly.

8) Ability for a single musician to perform multiple parts simultaneously. If the solution requires a one-to-one ratio of replacement versus original, then there is no reason to use any solution.

9) Ability to change dynamics in real time. Loudness levels need to be adjusted during the performance as well 10) Transparency. Overall, the traditions of the performing arts have been developed over many years. Any solution should provide minimum invasion of these techniques, and therefore be transparent to director, musicians, and stage talent.

A number of solutions have heretofore been attempted. While each addresses one or some of the preceding problems with varying degrees of success, none of the related art provides a satisfactory level of performance and flexibility.

1) Lowering the Size of the Orchestra. Doing this means that an orchestrater needs to be hired. This is an additional, and not inconsiderable expense. The quality of the final output is compromised by a thinner sound. If the production changes, then additional orchestrations need to be done. Since practically every production has different contingencies, this re-orchestration needs to occur time and again, depending on the required size of the orchestra.

2) Prerecorded music. Often called "click track." Although able to provide a warm, convincing sound, this solution suffers in many of the other areas. Tempo is fixed, and, in fact, the musical director must often wear headphones which contain a metronome click (hence the name) in order to follow the prerecorded sound. Also, there is no way to recover from a catastrophe, and internal mix decisions are not able to be changed without a lengthy and expensive re-recording session.

3) Synthesizer. The most common solution used has been to place synthesizer players in the orchestra, each covering multiple parts. Although able to provide flexibility and catastrophe recovery, the resulting sound is thin and unrealistic. It is impossible for a single player to provide the nuance and technique of multiple musicians simultaneously.

4) Sequencing. There are many computer programs which are designed to take advantage of the MIDI (Musical Instrument Digital Interface) specifications to control multiple synthesizer parts. In effect, these devices can store "performances" and then play back these performances. Sequencers are powerful tools, and, in the right hands, capable of realistic simulations of the orchestra. However, since these devices were designed for and mostly used in the studio environment, their thrust has been to develop solutions designed for studio use. There are many situations in the live performance world which are not fully implemented within these systems, such as arbitrary tempo flexibility, full catastrophe protection, and real-time modifications to the instrument output.

SUMMARY OF THE INVENTION

The present invention is directed to a method of producing a musical output comprising the following steps. Retrieving a first data structure representing a musical piece, where the first data structure includes digital music information that represent musical notes of the musical piece. Retrieving a second data structure that includes information different than the first data structure. The second data structure is used to modify the first data structure and the modified first data structure is used to produce the musical output.

In another aspect of the invention, the first data structure includes information that conforms to a pre-selected digital format and wherein the second data structure includes information that does not conform to the pre-selected digital format.

In another aspect of the invention, portions of the second data structure are extracted from the first data structure.

In another aspect of the invention, the first data structure includes information that conforms to a MIDI specification.

In another aspect, the invention provides a method of reusing a first data structure comprising the steps of: creating a first data structure related to a song, where the first data structure comprises a first type of digital information, and the first data structure can be used to produce a musical output. Using a first version of a second data structure along with the first data structure to produce a first modified musical output, and using a second version of the second data structure along with the first data structure to produce a second modified musical output, where the same first data structure is used to make both the first modified musical output and the second modified musical output and where the first modified musical output is different than the second modified musical output.

In another aspect of the invention, the second data structure includes at least one map.

In another aspect of the invention, the second data structure includes at least one group.

In another aspect of the invention, the second data structure includes at least one command that changes to play sequence order of the first data structure.

In another aspect, the invention includes a method of generating a musical output comprising the steps of: retrieving a pristine digital bit stream related to a song and retrieving a second type of digital information. Using the pristine digital bit stream and the second type of digital information to generate a second digital bit stream, the second digital bit stream representing a musical signal. Using the second digital bit stream to create the musical output and playing the musical output in real time, and receiving a command from an operator during the playing of the musical output, the command modifying the musical output.

In another aspect of the invention, the received command changes to play sequence order of the pristine digital bit stream.

In another aspect of the invention, the received command changes a playback mode between a tap mode and a cruise mode during the playing of the musical output.

In another aspect of the invention, the received command modifies a pitch associated with the musical output during the playing of the musical output.

In another aspect of the invention, the received command establishes a vamp during the playing of the musical output.

In another aspect of the invention, the received command modifies a tempo associated with the musical output.

Additional features and advantages of the invention will be set forth in the description which follows, and in part will be apparent from the description, or may be learned by practice of the invention. The objectives and advantages of the invention will be realized and attained by the structure and steps particularly pointed out in the written description, the claims and the drawings.

BRIEF DESCRIPTION OF THE DRAWINGS

FIG. 15 is a flow diagram of a preferred embodiment of a method for developing maps in accordance with the present invention.

FIG. 16 is a schematic diagram of a preferred embodiment of a map structure in accordance with the present invention.

DETAILED DESCRIPTION OF THE INVENTION

Certain terms, defined here, are used throughout this disclosure in a consistent manner. The term, "show" is an original music notation of all instrument parts for a particular show. The term, "song" means a piece of music, perhaps complete within itself, and separated from other songs. The term "show" means a particular set of songs put together to create a particular performance, and the term "production" means the use of a show by a particular organization version. Each production may have multiple different interpretations of the same show. These are called production versions.

Figure 1:
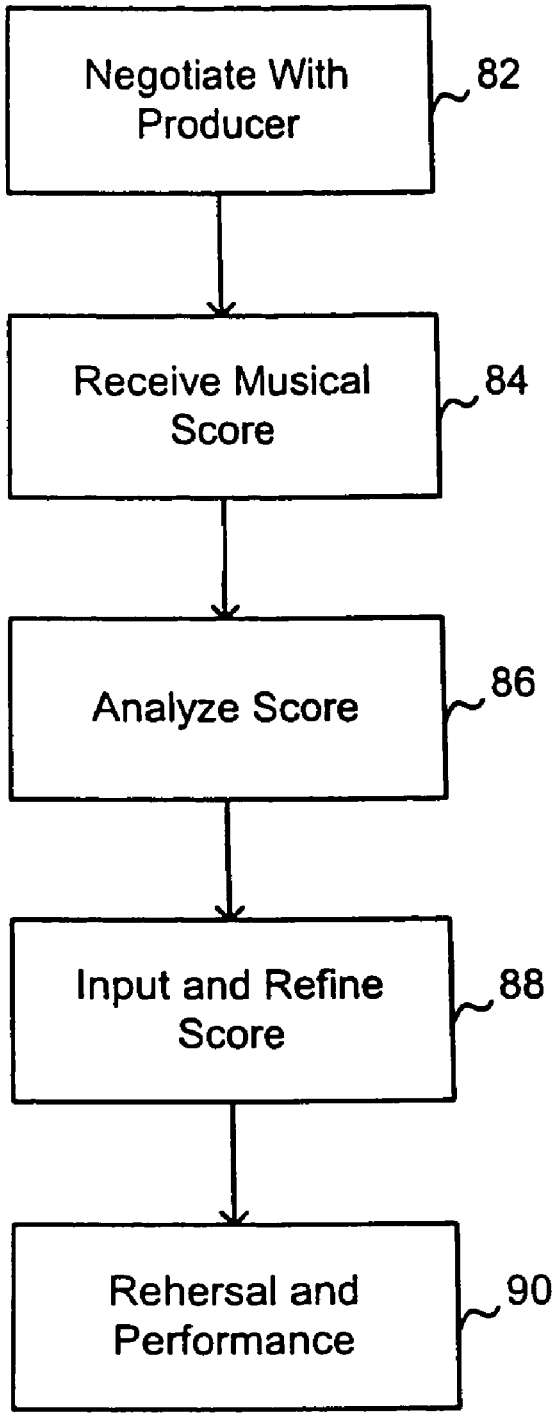
FIG. 1 is a flow diagram of a preferred embodiment of a method of producing a show in accordance with the present invention.

Referring to FIG. 1, a project is first negotiated 82 with a producer or production company. Generally, a development company negotiates with the producer. Once completed, then the musical score is received in step 84. This may be either a complete score, instrumental part books, or some combination of the above. What is important is that the specific information for every note played by every instrument is contained within the materials received.

At this point, the score is then analyzed 86 for a variety of different features. This include the number and type of instruments, the number of different songs, the number of measures within each song, and the complete inventory of different types of percussion, keyboard, and other instruments.

In the next pass, the show is shaped. Each song is carefully listened to, and additional information beyond the basic score information is added. This can include volume curves, more sophisticated patch information, note duration, start point modification, and velocity information, for example. Certain instrument types may also have other parameters, such as brightness, accent and/or sustain, for example.

The artistic director of the development company and the musical director from the production company can also participate in this refinement process. They can provide assistance and comments to help individually craft the show to meet the needs of a particular production. Preferably, a music system 106 (see FIG. 2) is used during this process.

Music system 106 can be a portion of computing resources of a computer, is a single computer and/or more than one computer in communication with one another. Music system 106 includes provisions that permit the storage and manipulation of music files.

Once this refinement process has been completed, the score and/or a digital representation of the score, can be loaded into the music system 106.

After the score has been loaded, the rehearsal and performance step 90 takes place. At this time, a human performer practices interacting with music system 106. Preferably, performer becomes familiar with the show and is able to control music system 106 in a musical way. Performer may add their own modifications to the show; not to change the aesthetic needs of the musical director, but to simplify or expedite the performance.

Once the performer has adequately rehearsed the score, the rest of the orchestra can be added. These musical rehearsals are very similar to a rehearsal with only standard acoustic instruments or more traditional orchestral enhancement systems. As the orchestra learns its parts, additional modifications to the show can be made by technicians familiar with music system 106 or by trained personnel from the production company. These modifications may occur during the rehearsal or between rehearsals.

The complete system will then be transferred to the pit, and complete technical rehearsals will begin. These are the rehearsals when the entire show, actors, lighting, sets, costumes, and other elements of the show, are assembled. These rehearsals allow for continued refinement of the production score, and so additional edits can be made. Eventually the technical rehearsals end, and the show goes into performance mode.

Figure 2:
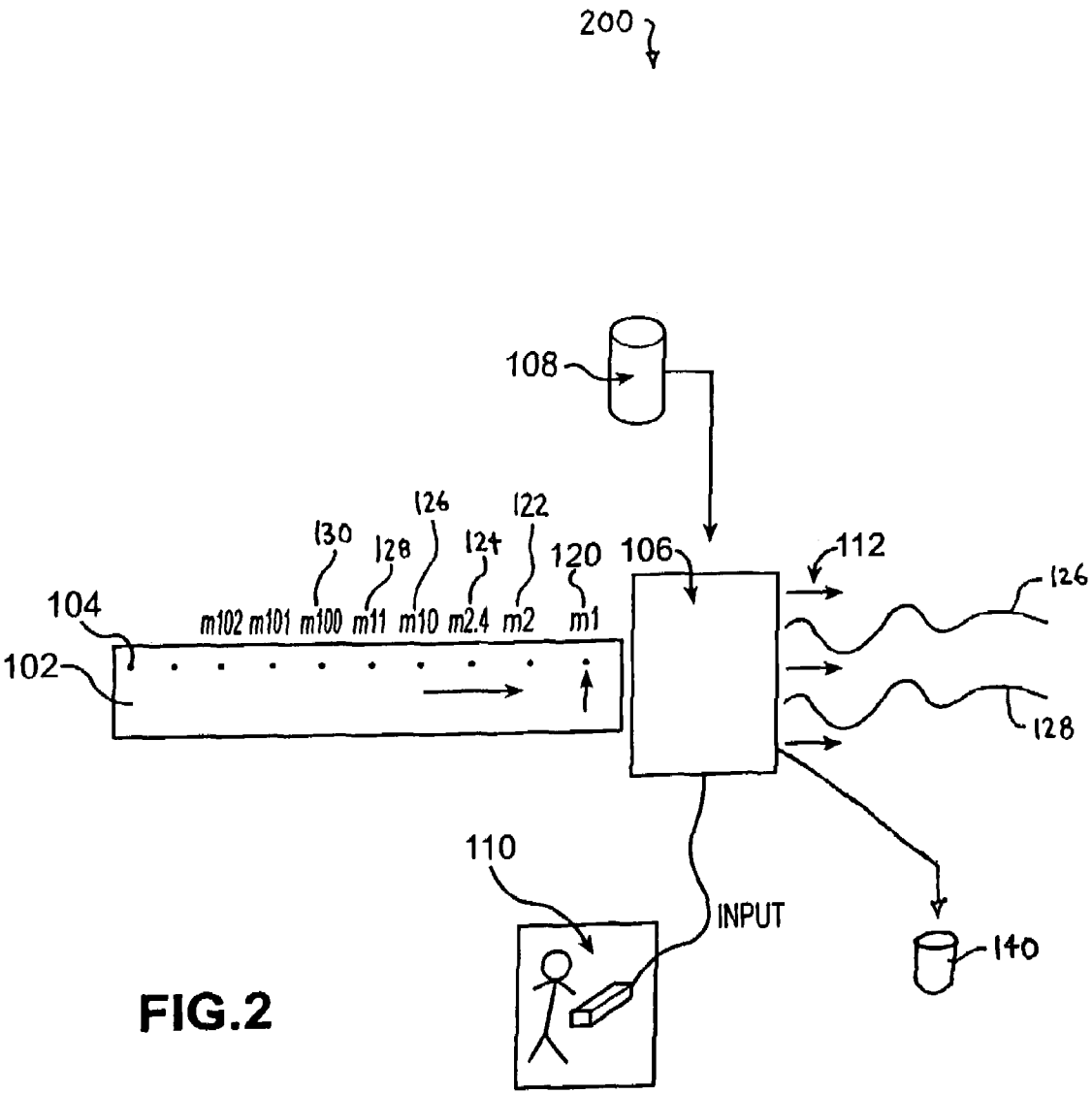
FIG. 2 is a schematic diagram of a preferred embodiment of a system in accordance with the present invention.

FIG. 2 is a schematic diagram of a preferred embodiment of a performance system 200. Performance system 200 includes a music system 106 that receives or retrieves a first file 102. First file 102 can include information related to a first data structure. First data structure generally represents a musical piece and can include information that represents musical notes. In some embodiments, first data structure conforms to a known or pre-selected music definition language. In some embodiments, this music definition language can be MIDI (Musical Instrument Digital Interface).

Dots 104 represent embedded information related to a second data structure. Second data structure preferably includes information that can be characterized as somewhat different than the information associated with the first data structure. In some embodiments, first data structure includes information that expresses music including musical notes and rests and second data structure includes information related to actions, events and/or markers that help facilitate those actions and/or events. Events can also be referred to as meta events. In some embodiments, the information associated with the second data structure does not conform to the pre-selected music definition language to which the first data structure conforms.

In the embodiment shown in FIG. 2, dots 104 represent a form of meta event, markers, and in particular metrical markers. The markers can be labeled in any desired manner. In the embodiment shown in FIG. 2, measure 1 120 is labeled m1, measure 2 122 is labeled m2, measure 2.4 124 is labeled m2.4, measure 10 126 is labeled m10, measure 11 128 is labeled m11, and measure 100 130 is labeled m100. Arbitrary measure numbers or measure names can be assigned to the various measures. The arbitrary names and/or numbers can be in any order. In some embodiments, these arbitrary names and/or numbers represent locations on a particular sequence that correspond to the musical score that is being simulated.

Output 112 from music system 106 can include one or more channels of output. Output 112 can include digital and/or analog output. In a preferred embodiment, output 112 includes multiple channels of analog musical output. Output 112 can be modified in many different ways. One modification can be based on information found on a file or files 108. In some embodiments, file 108 is called a show file and is sometimes given a file extension of .SHO. The show file contains information that allows manipulation and/or modification of MIDI stream 108.

In some embodiments, file 108 can contain a variety of different types of information. Some of the types of information that can be included relate to: (1) the properties of instruments, (2) order of show, (3) global parameters, (4) actions and (5) song parameters. The file may contain all of this data, or it may be split into separate files, each file containing a specific type of information. If split into different data type files, these different files can be referred to as maps, and can then be referred to by file 108.

Returning to FIG. 1, the input and refine score 88 step can include a variety of tools, techniques and processes to assist a user in entering the score, as well as analyzing the score. Generally, the goal is to accurately model an orchestra. Music system 106 can be thought of as an orchestral simulation device that includes a method to simulate the orchestra in as many different ways.

Figure 3:
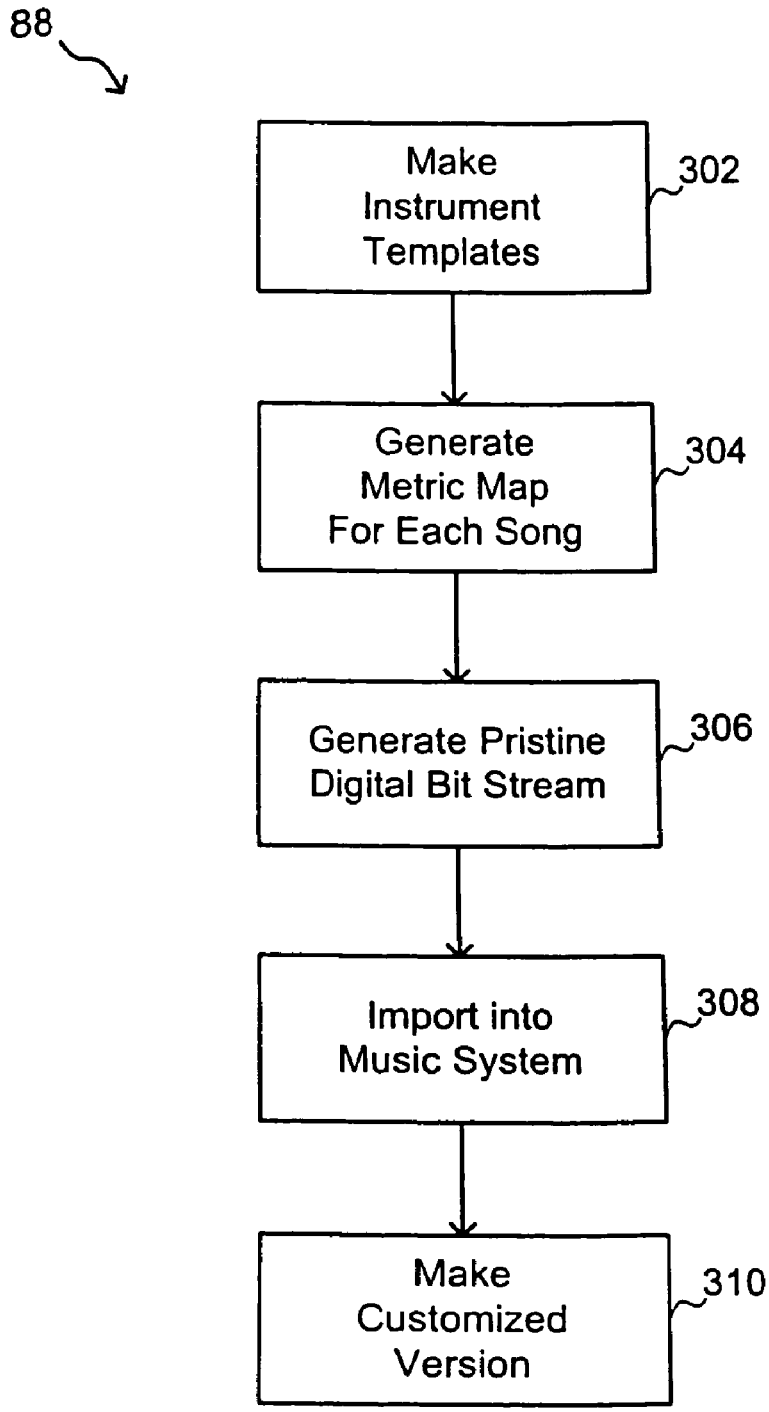
FIG. 3 is a flow diagram of a preferred embodiment of a method to input and refine a score in accordance with the present invention.

FIG. 3 is a preferred embodiment of a schematic diagram of an input and refine score process 88 (see FIG. 1). The input and refine score process 88 can include five steps. The process preferably begins by having the user define all of the instruments that participate in the score and define instrument templates 302. In this step, instruments are defined. As noted above, although any music definition language can be used, MIDI is preferred. MIDI permits instruments to be associated with various channels, ports, and/or outputs. In step 302, each instrument is carefully associated with a port and an output. Preferably, so that every standard MIDI file that is associated with a particular show has the exact same set of instruments going to the exact same MIDI outputs, instruments are given names that are similar so that there is a common port assignment for that instrument and that port assignment will be consistent throughout the various songs that comprise a score.

In step 304, a metric map is created for each song. A metric map is created by placing indicia or tag markers in a standard MIDI file. These indicia or tag markers can represent a form of second data structure. Standard MIDI files permit comments at any point and at any location within the standard MIDI file and the second data structure can be associated with these comments. In some embodiments, portions of the second data structure can be contained within these comments.

In a preferred embodiment, a number of labels that start with the letter "m" and then a space are used to denote a metric marker. FIG. 1 has examples of metric markers, M101, for example, in MIDI bit stream 102. Of course, the marker need not be named, "M 101," the marker could have any name. Although metric markers can follow a consistent numerical or alphabetical order, generally, metric markers do not follow a consistent numerical or alphabetical order. Generally, the metric map is defined by a series of markers with labels, m 1, m 2, m 3 . . . and on until the end of the song. These markers can be placed at the beginning of measures.

Additional markers can be placed at any location where a sequence would jump to or commence. In other words, for every single type of action or event, a marker can be embedded within the standard MIDI file to define a specific location for the action or event to use. Actions and events represent another example of the second data structure. It is not necessary to embed all actions within the Standard MIDI file at this time. Additional metric markers can be added at any time.

In step 306 a pristine digital bit stream is created. In this step, all of the notes of the score, the sounds that accompany those notes. Optionally, characteristics of those sounds, including, for example, volume, velocity, petal information, and/or pitch bend can also be included. The goal of this process is to create a digital representation of the score by creating digital representations of every note and every rest that are part of that score. This step can include several revisions, shapings and other refinements to arrive at a suitable digital representation of the score. Once this step has been completed, a pristine digital bit stream is created. Preferably, this digital bit stream remains unchanged. In some embodiments, the first data structure includes this pristine digital bit stream or a refined pristine digital bit stream.

After the pristine digital bit stream is created, it is imported into music system 106 (see FIG. 2) in step 308. This process of importing the pristine digital bit stream is more fully disclosed below.

Finally, after the pristine digital bit stream has been imported into music system 106, users can make customized versions of the shows to suit particular needs. This is done in step 310. Preferably, during this step, the pristine digital bit stream is left intact and modifications are made to the pristine digital bit stream that include information that is a different kind of information that comprises the pristine digital bit stream. There are many different features and functions that assist users in producing a customized version. These features and functions will be more fully disclosed below.

Each of the steps, 302-310 will now be discussed more fully, starting with step 302, make instrument templates. However, before discussing the construction of instrument templates, it is important to consider various instrument properties. These properties are associated with each instrument, and define how that instrument will react to a variety of performance data. Every instrument that can be performed has its own set of characteristics. Those characteristics include such things as, for example, the range of the instrument, whether or not the instrument is transposable (is allowed to have it's pitch changed during the modification stage), whether the instrument is currently muted, and the global volume ratio for that instrument.

Certain attributes of the instrument can influence other parts of the output. For example, inertia, which relates to the responsiveness to changes in dynamics, can influence other characteristics of the output. Each instrument will have different definitions for a variety of different parameters, such as velocity sensitivity, articulation possibilities, durational capabilities, instrument range, and other properties. These are different possible types of features that would be stored within the instrument properties. This file may be stored as part of a single show file, combined within a map or map files, or stored as a separate file. The instrument property list is dynamic, so that additional properties can be added as new features are implemented.

Figure 4:
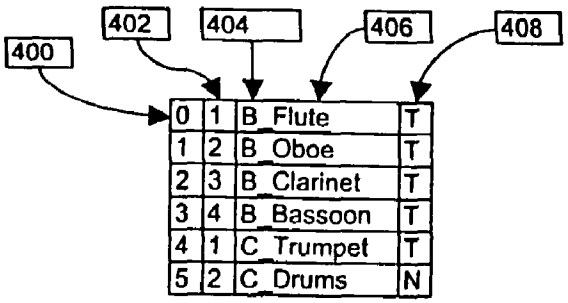
FIG. 4 is a schematic diagram of a preferred embodiment of an instrument template in accordance with the present invention.

To assist in collecting and defining all of these instrument characteristics, an instrument template can be constructed that describes the various features of each instrument. These templates can include a variety of different aspects, some of which are included in a sample template shown in FIG. 4. Some of basic components of the instrument definition include: the order of each instrument, a unique instrument id 400, which output channel each instrument will use 402, which port each instrument will use 404, the name or label of each instrument 406, and whether the instrument is a transposing or non transposing instrument 408. In FIG. 4, the instrument template contains six instruments. Of course, a greater number or a lesser number of instruments could be used.

Of these, four are associated with Port B and two are associated with Port C 404. Each instrument also includes a separate channel number. More than one instrument may share the same channel number and port, but care should be taken to avoid simultaneous use of the same port and channel. Note that the last instrument, drums, is a non-transposing instrument. This can be determined by inspecting column 408 regarding transposition. Note that the drums include an indicia, preferably, a symbol or character, and in an exemplary embodiment, the character "N" to indicate that the drums do not transpose. This means that if the pitch of the song is changed because of the activation of a transposition (change in pitch) event, the drums will not be effected by that event.

Figure 5:
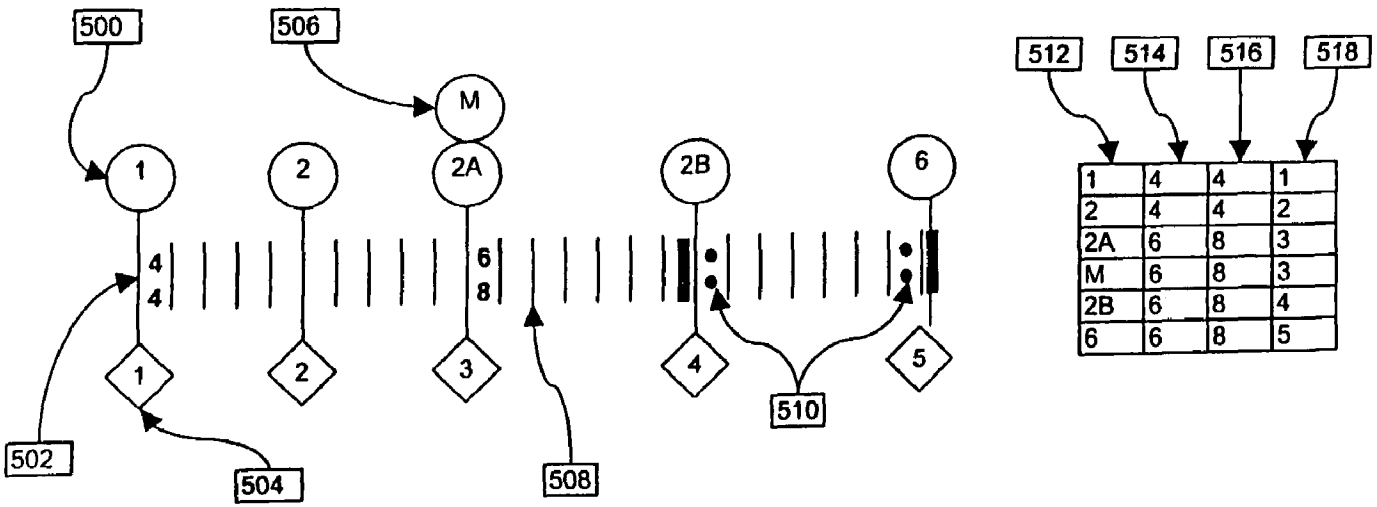
FIG. 5 is a schematic diagram of metrical information in accordance with the present invention.

Once the instrumental template has been defined, a song template is generated for each song. An example of this template is shown in FIG. 5 and is used to describe certain features of each song. Each song will be a specific length. Length in music is defined by the number of measures 504. Each measure has a certain number of beats 508. The number and type of beats within each measure will define that measure's meter 502. As well, the numbering of the measures may not be consistent within the score, so the specific measure labels will be input 500. Note that it is possible to have more than one label at any position 506. In the example, the third measure has two different labels: 2A and M. It is common for a score to have displaced, skipped, or added measures. The musical director and musicians will refer to these measures, and therefore the system needs to be aware of each of these locations as well. It is possible to use the strict underlying measure numbers, but this is not an optimal embodiment of the invention.

Note that the information as described in FIG. 5 is placed into a template which contains the same information. Thus, we have a label 512, a meter beat number 514, a meter subdivision number 516, an absolute measure location 518.

Figure 6:
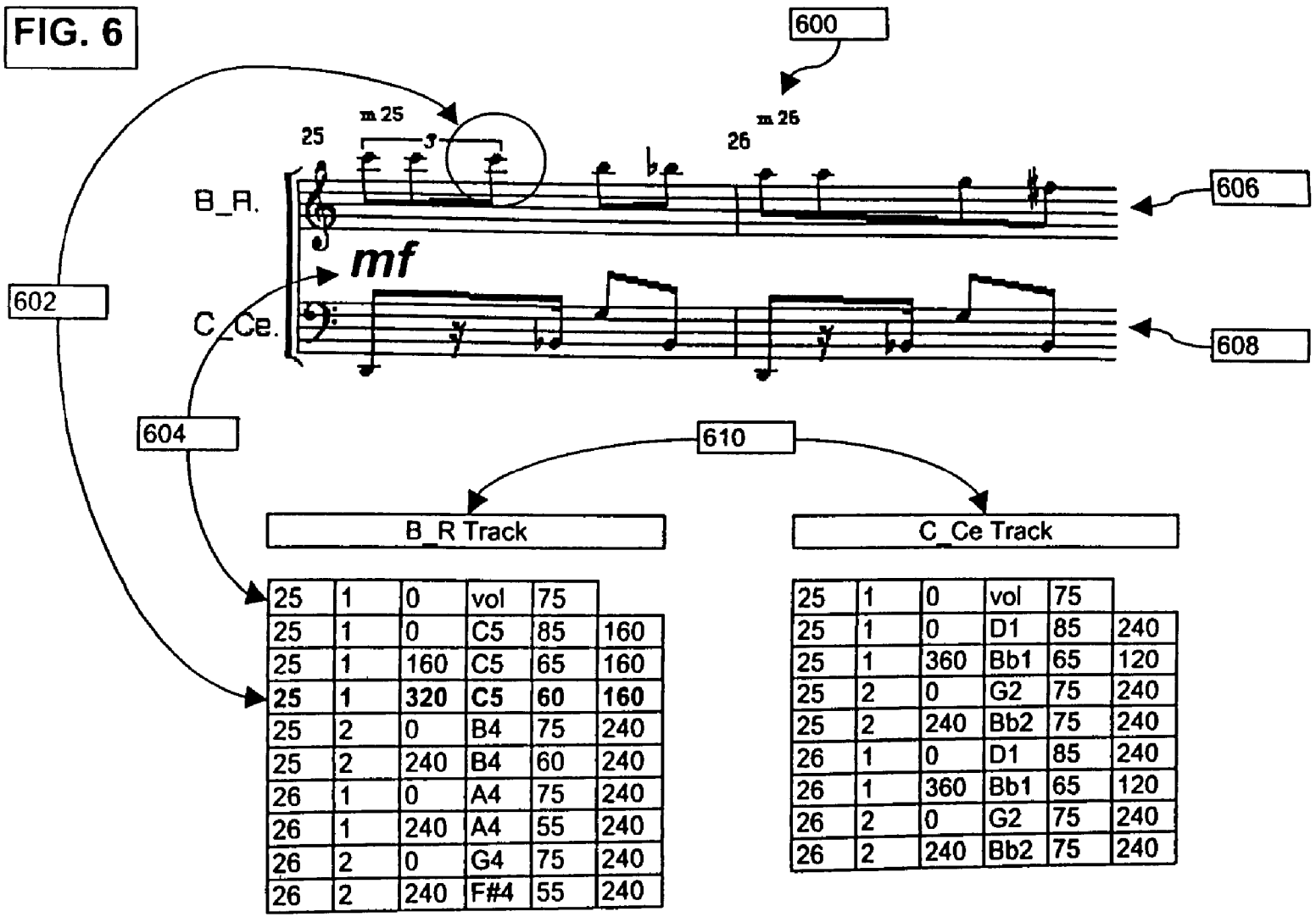
FIG. 6 is a schematic diagram of an embodiment of a representation of a score in accordance with the present invention.

Once the template is complete, then the input of the score can begin. FIG. 6 is a schematic diagram of an example of a representation of a score in accordance with the present invention. This initial entry of the score can be referred to as the first pass. Preferably, each song is placed in a separate file. Every note, duration, and time start point is programmed into the file. In addition, velocity (articulation) and volume (loudness) information is input. In the example song shown in FIG. 6, there are two instruments: B_R 606 and C_Ce 608. The song is two measures long, with the first measure being labeled 25 and the second measure labeled 26 600.

Each instrument line is stored as a series of note information. Thus, there are nine notes in the B_R part, and eight notes in the C_Ce part. Each list 610 stores these items of note information. In this list, the values for notes can be measure number, beat number, tick number (in some embodiments, there are 480 ticks per beat), note name, note velocity (how hard that note is stressed), and note duration. An example of a notated data and its equivalent is shown as 602. In addition, the mf marking in the score 604 indicates a volume. This is also recorded into the list. One way of performing this data input is by using an any of the many sequencing applications available on the market today, and using a variety of standard input techniques. Once this input procedure is complete, a pristine digital bit stream is created for the show. At this point, the show is ready to be imported into music system 106 (see FIG. 2). However, further refinement is also possible.

If desired, the show can be further shaped. Each song is carefully listened to, and additional information beyond the basic score information is added. This includes things like volume curves, more sophisticated patch information, note duration, start point modification, and velocity information. Certain instrument types may also have other parameters, such as brightness, accent, and sustain, for example. During this refinement step, these additional properties are defined. This version of the show is now available for any production that may need to use the score in the future. In other words, this show can be the basis for a first data structure. Preferably, this first data structure is not directly altered or modified but rather, non-destructive modifications are applied to the first data structure by the second data structure.

Figure 7:
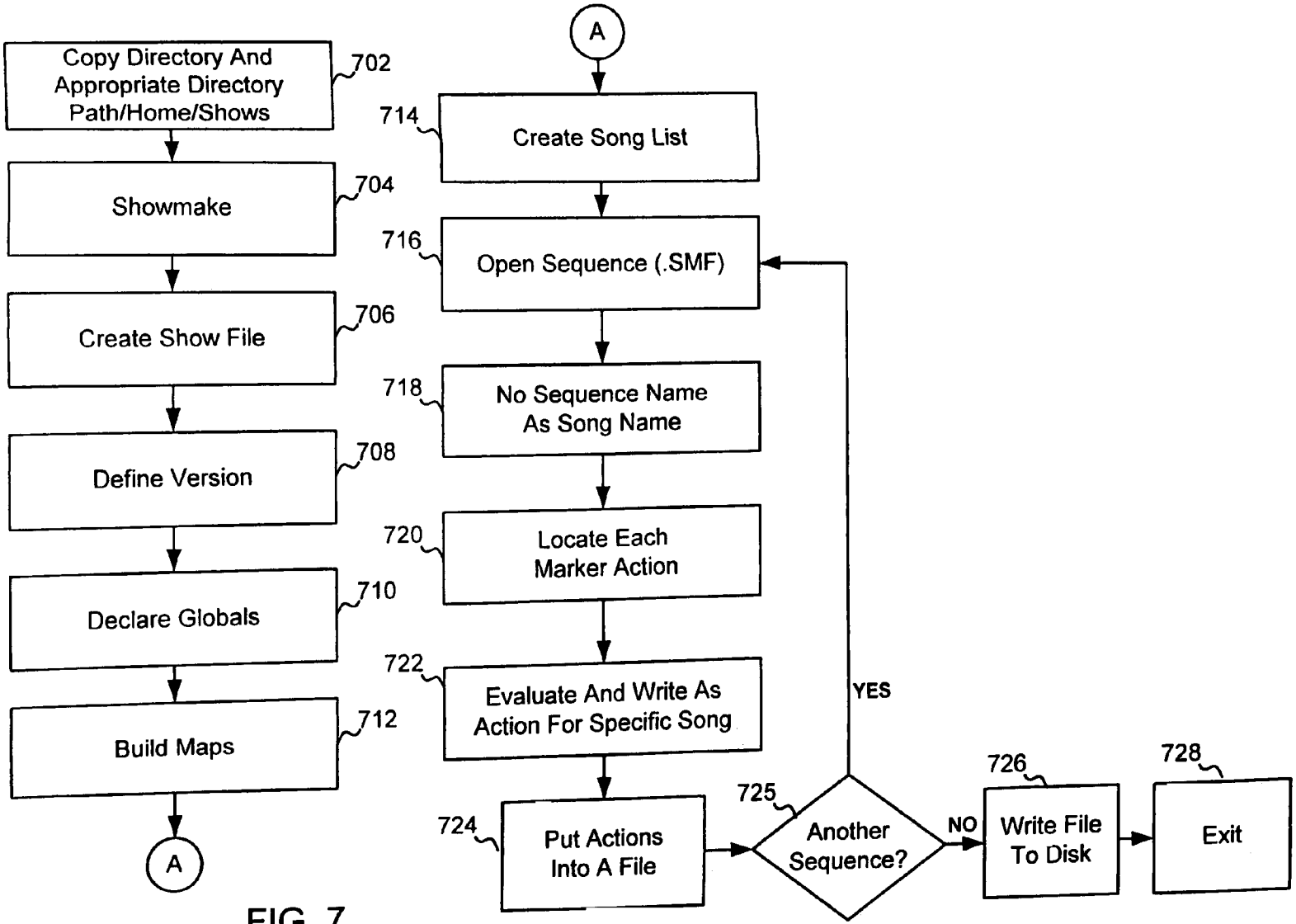
FIG. 7 is a flow diagram of a preferred embodiment of a method for importing a show in accordance with the present invention.

FIG. 7 shows a preferred embodiment of a flow diagram of an import procedure. Returning briefly to FIG. 3, the import procedure is step 308 of the input and refine score process. The import process begins by creating or copying appropriate directories and/or files, step 702. In this step, a new directory for the specific show is created. Preferably, this directory is given a convenient descriptive name, for example, the name of the show.

After this new directory has been created, an application is run, step 704. In some embodiments, this application is called the "showmake" application. This application can assist in performing one or more of the following steps.

In step 706, one or more new files are created. In some embodiments, this file is referred to by its extension, the .SHO file. This file can contain definition information.

In step 708 the version of the show is defined and in step 710 music system 106 declares globals. At this point, since the globals have not yet been defined, music system 106 simply establishes many of the globals and provides space for them in the .SHO file.

In step 712, maps are built. Maps will be more fully disclosed below. At this point, music system 106 establishes any pre-selected map structure and provides logical space in the .SHO file for later population with data.

In step 714, a song list is created. Preferably, a loop, shown in steps 716-725, is used to create the song list. Preferably, while the song list is created, definitions are retrieved from the songs and those definitions are stored in the .SHO file. In step 315, each sequence is opened.

The sequence refers to one of the pristine digital bit streams created in step 306 (see FIG. 3). Preferably, there is one sequence in a song. A song is that sequence plus all the additional information that is associated with that song. That additional information being the data that is included within the .SHO file. In other words, the song is the marked-up sequence or a sequence with additional data. The song can be thought of as a container of data which also includes reference to a sequence.

After the sequence has been opened, a name is given to the sequence and that name is added to the song list. This occurs in step 718. Preferably, the sequence path is also included in the definition file. By doing this, the sequence can be associated with a particular song. Preferably, the song can be given a different name than the sequence in order to preserve the sequence and allow for multiple uses of the same sequence with different songs.

In the next step, the sequence is examined for markers and/or meta events. Preferably, these meta events exist as tagged or associated comments within the pristine digital bit stream. These meta events can also be referred to as action events.

In a digital bit stream that represents music, for example, a standard MIDI file, markers can be place anywhere in the file. So a marker, that exists within a standard MIDI file as a tagged comment, is placed at a particular location within the sequence.

This available comment is associated with a particular location, and additional information, different than the musical information of the standard MIDI file, can be placed in that comment to provide instructions. During the build or import procedure, all these markers are extracted, along with their associated information and that is placed in the .SHO file. These will then become either the actions or the locations of the developed process. This happens in step 720.

Then the marker is evaluated and an action is written for that particular song. This occurs in step 322. This loop is continued until the end of the sequence is reached. Once the end of the sequence has been reached, the number of actions is counted and the count number of actions can also be stored. Both the count and the actions themselves are extracted. The actions are placed into the .SHO show file in step 324. The sequence is then closed.

In the next step, step 325, the system determines if another sequence exists. If there is another sequence, music system 106 (see FIG. 2) returns to step 316, and the next sequence is opened. The process returns to step 316 until all the sequences for giving musical or show have been completed. When there are no more sequences remaining, then the .SHO file is written to disk in step 326 and music system 106 exits in step 328.

During the import process, step 308 (see FIG. 3), music system 106 has the ability to split the meta event data into different categories. This information can be stored in a file. Each type of information can be stored in a separate data structure and can be saved to disk as a separate file. These divisions of meta event data are called maps. There can be a separate map for each song and for each meta event category. Each map can contain a list of actions and each action can be associated with a specific location. Some examples of maps that can be generated at build time include the following:

(1) Metric map: A list of all the location meta events (measures and targets), as well as the meter changes, and tap subdivision action meta events (2) Tempo Map: A list of all the tempo changes (3) Mute Map: A list of all instrument mutings and unmutings (4) Navigation Map: A list of all action meta events changing how the sequence is navigated in time (5) Dynamic Map: A list of all action meta events modifying the volume and/or loudness (6) Group Map: A List showing instruments and group relationship definitions (which instruments and groups are added or removed from group memberships)

(7) Velocity Map: A list of all events modifying the velocity for each instrument and/or group (8) Instrument Map: Maps changes to instrument definition values (9) Cruise Value Map: Maps changes to Cruise algorithm parameter values

(10) Duration Map: Maps changes in relative duration

(11) Pattern Map: Maps pattern definitions which can be applied to any instrument or group.

It should be noted that this is not an exhaustive list. Music system 106 (see FIG. 2) provides the ability to add additional maps to the sequence structure as needed.

This process continues until all of the songs for the show are imported or built. After that is done, the entire show has been built and a complete .SHO file is created, along with associated maps.

Later, significant changes might be made to adapt a show to suit a particular need. Those modifications are preferably stored in different show files, which can have different names and extensions. In one embodiment, .SHX files are created. These files have identical structure to the .SHO files, and are only different in that they can be edited by the user. .SHX are kept separate from .SHO so that the underlying editor knows not to allow any changes in a pristine .SHO file.

Preferably, the .SHO file should duplicate the show exactly as described by the score. So this will have all navigation information, all muting, all transposition information as the book shows. The book is the score so it's all the notes.

After the show has been imported into the system, users can make custom versions of the show, step 310 (see FIG. 3). When the Artistic Director is satisfied with the sound of the entire show, then the musical director from the production company can participate in the customization process and provide comments. This is where the show is individually crafted to meet the needs of the particular production. Every musical director has a different idea about the subtleties of the performance, and therefore every show will be different. Here the score is crafted to meet the specifications of the musical director.

In addition, the musical director will have tentative information about cuts, extra repeats, vamps, and other features of the show. Every production will perform in a slightly different way, either rearranging songs, skipping parts of songs, repeating sections different number s of times, and other arrangement changes. The musical director may also provide instructions as to which instrument or instruments are to be performed live, and which will be covered by the system.

Figure 8:
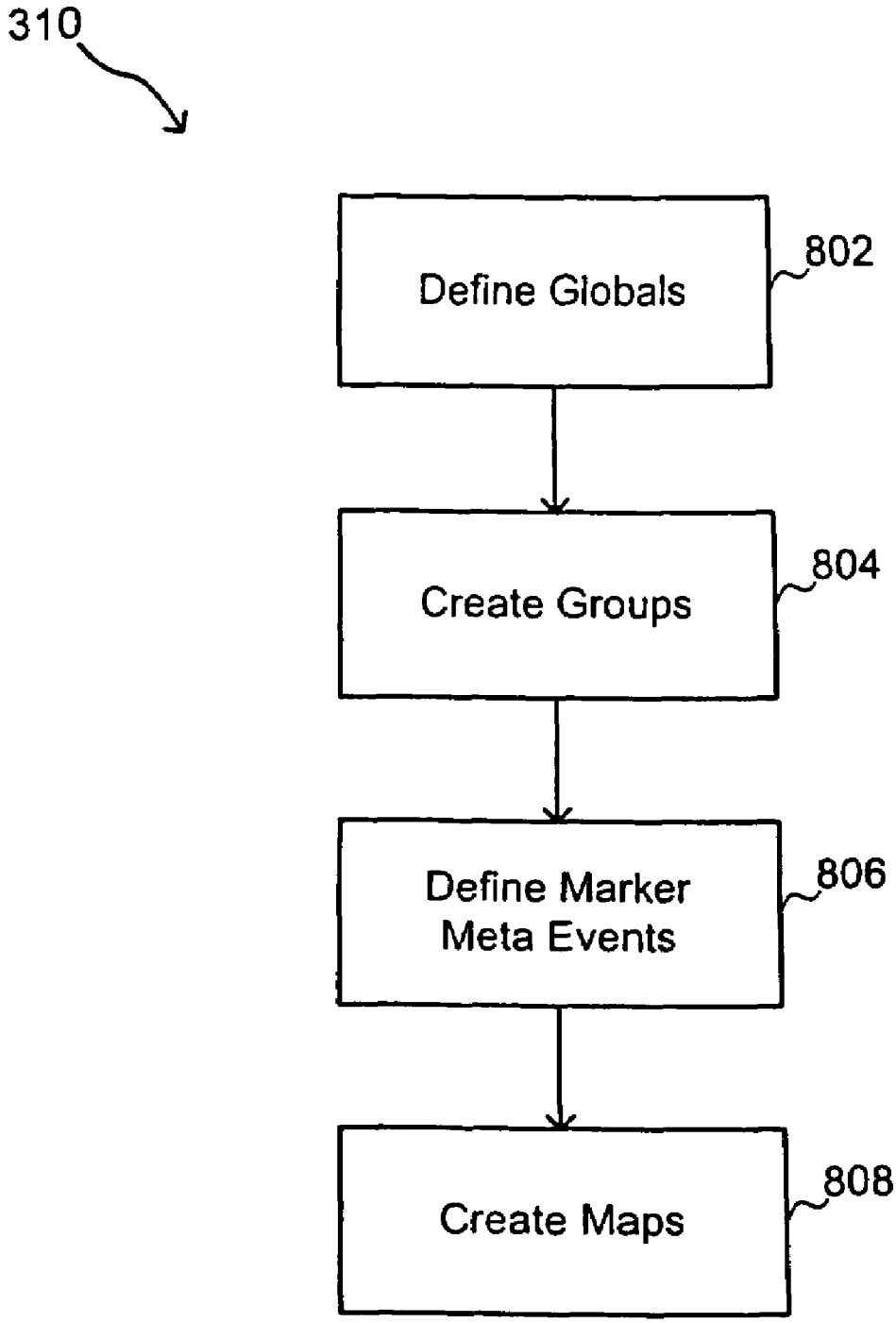
FIG. 8 is a flow diagram of a preferred embodiment of a method for making a customized version in accordance with the present invention.

FIG. 8 shows a preferred embodiment of a flow diagram of steps that can be conducted during the customization step, 310. As shown in FIG. 8, the customization process begins by defining globals, step 802. From there, groups are created in step 804. Then marker meta events are defined in step 806 and finally, maps are created in step 808. Taking each step in turn, step 802, define globals, is disclosed first.

One, some or all of the global attributes are set to a default, in some cases, zero or one. This can include the global overall volume, the global transposition, and any other global attributes that are desired. At build time these globals are set to whatever predetermined default conditions are considered appropriate by the software. These global attributes need to declared within a field.

Some global values include: whether the instrument is muted, whether the instrument is transposed, the velocity offset of that instrument, the volume offset of that instrument, whether the instrument allowed to transpose (it is not desirable to transpose certain types of instruments, for example, drums), what the sensitivity of that particular instrument's dynamic range, the inertia of the instrument, and any other desired definition.

After globals have been defined, groups may be created. Certain processes require that more than one instrument is manipulated simultaneously and in the same manner as other instruments. In other words, there are many times when it is desired that a single action will modify the output stream of more than one instrument, song, action, or section. In these cases, it is helpful to be able to combine certain components together, so that it is not necessary to repeat explicitly an action many times. For this reason, we define a set of groups.

To assist with this task, groups can be established. These groups can be either static, in which case membership in the group do not change, or dynamic, in which case the members of the group will change during the show or performance. For example, a static group might be called "winds," and all wind instruments can be associated with this group. So, the winds group can include flutes, clarinets, oboes, saxophones, and other wind instruments. Another group might be strings, another brass, to name a few. Other types of static groups might include registration, which can define instruments as treble (high), medium, or bass (low), and by instrumentalist.

An example of a dynamic group would be a group called "solo," which would contain all the instruments which are currently soloing. Membership in this group would change during performance. So, if at the beginning of a song there is a clarinet solo, the clarinet would be a member of the solo group. When its solo is completed, it would then be removed from the group, and whichever instrument was soloing next would become a member of the solo group.

For example, many pit orchestras require a wind player to be a "utility wind," this means that this musician will play more than one instrument. So, the musician designated "Reed 1" in an orchestra may play flute, clarinet and piccolo, and Reed 2 may play clarinet, bass clarinet, and tenor sax. In this type of group, Reed 1 would be represented by the three separate instruments played by that musician.

Groups may be treated as instruments in almost all ways because groups can be muted, have their volume changed, change articulation, or have any other desired characteristic changed. One difference is that instead of referring to a single instrument, track, channel and/or port, the groups reference a set of instruments or other groups.

Each song in a show itself has a number of attributes which need to be considered. Once again, the underlying data should not be affected, so a song data structure can be developed which contains this necessary information. Examples of this information include the underlying sequence or sequences and paths which show where these are located, paths to associated graphics files used for display, a unique identifier so the show can reference the song, a name which can be referenced by the user, and a structure of maps and map groups which can be used to influence the performance and output of the invention.

There are many different ways to define groups. They can either be defined at build time, during editing, or as part of a meta event action list. If done at build time, a group definitions file is included within the sequence list. This definitions file contains a template of instruments, with associated Join group action events, discussed below.

In order to control the behavior of groups, one or more of the following rules can be used: (1) A group contains a list of elements. These elements are considered a member of the group. All other elements are considered to be nonmembers of the group. (2) The group knows how to access its members. (3) A group may contain any number of instruments, elements and/or groups. Thus, a group may have as its membership elements b, c, and d, and another group e. (4) An instrument or group may belong to any number of groups. Thus, element a can be a member of both group b and group c. Likewise, group b can be a member of group c and group d. (5) No group may belong to itself. For example group a can not be a member of group a. However, it can be a member of group b. However, if group b is a member of group a, then group a may NOT be a member of group b. This includes being a member of a group which is a member of the stated group. (6) A group or element may join or quit any group of appropriate type. Other rules can be used as well.

It is possible to limit the ways of modifying a group. For example, a static group may not have its membership changed. A semi-dynamic group may allow membership changes to occur via mapped meta events, but not from external actions. A fully dynamic group may be modified by any type of action or meta event. Certain groups may be created or destroyed as well.

The type of group defines what type of elements can be members of that group. There are a variety of different types of groups. Possible group types are Instrumental groups, Action Groups, Song Groups, Map Groups, and Metric Groups.

Instrumental groups allow for multiple instruments to be modified equivalently by the same single action. This is compatible with the way that musical structures are thought. It is common, for example, to refer to a section of instruments by a family name: such as woodwinds, strings, brass, etc. If modification of all the instruments in a particular family is desired, for example, a user may want to make all the woodwinds softer from measure 1 to measure 10. If there were fifteen wind instruments, without the use of groups, fifteen different mute events would have to be created. However, with the use of groups, the same result can be accomplished with a single action, by assigning the mute event to a group called "Winds" that would include all of the fifteen instruments. This group, "winds" is also an example of a static group because this group contains a list of all the instruments that are considered wind instruments and this group generally would not change throughout a given show. So, flutes, clarinets, oboes, saxophones, and other wind instruments would all be members of this group. Another group might be strings, another brass, and so on.

Figure 9:
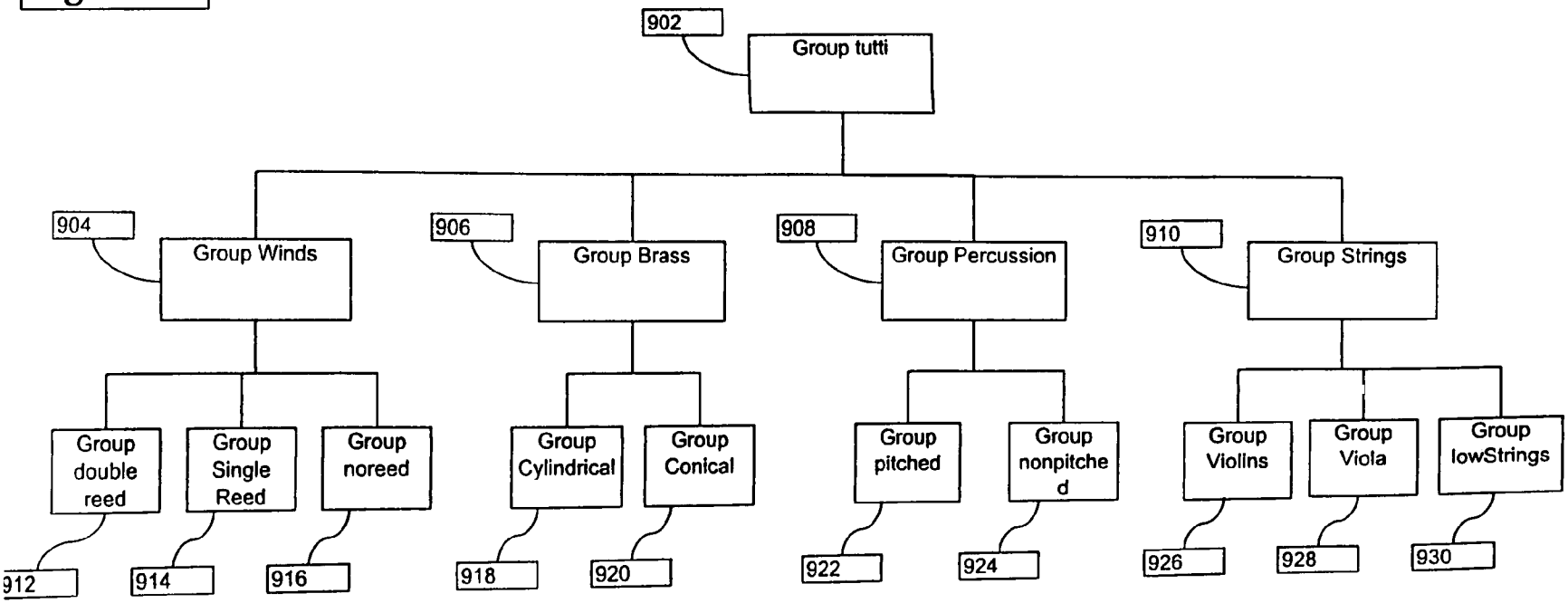
FIG. 9 is a schematic diagram of an example of groups in accordance with a preferred embodiment of the present invention.

It is also possible to define sets of subgroups within this structure, which continue to allow for easier management of instruments. FIG. 9 shows one example of such a structure. In this instance, there is a larger group called tutti 902 and within tutti, are four other groups: winds 904, brass 906, percussion 908, and strings 910. Each of these subgroups also contain groups. In this case, the wind group 904 contains a double reed group 912, a single reed group 914 and a non-reed group 916. The brass group 906 includes a cylindrical group 918 and a conical group 920. The percussion group 908 includes a pitched group 922 and a non-pitched group 924. And finally, the string group 910 includes a violin group 926, a viola group 928 and a low string group 930. This is just one of many possible group structures that can be developed. Group structures will often be determined by the specific requirements of a particular show or production.

Figure 10:
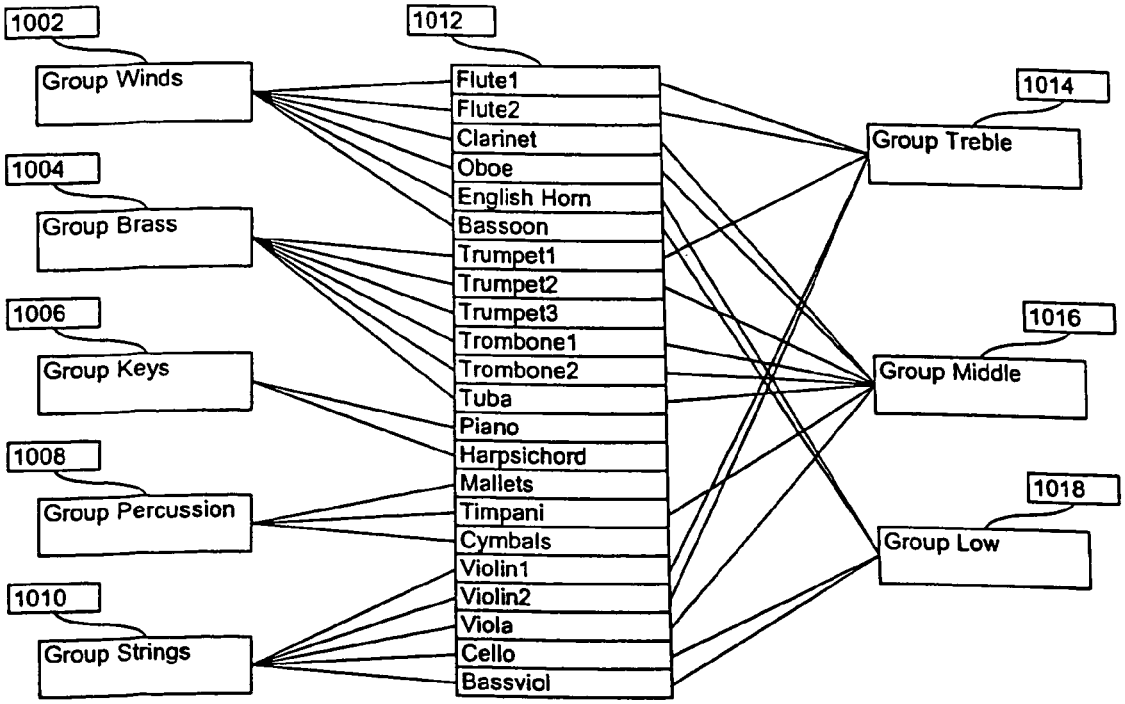
FIG. 10 is a schematic diagram of an example of groups in accordance with a preferred embodiment of the present invention.

Another possible static group could be based on registration, which defines instruments as treble (high), medium, or bass (low). This would allow a user to change the volume of all bass instruments, for example. FIG. 10 shows an example of two different sets of static groups. Instrument list 1012 represents a fairly typical medium sized orchestra. Its members have been assigned to several different groups. Flute 1, for example, is a member of group winds 1002 as well as group treble 1014. In this way logical operations may be used to select instruments from multiple groups. For example, a meta event may be applied to the following operation: group "Winds" AND group "Treble". This event would only be applied to instruments which are members of both groups. Likewise, group "Winds" OR group "Treble" would apply to any instrument which is in either group. Group "Winds" AND NOT group "Treble" would apply to any instrument which is a in group Winds but not in group "Treble". Allowing for logical operators can create even more flexibilities.

An example of a dynamic group would be a group called "solo," which would contain all the instruments which are currently playing the main melody. This would change during performance. So, if at the beginning of a song there is a clarinet solo, the clarinet would be the member of this group. When its solo is completed, it would then be removed from the group, and whichever instrument was soloing next would be added.

Another possible group definition would be by instrumentalist. Many pit orchestras require a wind player to be a "utility wind," this means that this musician would play more than one instrument throughout a given song or show. So the musician designated "Reed 1" may play flute, clarinet and piccolo. And "Reed 2" may play clarinet bass clarinet, and tenor saxophone, and so on. Reed 1 would be represented, in this case, by 3 separate instruments, so a group called "Reed 1" can be established. The Reed 1 group would include all of the instruments played by the musician designated as "Reed 1."

Figure 11:
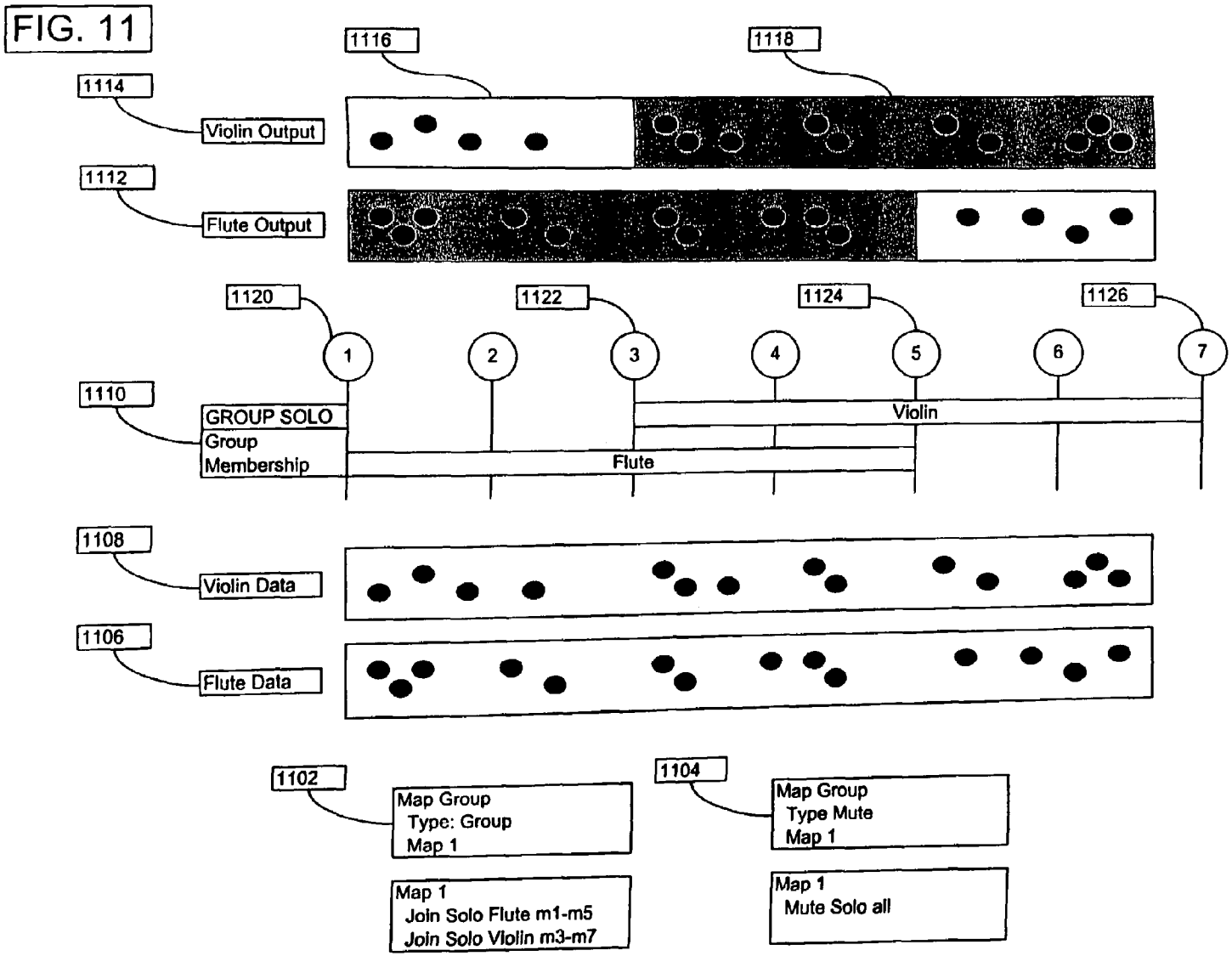
FIG. 11 is a schematic diagram of an example of a dynamically allocated group in accordance with a preferred embodiment of the present invention.

FIG. 11 shows an example performance of a dynamically allocated group. 1106 is underlying flute data (the dots represent notes in a digital bit stream), and 1108 represents notes in for a violin. 1102 shows the group map that defines that the flute is a member of the group "solo" 1110 from measure 1 1120 to measure 5 1124, and violin is a member of the group "solo" 1110 from measure 3 1122 to measure 7 1126. Map Group Mute 1104 contains a mute event which mutes all members of group "solo" for the entire song. Because both instruments are members of the group "solo" for parts of the song, the result is that the output of each 1114 and 1112 is partially muted, during the period in which the instruments are members.

This muting based on membership in the "solo" group results in the following outputs for the violin 1114 and the flute 1112. Violin output 1114 will be unmodified by the map group in the first non-shaded region 1116. But, because the violin becomes a member of the solo group from measures 3-7, and because the solo group has been muted, violin output 1114 becomes muted in the second shaded region 1118. Similarly, flute output 1112 is affected by its membership in the solo group and the fact that the solo group has been muted. Flute output 1112 is muted in a first shaded region, measures 1 through the end of measure 4, and is un-muted, or unaffected by the muting of the solo group in a second unshaded region, measures 5-7. Therefore, music system provides musical output for the non-shaded regions and mutes the musical output for the shaded regions of the respective violin and flute outputs 1114 and 1112.

Groups can be defined at a number of different times and places in the production process. Some of these include: during show build, in the editor, as part of a meta event action list or as the result of external actions in real-time. If done at build time, then a group definition file is included within the sequence list. This definition file contains a template of instruments, with associated join group action events.

It can also be useful to group multiple actions, discussed below, to be performed simultaneously with the execution of a single action command. For example, one might want to perform the following list of actions: stop, relocate to measure 10, atempo, unmute flute. In order to conveniently accomplish all of these tasks, an action group can be established.

Songs may also benefit from grouping operations. For example, there may be many songs which are interludes (transitional music between scenes). If the director wants all the interludes to be louder, it would be more convenient to assign an action to address all of the instruments that play during the interlude for the duration of the interlude. So, a group can be established where any instrument that plays during the interlude would be a member that group. In some embodiments, the group can include a descriptive name, such as "songinterludes."

It is useful to be able to associate certain ranges of measures within a song or with other ranges. For example, there may be a short section of music which is used repeatedly within a song. It is useful to define these related sections as belonging to the same metric group. So, measures 5-10 may have similar material to measures 15-20. These would be assigned to the same group, given a unique label, and then could be referenced by the same meta event.

Preferably, embodiments of the invention provide provisions that permit the ability to make changes to the interpretation and performance of each show without modifying the underlying pristine data or the first data structure. These changes need to be both stored for future playback as well as capable of modification during real-time performance. In addition, the ability to record performance information from the external control is desirable. This data can be used either for analysis or for additional modification of future performances. In order to assist in the implementation of these requirements, embodiments of the invention can use data structures defined as maps.

Every show and song can include one or more maps that influence certain parameters of the performance. If a map is not present then that particular parameter's output is not affected by a map dealing with that parameter. However, if a map exists, then modifications to that parameter occur based on the information contained within the map. These maps may be very sparse or very dense, depending on the desired output.

Each map contains a list of modifications for the associated parameter or parameters. Each modification can be either tied to a metric location or tagged as extra-metrical, and therefore subject to being used arbitrary by other processes. Multiple maps modifying the same parameter can be superimposed within map groups. This can provide even more flexibility to the modification procedures.

In addition there may be higher level maps which are responsible for manipulating more than one parameter, and meta-maps, which define and modify other maps. This entire structure of maps would be stored within predefined data structures, and could be dynamically changed or recorded in performance or rehearsal situations.

Figure 12:
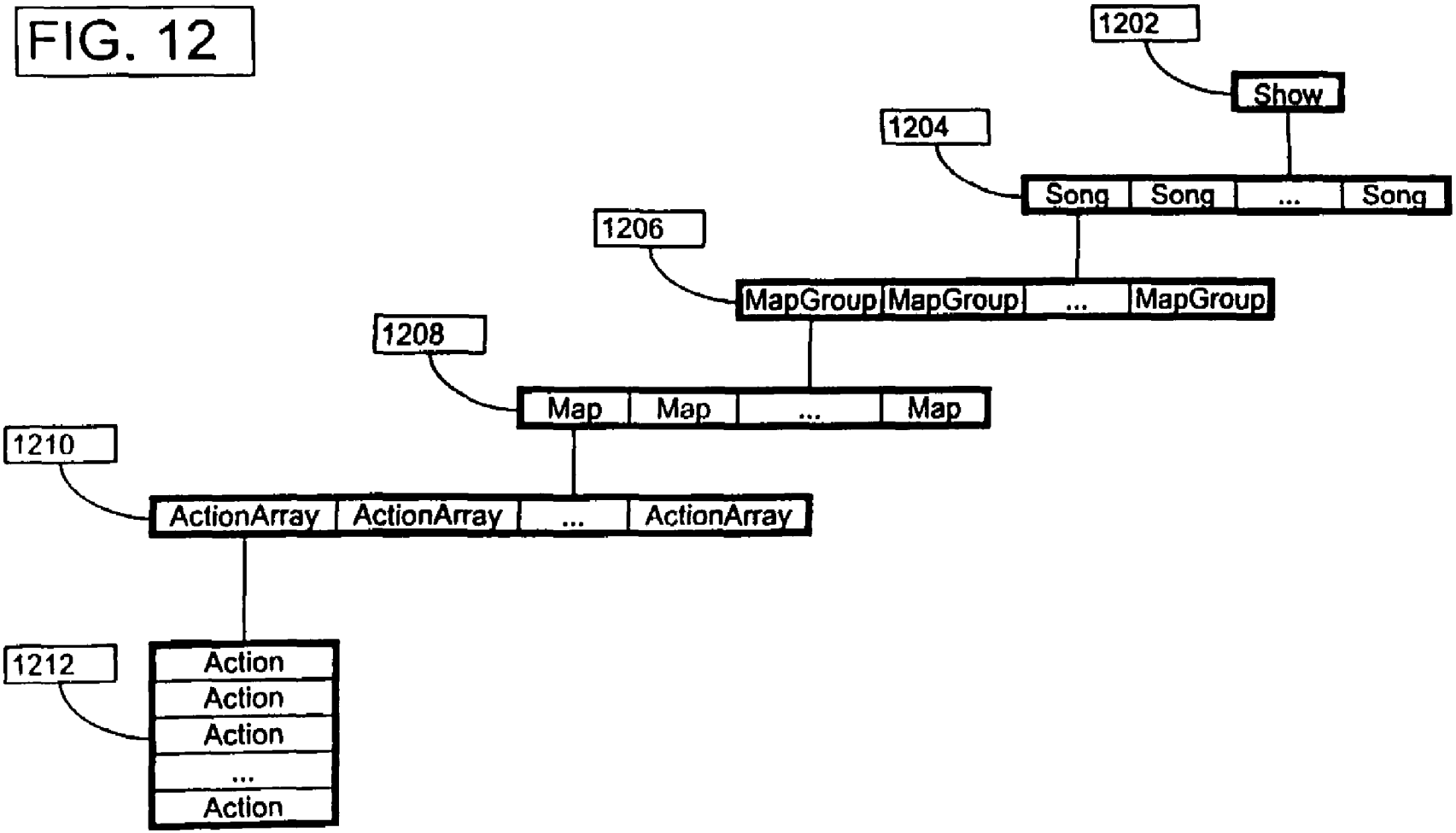
FIG. 12 is a schematic diagram of a preferred embodiment of a map structure in accordance with the present invention.

A preferred embodiment of a map storage structure is shown in FIG. 12. A Show 1202 contains an arbitrary number of Songs 1204. Song 1204 contains an arbitrary number of Map Groups 1206. Map Groups 1206 contain an arbitrary number of Maps 1208. Maps 1208 contain an arbitrary number of Action Arrays 1210, and Action Arrays 1210 contain an arbitrary number of actions 1212. Other structures may also be developed.

Some possible types of maps can include the following:

Metric Map: Contains measure numbers, meter markers, embedded target values, and default tap subdivisions.

Tap Map: Contains tap subdivision information

Tempo Map: Contains tempo curve of performance

Dynamic Map: Contains volume modifiers for instruments and groups

Velocity Map: Contains velocity multipliers for instruments and groups

Mute Map: Enables or disables instruments and groups

Duration Map: Relative duration of events for instruments and groups

Transposition Map: transposition of music

Cruise Value Map: parameters used to develop the cruise algorithm.

External Control Map: Modifications to the external input

Instrument Map: instrument properties.

Pattern Maps: Higher order map which contains patterns which can be applied to a variety of parameters and instruments.

Articulation map: Contains articulation information for various instruments and groups Group Map: Controls assignment of instruments and groups to groups Pitch Map: Maps incoming note values to a different set of output note values MIDI Event Map: Contains raw MIDI data and/or digital bit stream data that can be introduced into the output stream 112 (see FIG. 2).

Because more than one map effecting the same parameter may exist within each song, some form of organization can be used to ensure that no conflicts occur. The preferred embodiment is the map group. A map group contains one or more maps of the same type, and each map is assigned its own priority and merge method.

Examples of merge methods are masking, multiplying, averaging, and summing. Other techniques of merging maps may be defined as well.

An example of a masking merge method relies on the priority of the various maps. Each map is assigned a relative priority to the other maps within this map group. If there is a meta event conflict between two different maps, such that two different instructions are given within the same time range, then the meta event from the higher priority map will be used. This is called the masking priority rule.

Figure 13:
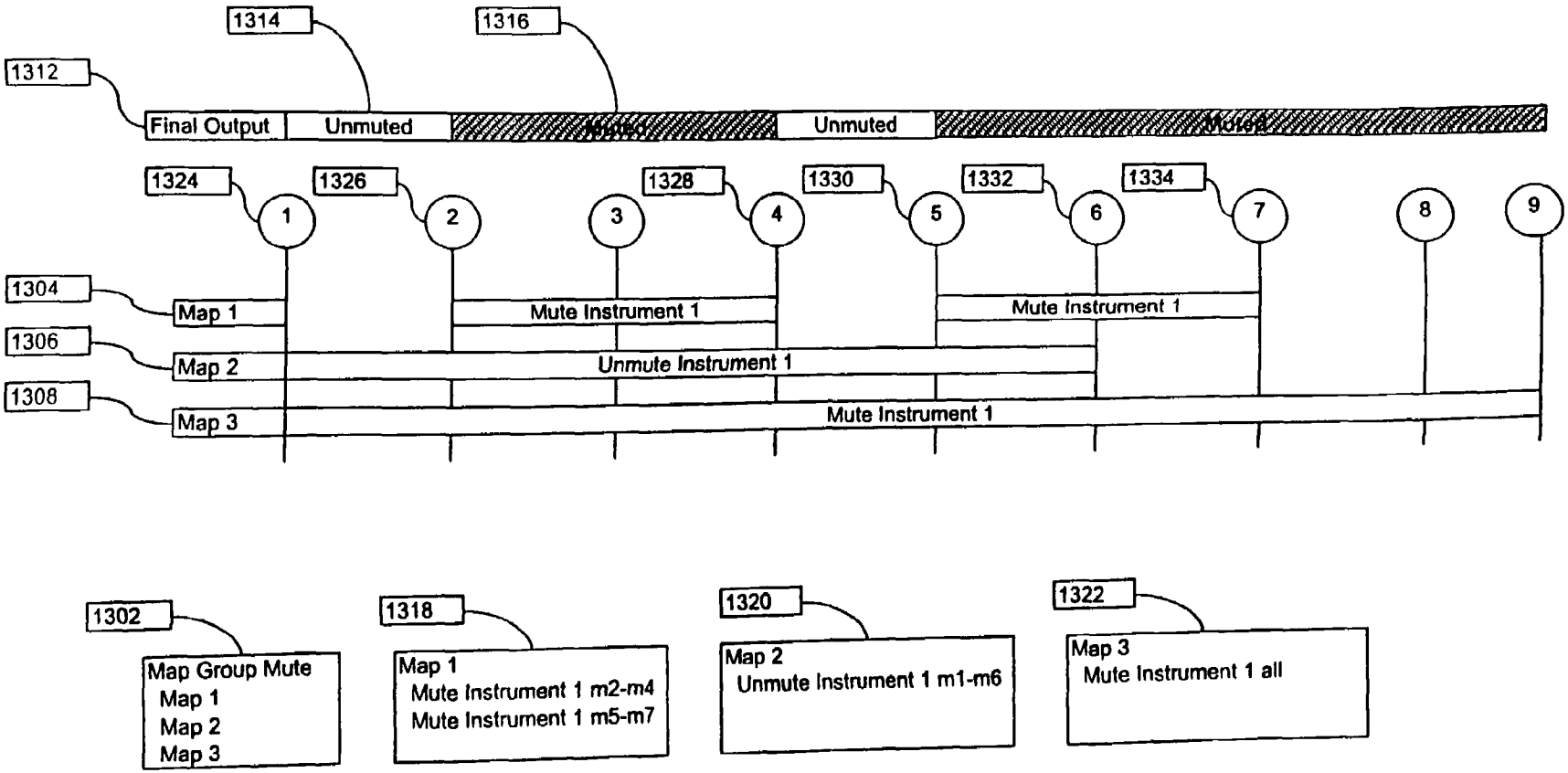
FIG. 13 is a schematic diagram of a preferred embodiment of a map group in accordance with the present invention.

In one embodiment, a map group that uses masking will ignore map information from a lower priority group. An example of a simple map group using masking is shown in FIG. 13. In this example, a map group 1302 contains three maps: Map 1 1318, Map 2 1320, and Map 3 1322. Map hierarchy can be defined or established in many different ways. One way is by list order. In this case, since Map 1 is first on the list, it has been given the highest priority. Other ways of establishing priority can also be used. Map 2 follows Map 1 and Map 3 follows Map 2. Therefore, in this example, Map 3 has the lowest priority.

If all maps were empty, then the default state would be for instrument 1 to be unmuted. However, there is information in the maps. As shown in FIG. 13, Map 3 1322 includes an action which provides an instruction to mute instrument 1 for the entire song. However, Map 2 1320 contains an instruction that Instrument 1 should be unmuted from measure 1 1324 to measure 6 1332. In addition to these maps, Map 1 1318 includes an instruction for instrument 1 to be muted from measure 2 1326 to measure 4 1328 and from measure 5 1330 to measure 7 1334. Obviously, there are some conflicts between the different maps. An instrument can not be both muted and unmuted simultaneously, as is required in measure 2 1326 by the various maps.

The masking priority rule makes this decision simple, and the results can be seen in the final output line 1312. As the song moves through the measures, we see that the instrument will play in measure 1, where the result is unmuted 1314. Map 1 1304 overrides this command in measure 2 1326, and the instrument becomes muted 1316. When map 1 no longer contains information, the command associated with Map 2 1306 is now the highest priority, and therefore the instrument is now playing again 1316. The conflicts are resolved in a similar fashion through the rest of the song.

Figure 14:
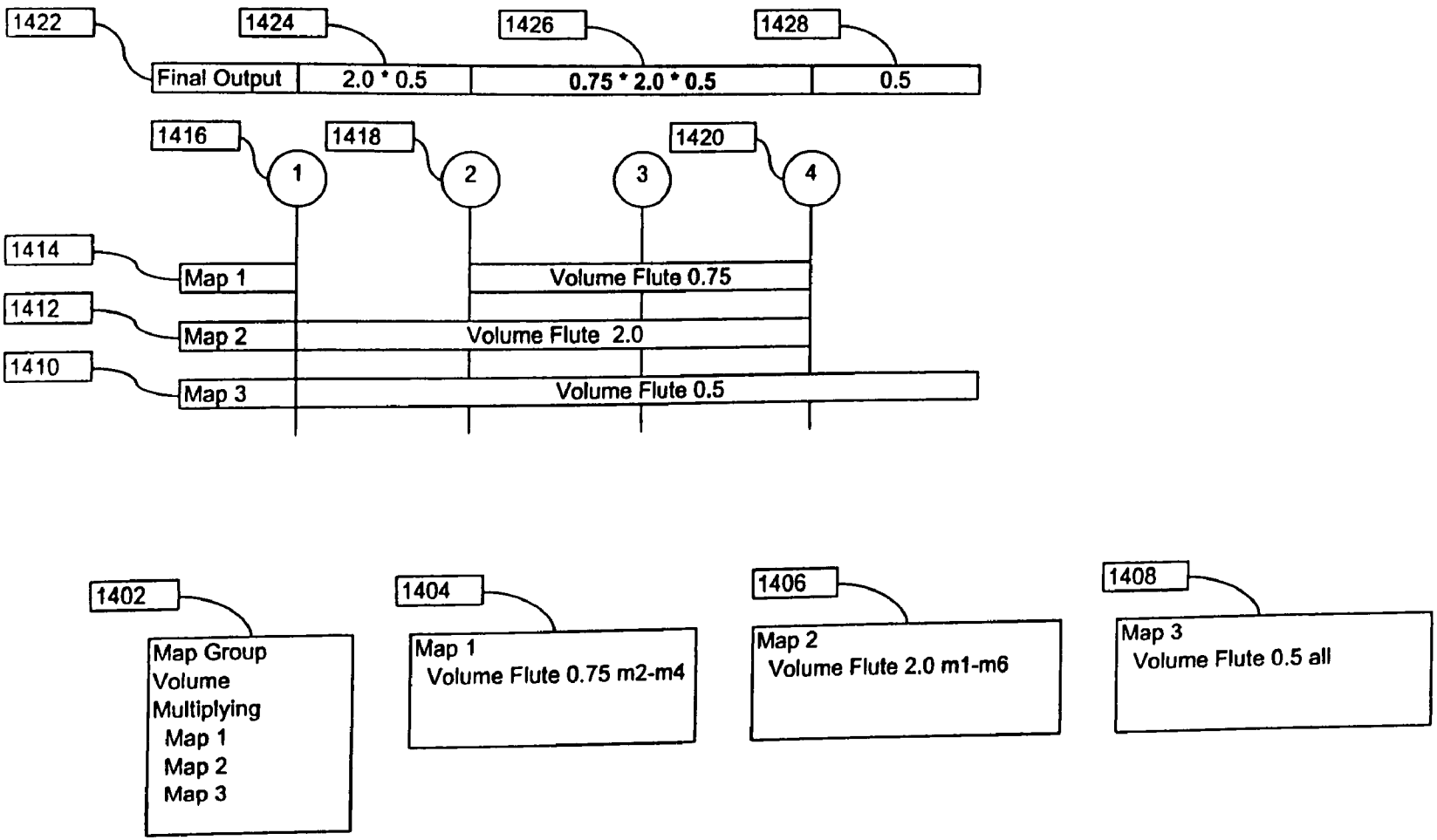
FIG. 14 is a schematic diagram of a preferred embodiment of an example of a combined map group in accordance with the present invention.

FIG. 14 shows a different result based on a mute group that uses multiplying. In this example, there are three maps within the map group 1402. These maps have been instructed to use a multiplying algorithm, where the result is the product of the three maps. Here, if all maps are empty, the final output would be the unity value of 1 and the instrument would play at a pre-selected volume. However, these maps all contain values. Map 1 1404 shows that the volume offset for the flute instrument is set to 0.75 for measures 2 1418 through measure 4 1420. Map 2 1406 shows that flute should have a volume multiplier of 2.0 from measure 1 1416 to measure 4 1420. Finally, Map 3 1410 shows that the Flute should have a volume multiplier of 0.5 for the entire song.

The result 1422 shows that for measure 1 1416, the result will be the product of the action in Map 2 1412 and in Map 3 1410. Thus 2.0*0.5=1, the product 1424 for the final output of measure 1 1416. Since there is no information in Map 1, it is ignored. In measure 2, however, all three maps contain information, and therefore the result is the product of all three maps: 0.75*2.0*0.5, or 0.75 1426. This is true through measures 2 1418 and 3. At measure 4 1420, the only map with information is Map 3 1410. Here the result is 0.5 1428.

Other Map Merge methods work in similar fashion, but using different algorithms. Thus, if I were to change the merge type in N1002 from multiplying to averaging, the results would be different. N1024 would be (2+0.5)/2, or 1.25. N1026 would be (0.75+2.0+0.5)/3 or 1.0833. N1028 would still be 0.5.

If the merge type was summing, then the algorithm would be a simple addition of each action during the time of its activation. A weighted average type would assign a weight value to each map. Other merge types can be defined as required.

A possible set of map group attributes are defined as follows: (1) type, (2) number of maps, (3) maps, and (4) merge method. Type refers to the type of map group, such as muting, volume, among others. Number of maps refers to the number of maps contained within the map group. Maps is an ordered list containing information on how to access these maps, and merge method refers to the formula used to combine multiple maps within the map group. In some embodiments, the order in which maps appear in the map group determines the priority of the map. Additional Map Group attributes may be defined as needed.

A possible set of map attributes includes (1) type, (2) name, (3) number of action arrays, and (4) action arrays. Type refers to the type of map. Name is an identifier used for descriptive purposes. This way the user can use convenient names to describe each map. Number of Action Arrays refers to the number of action arrays that the map contains, and Action Arrays is a list, sometimes an ordered list, containing information on how to access the action array. Additional Map Group attributes may be defined as needed. Action arrays may contain any number of related actions.

Of the many maps, one is unique: the metric map. The metric map for each song lists all the information about the measures and beats contained within the song. These then directly reference embedded markers within the pristine digital bit stream. This map can then be referred to by other maps when evaluating when actions should be activated. Because this map is related to the pristine digital bit stream, and since these files will never change, it would be unusual to make any modifications to this map.

Maps and Map groups can be created in a variety of ways. Some of these ways include: (1) generating from the underlying MIDI files during the build process, (2) recording from the output stream during rehearsal or performance, and/or (3) using an editor to add, change or delete a map and/or a map group.

FIG. 15 shows an embodiment including a possible sequence of events that demonstrates one technique for developing a set of maps for a song. First, the basic maps are created during the build process 1502. First, the pristine digital bit stream file is opened, and a metric map generated 1504. This map is then associated with the pristine digital bit stream. Next, a tempo map can be extracted 1506 from the tempo markings contained within the pristine digital bit stream. Any embedded meta events can be extracted and placed into appropriate maps 1508. Once completed, the song can then have the appropriate map structure generated 1510 containing the basic information. After that has been completed, an editor can be opened 1512 to further modify or edit the various maps.

FIG. 16 shows a possible example configuration for a basic map structure after a build has been performed. In this example, song "MYSONG" 1602 is generated from a sequence entitled, "MYSONG.MID 1606. The relationship between the song and the sequence is mediated by the metric map 1604. The metric map contains all the information required to locate actions associated with maps and map groups. In this instance, the metric map includes metrical information from the sequence or pristine digital bit stream 1606. In this example, the metrical information would include events 1652, 1656, 1658, 1660 and 1664. From other information contained in pristine digital bit stream, the build process generates an additional three map groups, and places them in the map group list 1608. The first map group, tempo 1610, contains a single map 1612, which holds tempo information. In this case, there is one item of tempo information 1604, where a quarter note is defined as 120 beats per minute, and that this happens at location m1. The next map group is the navigation group 1614. Pristine tempo navigation map 1612 contains information about a repeat type event 1662. Finally, a Mute Map group 1618 is generated, since event 1616 contains information related to muting a flute. This is contained in a single Map 1620.

Note that these files are defined as "Pristine" Maps. They contain only the information which is contained within the underlying pristine digital bit stream file 1606. Also, in this example and at this time, no additional maps have been generated. It is possible that the build process would generate a pristine map and map group for every type of map, but this has not been done in this example.

Before performance, a show version is loaded. Each Show version contains a list of the maps which it is using. Along with the show version are loaded the core sequence files. These sequence files are in smf format, but may be extracted as they are placed into the performance structure. The core tempo maps may contain higher level information which is compiled into show structures at load time.

As a song progresses, the scheduler checks the sequence file for any time stamped data. If the data exists, then it outputs that data to the post processor. The post processor evaluates the data, checks it against any modifications as applied to current states and outputs the modified data. The scheduler also checks at each clock cycle for any map update information. If this exists, then the associated parameter is modified. If the modification of the parameter results in changing the state of any current event, then that event is modified.

Preferably a sequencer schedules various tasks. A map group can be a subclass of task. A track, preferably a MIDI track, can be a subclass of a task. A task can have the following attributes: (1) next Tick and (2) "Do Event" function. When a map action is executed by the scheduler, all maps within the group are consulted using the specified merge method. Another possibility is to merge all map groups together during load time.

When a song is selected the following occurs:

all maps are scheduled (next tick, function, and parameters are inserted into the scheduler).

any initial map values that need to be set before playing.

when it's time to execute the task, the task function is called with the parameters.

the function should automatically reschedule the task.

The parameter for the map task function is a pointer to the Map Group.

Certain types of maps may contain information which is not time specific, or is to applied to all songs. If a mapped event contains the appropriate indicator, then the event is used in a different way then the scheduled event structures as described above. Activation can occur in a variety of ways. Some of the ways include, all, and on.

AlwaysOn—action is always on (active).

Trigger—Action is dormant until activated by external event or other action.

It is also possible to envision a global map, which can be included in all map groups of a particular type. For example, if I wanted to mute the flute for the entire performance, it would be possible to generate a map called "GlobalMute", place a mute flute all event into it, and then include it in all Mute Map Groups for the show.

Figure 17:
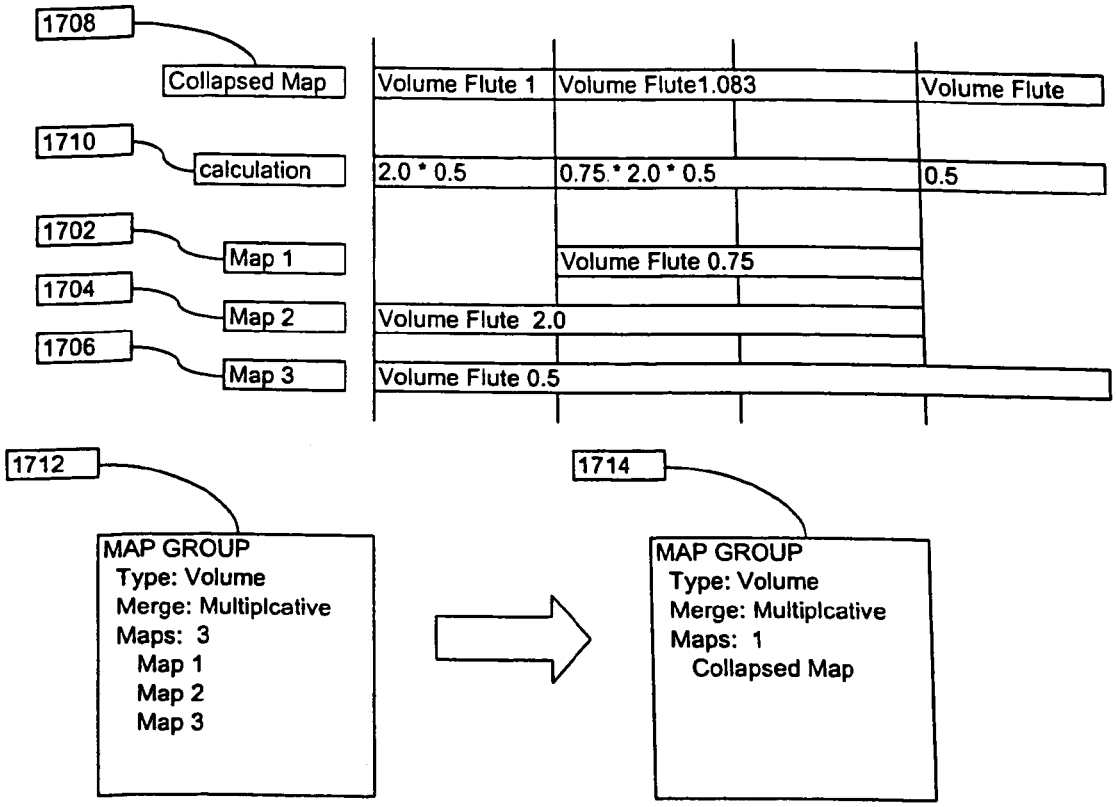
FIG. 17 is a schematic diagram of a preferred embodiment of a map structure in accordance with the present invention.

It is easily possible that after a number of rehearsals and edits, that a set of maps within a map group becomes cumbersome and unwieldy. If this is the case, it is easily possible to generate a map which contains the values of the dynamically merged maps. At this point, other maps can be removed from the map group and replaced with a collapsed map FIG. 17 shows an example of a collapsed map. Information from FIG. 14 is used in this example. Here, the three map groups. 1702, 1704, and 1706 all combine into a final map group 1708. The resulting Map Group would change from a first map 1712 to a second collapsed map 1714. Although there is no difference in performance, there is now only one map in the 1714 in the map group.

Sometimes it is desirable to keep a map, but not use it in a particular situation. These maps can be removed from the Map Group, and stored in a separate file location. Of course, it is important to be able to identify which underlying MIDI sequence the map refers to.

Music system 106 preferably includes a loading procedure. This load procedure can occur at various times. For example, the load procedure can occur when music system 106 is turned on, when new shows or songs are loaded into music system 106 or the load procedure an occur when music system 106 is instructed by a user.

Figure 18:
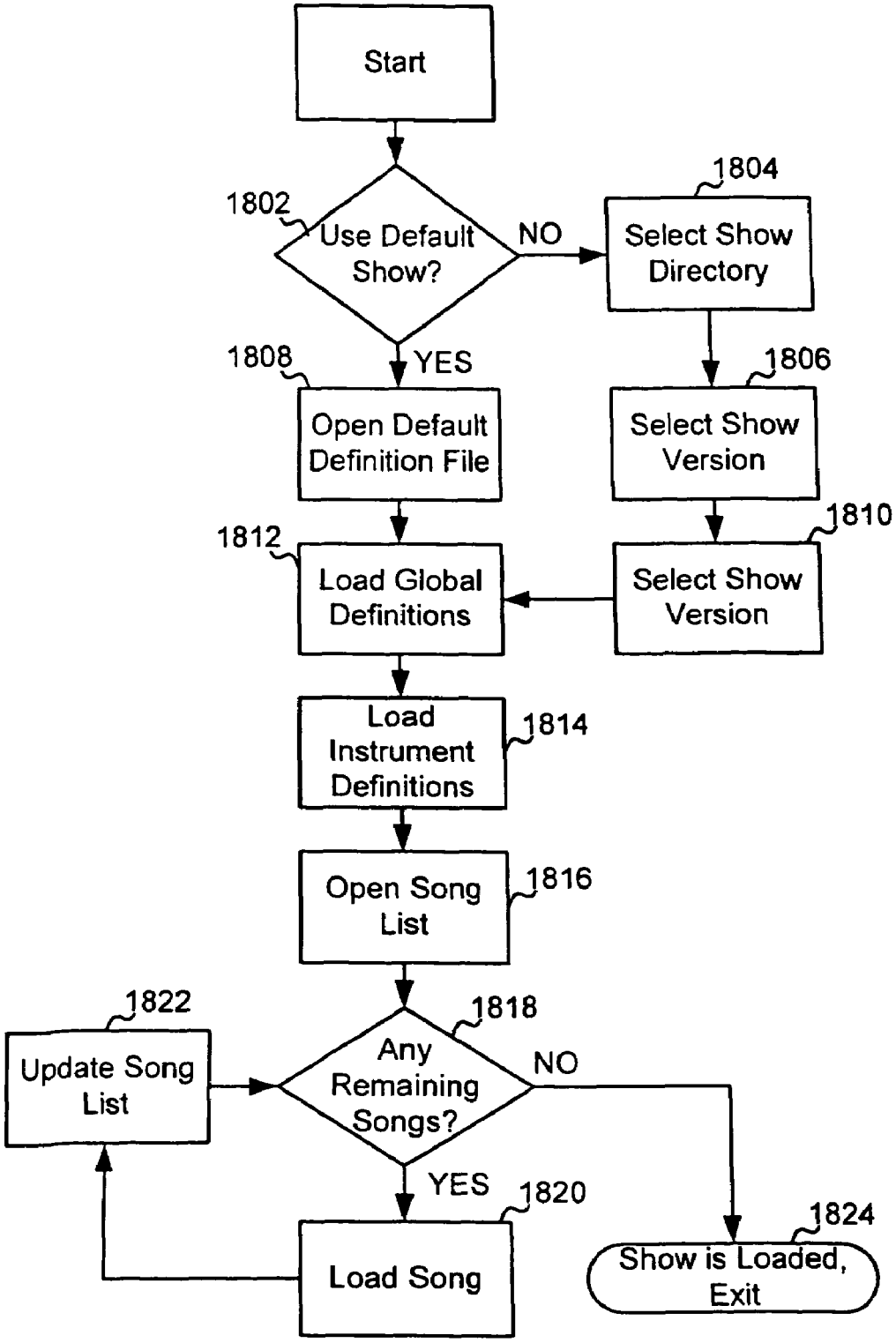
FIG. 18 is a flow diagram of a preferred embodiment of a load process in accordance with the present invention.

FIG. 18 shows a preferred embodiment of a flow diagram of a load routine. The example shown in FIG. 18 is of a show being loaded, but principles of can of the load routine can be applied to songs and other types of data structures that are loaded into music system 106.

The load process begins with a decision to either use a default show 1802. Music system 106 can ask the user if a default show should be used or music system 106 can search for shows. Music system 106 could also do both, by first searching for shows and then asking the user to select one of the shows. If no shows are found besides the default show, then music system 106 assumes that the default show should be used.

If the default show is used, the load process proceeds to step 1808 where the default show is opened. If the default show is not used, then music system 106 asks the user to select a show in step 1804. After a show has been selected in step 1804, music system 106 asks the user to select a show version in step 1806. After the appropriate show and version has been selected and opened or after the default show has been opened, music system 106 then loads global definitions in step 1812.

After the global definitions have been loaded, instrument definitions are then loaded in step 1814. The song list is then opened in step 1816. After the song list has been opened, the load process enters a loop where all of the songs associated with the score are loaded. In step 1818, music system 106 determines if any songs remain. If songs remain, then the next song on the list is loaded in step 1820. The process moves to step 1822 where the song list is updated to indicate songs that have already been loaded. The load process returns to step 1818 to determine if any songs remain that have not yet been loaded. When no songs remain, the load process ends at step 1824.

Figure 19:
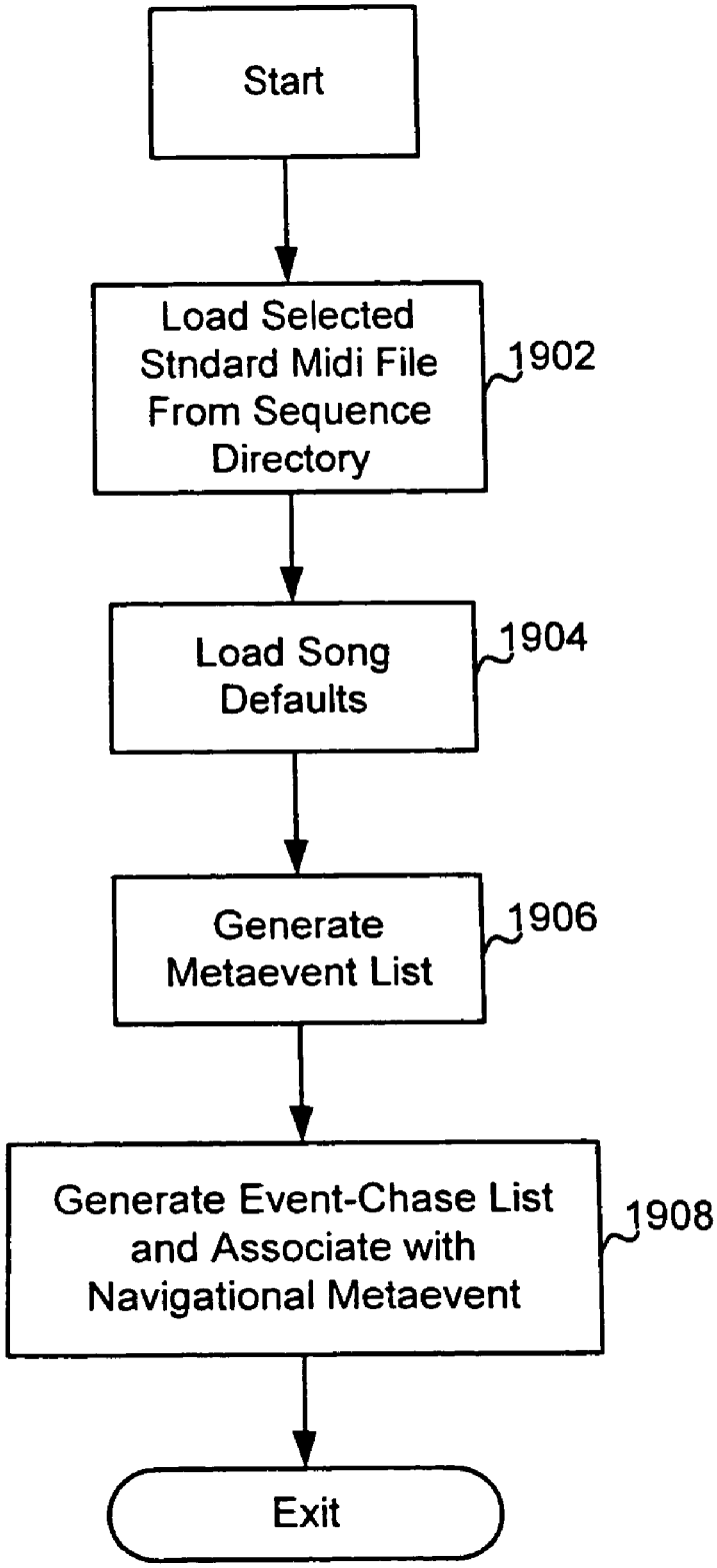
FIG. 19 is a flow diagram of a preferred embodiment of a load song process in accordance with the present invention.

The load song step 1820 is shown in greater detail in FIG. 19. Preferably, every song has an associated sequence file. Those sequence files are loaded in step 1902. These sequence files are generally files that can be characterized as the first data structure or pristine music files. As discussed above, this first data structure, once created, is preferably not directly modified.

After the sequence file for the song has been loaded, the song defaults are loaded. This is where definitions that apply only to a particular song are loaded. The song defaults are those elements that are associated specifically with that particular song. These song defaults can include elements such as song global volume, song transpose and instrument default definitions. These instrument default definitions can include, for example, whether an instrument is muted or not for a song, whether an instrument has a different volume level for a song, whether the articulations for a given instrument have been changed in that song, or any other type of parameter for a particular instrument for a particular song.

If the show is pristine or unmodified, there will be no changes. However, if the song has been modified, for example in an editor step, then the song may include actions and associated meta events. A meta event list is created in step 1906. In this step, all of the meta events are collected and a meta event list is built from the set of actions associated with the song.

Once the meta event list is generated in step 1906, any information associated with those meta events or actions are then associated with markers that are associated with the first data structure. Then an event chase list is generated in step 1908.

Returning to FIG. 2, the function of music system 106 will now be disclosed. An action is a type of meta event. Actions are events which can be used to modify the performance of music system 106 and the musical output 112 produced by music system 106. Preferably, these actions can be used with a first data structure, also referred to as a pristine digital bit stream, in a way that the first data structure or pristine digital bit stream is not itself modified, but that the additional information, also referred to as a second data structure, provided by the actions is capable of modifying the output 112 produced by music system 106 when the action information is used by music system 106.

Examples of actions include pre-selected actions and real-time actions. Pre-selected actions can be embedded within the first data structure or pristine digital bit stream, added from definition files, added through manual editing, recorded from external control or recorded from the output stream. In addition to action information or second data structures embedded within the first data structure, action information or second data structures can reside within map files, within song structures, and within the show structure. They may also be generated in real-time and in real time during a performance.

Actions can be called from a variety of different sources. Examples of real-time action sources include the internal scheduler 106, external human operator 110, generated from a set of internal decisions within the device 130, or from a different computer or processor 110 or from activation of a different action or process 130. External control actions may arrive from MIDI input, voice recognition equipment, gestural control equipment, serial port, parallel port, USB, ethernet, TCP/IP, modem, RS422, RS232, or any other manner of inputting data into such a system. The current embodiment uses a variety of different communication protocols.

An Action is an instruction that explains to the processor how to interpret, manipulate and/or modify the pristine digital bit stream 102. As stated above, these actions can reside in a number of different places. They may live within the MIDI stream 102, live within the show or song files 108, or they may be split out into separate types of actions into map files 122. They may also arrive from external control 110, or be reintroduced from the feedback stream 130.

There are a variety of different action classes. Examples of these action classes include navigation, tempo, volume, grouping, metric, tap, velocity, articulation, pattern, instrument property, duration, transposition, and mute, to name a few. Each of these effects a different parameter of output stream 116.

An action can exist within the show structure in several different locations. Examples of these are within a range of the timeline of a song, at a point in the timeline, associated with another meta event or action, dormant until activated by an explicit command, dormant until satisfying a set of conditions. An action may also be generated "on the fly" by a variety of different external or internal processes.

Each action preferably contains a list of parameters which are used in evaluating how the action will effect the output stream 112. Action meta-events can contain parameters that are similar or common with other actions. Some of these actions can also include additional arguments.

There are many ways of defining the syntax. Following is the preferred embodiment syntax. There will be a formal syntax for use in data storage, and a set of shorthand for label input into the SMF file by the music programmers.

A preferred embodiment for action meta event syntax can include the following:, an id, a type of meta event, a startlocation, an end location, a bypass parameter, a wait parameter, a times parameter, a label, and any number of additional arguments, depending on the complexity and type of action meta event.

The following are preferred definitions for the parameters.

id <integer> is a unique value used by the system to reference a particular action.

type <string> declares the type of meta event. All location and action meta events begin with this label. Each type is a unique string.

startlocation <m:b:t> <|> <target> The startlocation action declares where in the song an action is to begin.

The "m:b:t" argument refers to Measure, Beat, and Tick. If this argument is used, the action is started at the specified measure, beat and tick. A theoretical location of 0:0:0 can be used to store actions which are location independent. Thus they can exist in the action structure but never be encountered by the scheduler unless activated by some other process.

The "|" argument informs the system that an action should take place at the location of the embedded event, or where this action is logically located in the bit stream.

The "target" argument can be used to define a location by meta event location.

endlocation <m:b:t> <|> <target> declares where in the song the action effects will end or terminate.

m:b:t Measure Beat Tick

| default: there is no ending action: will continue until explicitly ended target Any meta event location.

bypass <Boolean>

This action is used by other actions or processes to activate the event. For example, hot keys and last time through)

If the Boolean argument equals 0, then action is activated. If the Boolean argument equals 1, then action is quiescent (asleep), and will be ignored if encountered.

Actions in bypass mode may be triggered using several different types of result.

1. bypass off. Action will be triggered next time sequence is in location.
2. bypass on. Action will be ignored next time sequence is within region.
3. trigger now. Action is triggered regardless of location.

wait <integer>

If bypass is off, the number of times an action is encountered before it is executed. If wait>0. then the action is not executed, and wait is decremented. If wait=0, then the action is executed.

times<integer>. The number of times an action is encountered after activation until bypass is set to on. If times=0, then the action is always on. If times>1, then the action is executed, and times is decremented. If times=1, then the action is executed and then bypass is set to on, thus deactivating the event.

label <string> This action is used only for identification or organizational purposes.

It can be any preferred length.

arg_v, arg_c. etc. These are additional arguments which may be required depending upon the specifics of the action meta event. For example, if an event refers to an instrument or group, then this is where that would be placed. Certain action meta events will also need to reference other meta events. This can be done with the unique id value, and this would then be located in one of these fields.

Arguments can dependent upon specific requirements of each type of action. This provides the possibility of adding powerful operations which may be usable on a large number of different action types. For example, the argument pattern could, for example, provide a way of modifying the output in a different way each time it is encountered.

As stated above there are a variety of different action classes. The following are examples of some available action classes.

Navigation. These determine how a particular performance will move through a song, either repeating sections, jumping over measures, or the like.

Tempo. These modify the speed at which the MIDI events are performed. A song could be played fast or slow, for example.

Dynamics These actions effect the loudness of the song, show, or various instruments and groups.

Velocity. Every MIDI note event has an associated velocity, which corresponds to how hard a piano key has been hit for example. A change of velocity can result in a louder sound, a brighter sound, a different sound file, some combination of the above, or other changes, depending on how the instrument is defined in the output sound module stage. A velocity action will modify this parameter.

Articulation. Articulation is how a musician performs a particular note. It might be smooth or separated. It might have an accent or a subtle entrance. An articulation event can modify this parameter of performance.

Durational. This is tied in some ways to articulation, and certain embodiments may combine these types of actions. A durational event will modify how long or short a note event is.

Grouping. This type of action allows instruments or groups to join or leave predefined groups. It also allows the creation of new groups, or the dissolution of existing groups.

Transposition. It is often desirable to modify the key (pitch level) of the song. A transposition event can raise of lower the pitch of a song, section or the entire show.

Tap. When the device is receiving tap information, it is useful to be able to change the tap subdivision. Does each tap represent a quarter-note, a half-note, or a whole-note? This can be changed with a Tap type action. In addition, certain types of music work better with more complex tap subdivisions. These would require a tap pattern. For example, if a song is performed with swing, then the pattern of triplet-quarter, triplet-eighth alternating would be preferred.

Pattern is another feature that can be used to simply entry and operation. Pattern permits a user to program a sequence of values for a particular action or meta event. The system 100 remembers the sequence of values and every time the meta event is encountered, system 100 uses the next value. For example, a mute instrument meta event is set so that a different value is provided for the mute meta event each time it is encountered. A pattern of 0's and 1's, where a zero means mute and a 1 means unmute, could be described in this field. Thus, the pattern 011 would mean that the system mutes the first time the mute meta event is encountered, the system unmutes the second time the mute meta event is encountered, and the system unmutes the third time the mute meta event is encountered. The pattern, mute unmute unmute would repeat for the fourth through sixth time the mute meta event is encountered. This pattern preferably continues.

Instrument Property. Each instrument has a list of properties which influence how the output stream is interpreted. These properties include inertia, sensitivity, etc. Actions of type Instrument Property can modify these definitions.

Mute. Because music system 106 is designed to play with ensembles of various sizes, and since the preferred embodiment of the system is to input the entire show, it is desirable to be able to mute (turn off) and unmute (turn on) different instruments and/or groups globally or within the show. These types of actions allow for such activity.

Utility. These types of actions perform small tasks or do not fit within the parameters of the other action types.

It is possible to define additional action classes as needed.

The Appendix provides details of some of the available actions and preferred syntax for those actions. The actions or meta events can be combined, used in sequence, used directly or used in indirect programming.

Now that the various commands and actions have been disclosed, the function of those commands and actions in the context of hardware and the production of various output signals will be discussed. Returning to FIG. 2, which is a schematic diagram of a preferred embodiment of the performance system, recall that music system 106 receives a first file 102. Recall also that first file 102 can include predefined locations or targets 120-130 that provide places where music system 106 can quickly return or move to during playback.

The information associated with first file 102 can be modified by the second data structure. Targets 120-130 are examples of items that can be considered second data structures. In addition to these, other information associated with a file, which can include multiple files, 108 can also be considered second data structures. File 108 is sometimes referred to as a show file, and sometimes has a .SHO extension to its filename.

A show file 108 contains information that allows the manipulation first file or data structure 102. File 108 can include a variety of different types of information. Some of the types of information include information related to: (1) the properties of instruments, (2) order of show, (3) global parameters, (4) actions ,(5) song parameters, (6) group memberships. A single file may contain all of this data, or the data may be split into separate files, each file containing a specific type of information. If the data is split into different files, then these files can be referred to as maps, and can then be referred to by the original file 108.

Music system includes an output stage 112. There are a number of different outputs that can be provided. A first output 126 can include digital information. In an exemplary embodiment, first output 126 provides a MIDI bit stream that conforms to the MIDI 1.0 specification protocol. This output can be used to control any MIDI compliant device. Any number of different digital outputs can be provided to suit particular needs. In one embodiment, four MIDI outputs are provided. However, this number can be easily increased or decreased if desired. Each output can include a port.

Examples of devices that could communicate with first output 126 or another digital output include a MIDI sample playback module, another computer, a MIDI controlled lighting board, a show control device, for example. A second output 128 can include video information. The second video output 128 can be used to provide information to a display used by a performer and to provide feedback to the performer or other personnel requiring this information. Second output 128 may also support graphics files 132, such as music notation and/or instrument layouts, for example.

A third type of output 140 allows the recording and storage of performance information. For example, information from an input 110, such as tempo, dynamic information, and/or articulation information, as well as any other information received from input 110 can be captured through third output 140. The information captured through third output 140 can be used to generate a map for subsequent performances, and later, this data can be analyzed and moved into a map file.

The embodiment shown in FIG. 2 includes provisions to receive information from external sources. This information can be used to control playback and modification of one or more of the outputs 126, 128 and/or 140. Input 110 can receive a variety of inputs including a MIDI input, a serial communications channel, an ethernet input, a parallel input, a USB input, a firewire input, a SCSI input, or any other desired protocol. Examples of the source of the control can be a human, another computer, a variety of sensors, radar batons, voice, analysis and/or gestural control. These sources can communicate with input 110 by using one or more of the protocols disclosed above. Information from this input can be used to change the state of music system 106 and therefore modify or control one or more of the outputs.

Music system 106 includes an event scheduler. The scheduler looks at the different types of input information and decides when to add information to any of the output streams 112, 124, 126, 128 and/or 140.

Once the show has been loaded with all the songs, maps, and underlying sequences, the show can be run. Preferably, music system 106 receives or retrieves first file 102 and show file 108 and memorizes both by placing information received from those sources into memory. As discussed in the load show process, the information has been loaded, the action lists have been built, instrument definitions have been declared, and group relationships have been defined. Preferably, all of this information is loaded into RAM.

At this point, music system 106 is ready and the system waits until it receives a start command. There are a variety of different types of start commands, whichever command is used, for example, hitting a "play" command, will begin operation and a clock will start.

Preferably, every single beat within first file 102 is divided into a certain number of ticks. A tick is a subdivision of a beat. Any tick value can be used, but 480 ticks per quarter note is preferred. A tick can also be a subdivision of a bit and any MIDI or meta event has to occur on a tick. All time-based events are associated with a particular location on a timeline, and this timeline is referenced by the musical indicators of Measure-Beat-Tick. While there are other ways of defining locations on the timeline, use the measure-beat-tick definition is preferred.

When the start action is received, the scheduler starts to look at the time. The time is converted from system clock cycles into the measure-beat-tick structure. The number of clock cycles per tick is determined by the tempo map. The tempo map will define a time frame based on beats per minute. Absolute time of the system clock can be converted into measure-beat-tick information. Assume, for example, that the system clock is running at 100 MHz, and that the song the tempo is 60 beats per minute. This translates into one beat per second. Since the tick subdivision of the beat has been defined in this embodiment of the invention as 480 ticks per beat, we see that the tick value will increment every $\frac{1}{480}$th of a second, or every 0.00208333 seconds. If the tempo map declares a different tempo value, then the tick increment would have a different time length. Preferably, the precision and accuracy of the underlying division is as great as possible.

The clock starts counting and music system 106 is waiting for a whole number subdivision to see if the clock cycle is actually showing up at this $\frac{1}{480}$ of a beat at a tick. If the clock cycle is at a tick, then it will see if any events have been scheduled for that time. These events may include information from first file 102, any actions in the map groups, any events embedded within first file 102, any processes which may be modifying definitions, or any actions associated with the song or show files.

Eventually there will be an event. One type of event is a note event, in some embodiments, MIDI is used, so a MIDI note event. If a MIDI note event is encountered, then the program will evaluate that MIDI event and run it through a variety of processes. These processes include global parameters, instrument properties, song parameters and action parameters. There are a set of algorithms and values that affect the event.

The global and local parameters are time independent. They are not updated unless there is an action to change that parameter. Music system 106 evaluates to see if there is information in one of the global or local parameters that affects the note. Before music system 106 decides what to do, it must determine if there is an action at affects a global or local parameter. If there is an action, then the global or local parameter is updated.

Some of the global parameters or some of the actions will cause certain types of activity where there will be processing between ticks. For example, an instrument may be getting louder and louder or there may be a change a global volume offset. That processing preferably happens before the event is updated.

For example, there may be an instrument with instrument information coming through but that particular instrument has been muted. In that case, music system 106 realizes the mute condition and does not even send it to an output port. Another type of change is a controller 7 value that is being sent through (the controller 7 is volume in MIDI). Music system 106 looks at any possible volume modification information. In this example, there is a global volume modifier which indicates that everything should be a little bit louder. So music system 106 uses controller 7 and multiplies it by the volume offset amount and then outputs a modified controller 7 value.

A list of the possible internal actions or the externals includes the following. These are all the different types of action META events which can occur within the action list. The actions include "stop" which means to stop the sequence clock and turn off any notes currently playing. "Pause" stops the sequence clock but does not flush the note-off buffer so any note on is any notes that are still playing will continue to play. "Relocate" moves to a different location within the score. There are different types of relocate. "Vamp," "repeat," "cut," "first ending," "second ending" are some examples. There are two other types of events that allow movement to different songs. "Relocate song" and "ATTACCA." "Relocate song" moves to a different song and then stops. "ATTACCA" will move to a different song and keep playing.

Other actions we have are "reset actions" and reset actions will restore iterative and activation flags which are discussed later, and also restore other action information.

"Mute instruments" permits muting an instrument or "un-muting of an instrument. A tempo resets the tempo map to the default condition. The volume can be changed as well as the sub-division, that is, the number of taps per beat or taps per measure that the sequence responds to. "Click-on" and "click-off" both turn the click track on and off and "cut off" flushes the note-off buffer without stopping the sequence.

Tempo following (flexibility of song tempo during playback) is an important capability of any live performance system. The subtle ebb and flow of tempo between onstage performers and accompanying orchestra, as well as within the orchestra is a component of artistic expression. At other times, it is important to be able to "lock down" the tempo, for example if the music needs to be performed in synchronization with fixed-playback devices, such as with prerecorded audio or video. Often, both types of tempo following are required within the same show or song.

Music system 106 permits easy use of multiple techniques for both fixed and flexible tempo playback, and the capability to switch between them on demand and in real time. Because there are different degrees of flexibility, different types of tempo following have been implemented. For example, a march or dance will often be fairly strict, tempo-wise, while a ballad or aria may be constantly changing tempo and have many pause points (fermata).

Preferably, there are two basic tempo following techniques: tap and cruise. Both have different characteristics, and the selection during performance can be defined either within a performance map or in real time using external control.

Both Tap and Cruise rely on receiving beat information from an external source. A beat is the underlying pulse of the music. Once received by music system 106, beat information informs the program that, at the instant of receiving the message, the scheduler should be at a specific M:B:T (measure beat tick). Because of the extremely accurate timing provided by the scheduler, the beat might be slightly behind or in front of the current location. The timing would have to be adjusted to allow the system to be at the correct location. This adjustment occurs in different ways depending on the type and flavor of the beat event.

The duration of the beat is also changeable, and is called the tap subdivision. These durations are expressed in units of metric time. So, a tap subdivision may be a quarter note, an eighth note, a whole note, or any other definable duration. Different sections of the same song may require quite different subdivisions. The shorter the subdivision, the more accurate you can be in terms of following the conductor, but the more times you need to tap per measure. This standoff needs to be taken into account when deciding what tap subdivisions to select. These changes in tap subdivisions may be stored in a metric map, or they may be changed in real time using external control.

In order to maintain the first data structure in an unchanged state, the changes to tempo are preferably accomplished by using a tempo multiplier value as opposed to changing any underlying data of the first data structure. This multiplier value is a combination of any tempo maps, as well as external control changes. This is multiplied by the underlying tempo to arrive at an actual tempo.

Tap is used when very accurate tempo following is required, such as when a singer needs to hold a note, or when wide, unpredictable tempo changes are a feature of the current performance style. However, exiting tap mode requires an explicit external action or mapped meta event. If the user stops tapping, the song will pause forever. The player needs to be constantly updating tap by providing beat information for every beat.

Figure 20:
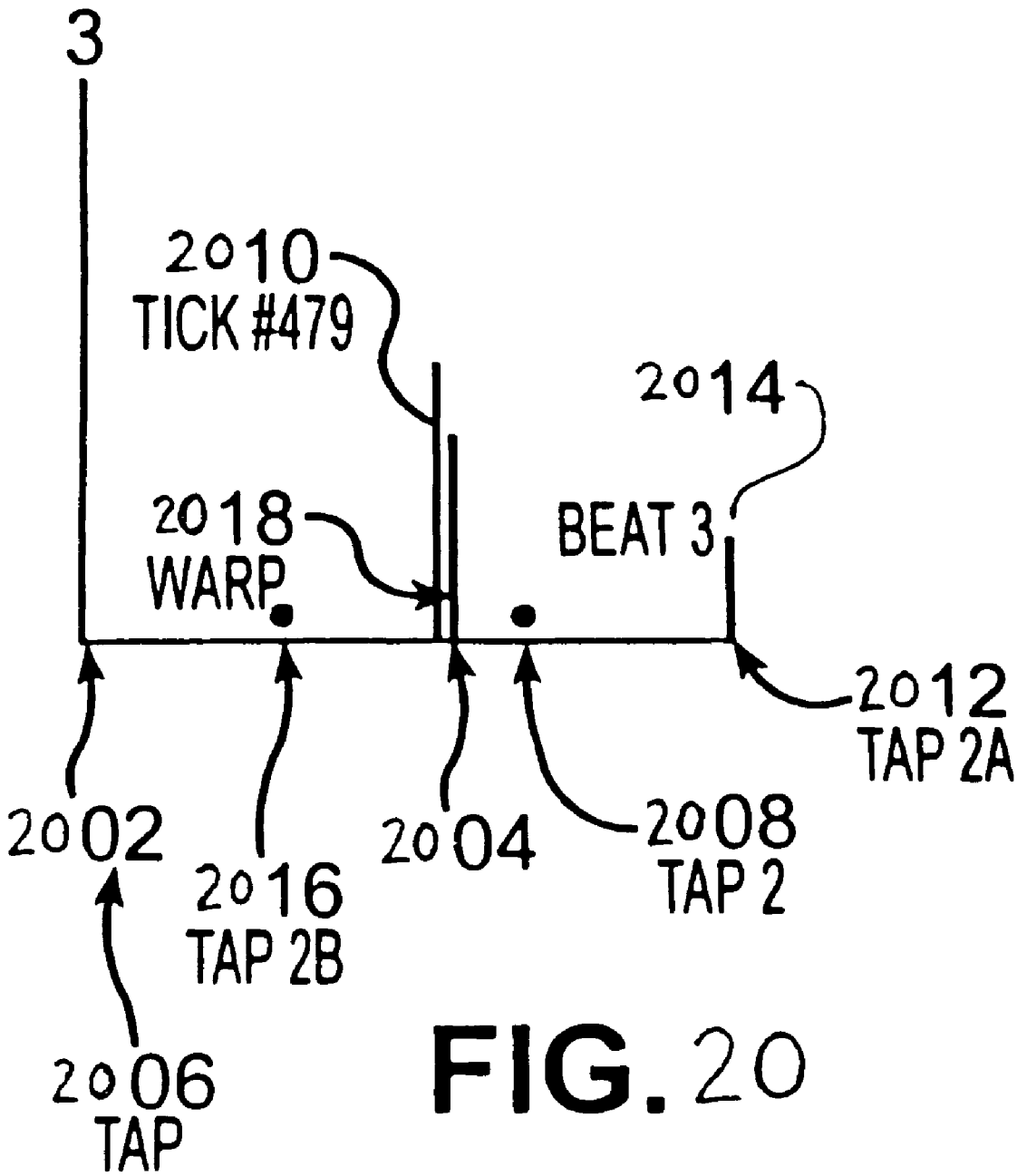
FIG. 20 is a schematic timeline diagram of a preferred embodiment of a tap example in accordance with the present invention.

Tap mode is designed for very precise control of tempo and location. Referring to the example in FIG. 20, which starts at measure 3 beat 1 2002. An initial tap 2006 is received and the system goes into tap mode, and a timer starts counting so that a duration can be calculated at the next tap point. The song will play at the underlying tempo value, since there is not yet enough information to determine what the desired tempo should be. Eventually, music system 106 calculates a difference in time between the two most recent taps, and from this, calculates a new tempo.

Once in tap mode, three possible tap options can occur: the next tap arrives after the next beat, the tap arrives before the next beat, or the tap falls exactly on the next beat.

(1) Tap arrives after the next beat. In this instance, the desire of the performer is to play slower than the current tempo. Therefore, the second beat 2004 would arrive before the second tap has been received. In this case, the system pauses at the tick before the next beat 2010, and waits for the arrival of another tap event. The timer continues to count, even though metrical playback has paused. Any currently active note will continue to play. The system will wait at location 2010 indefinitely, unless a tap or other event is received. Eventually, at some later time, a second tap 2008 is received. The timer now has a duration value which can be used to determine the correct tempo for the next beat. The appropriate calculation is made, the tempo multiplier is offset, and the song continues at the newly adjusted tempo.

Assume a starting tempo of 60 bpm (beats per minute). This means that each beat will play over the period of a second. Assume that tap 2 2008 arrives at 1.2 seconds. The timer would then have a value of 1.2 secs. The desired new tempo should be at 50 bpm (60/1.2=50). The tempo multiplier needs to be adjusted so that the new tempo will be at this value. Thus, the tempo multiplier=1/1.2=0.8333. The current tempo (60) is multiplied by the tempo multiplier thus (60*0.833333=49.99999=50), and the song continues on at the adjusted tempo, until either another beat is arrived at, or another tap is received. The process repeats itself at this point.

Note that the current tempo may itself already be effected by a tempo multiplier produced by a previous tap or other meta event. In this case, the calculation needs to include that modification as well. The algorithm is as follows:

new tempo multiplier=(underlying tempo*old tempo multiplier squared)/(60*timer value)

Where underlying tempo is expressed in beats per minute, and timer value is expressed in seconds.

(2) Tap arrives before the next beat. In this case, a different process occurs. We have not yet reached the next beat, and a tap has arrived. This will occur whenever the user desires to start playing faster. In this case, Tap 2B 2016 arrives before the second beat 2004. Because we need to be at a later moment in the song, the scheduler performs a warp operation 2018. In warp, all events between tap 2B 2016 and the second beat 2004 are output as quickly as possible. This allows the song to "catch up" very rapidly. Usually this is imperceptible (it takes very little time for a computer to perform this process). At the moment of the arrival of tap 2B, the timer records the duration between taps, and a new tempo is calculated.

Assume in this example that the tap 2B 2016 arrives at 0.8 seconds after tap 1 2006. This means we desire a new tempo 75 bpm (60/0.8=75). The tempo multiplier needs to be set at a value so that this can be achieved. Such a value is 1.25 (1/0.8=1.25 and 1.25*60=75). tempo is multiplied by the tempo multiplier and the song continues at the new tempo until either another tap or beat is received, or tap mode is exited.

3) Tap arrives exactly with the beat.

This is very rare, since the timer is working with millisecond accuracy, and therefore the next tap will almost always arrive before or after the next beat. However, when it does occur, the current tempo matches the desired tempo, and therefore no calculation needs to be made. Or, the calculation can be made with the timer at the same value. Then 1/1=1 and therefore the tempo multiplier equals 1.

In either case, the sequencer has received the next tap command, and therefore continues on through the second beat (from 2004 to 2014). Because a new tempo map multiplier as been calculated, the sequencer is now traveling at a different tempo. It has also reset the clock and is calculating a new Delta time. This process will repeat, traveling from beat to beat, either pausing at the tick before the next beat (if the tap command arrives later) or warping to the next beat (if the tap command arrives earlier). The sequencer performs the same operation, each time with a modified tempo map multiplier, and therefore a different tempo. Using this technique we are able to follow the conductor exactly, because every time the conductor's baton comes down, we are hitting a tap and we are at the next beat location.

This provides a segmented tempo, and this can cause some problems for certain types of musical situations. Now, if there is a very rubato section, which means a heavily changing slow sort of performance, then this is not much of a problem. Or, if the tap subdivision is equal or shorter than the shortest note event values, then this does not matter either. But if the performer is required to tap ahead in a very fast, very martial, very precise piece, and the tap subdivision is greater than the shortest note event values, then the sudden tempo changes become perceptible as jitter. The fact is that humans can not tap as precisely as machines, yet the human performer must still follow the conductor.

Figure 21A:
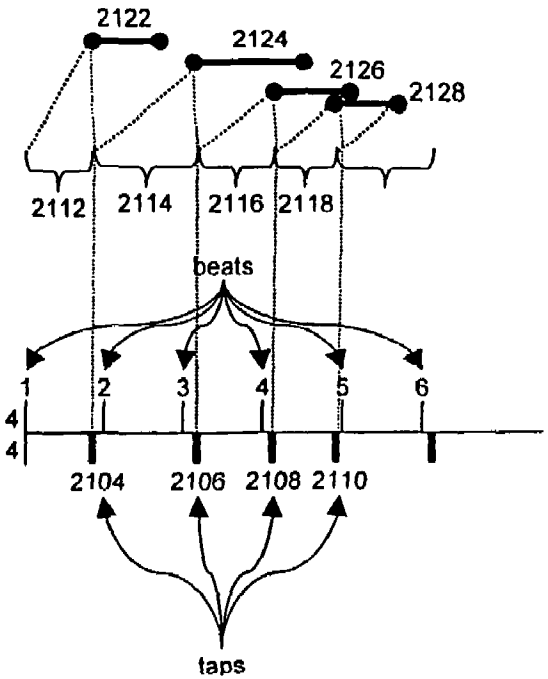
FIG. 21A is a schematic timeline diagram of a preferred embodiment of a tap example in accordance with the present invention.

For example, referring to FIG. 21, assume the tap subdivision is quarter notes and the underlying rhythm is in sixteenth notes. There will be four sixteenth-notes per quarter note tap. FIG. 21 shows a number of beats 2102. Note the human performer will be tapping a little behind or a little ahead of each beat 2104, 2106, 2108, 2110, although the average of the taps is correct. Since the tempo updates instantly on each beat, and there are four sixteenth note events per tap, each group of four events will have an identical tempo. This sounds jittery, and is because of the sudden changes in tempo from beat to beat. Therefore problems arise because minor deviations in tap can be heard.

Also, tap completely divorces the system from any information stored within an underlying tempo map. Thus, the performer needs to be constantly alert and performing very accurately during any time in which tap is used.

The cruise feature processes beat information in a different way. Cruise is designed to allow for subtle changes in tempo. Many types of music have a strong pulse that changes very little. In these cases, it is not necessary to tap each beat, because deviations from established tempo. This means that if a beat is inadvertently left out, the system will continue playing without that piece of information. Thus, every beat does not have to be tapped. The underlying tempo map can then help influence the overall tempo shape of the piece. The use of cruise type algorithms allows for certain levels of machine learning to help make performance easier.

Figure 22:
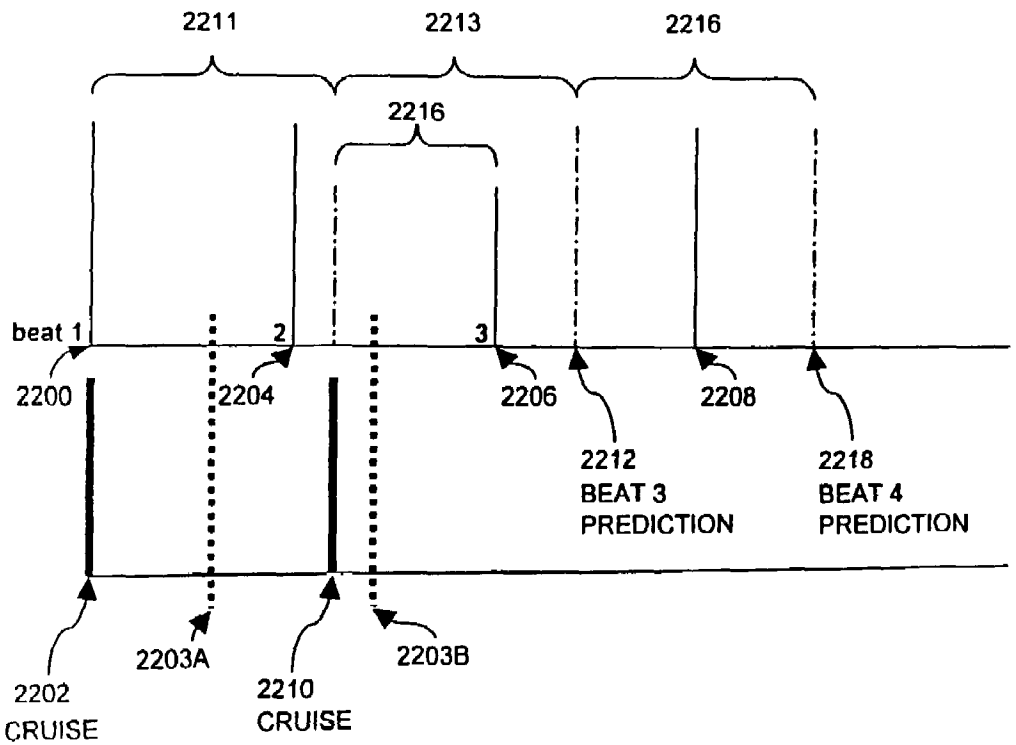
FIG. 22 is a schematic timeline diagram of a preferred embodiment of a cruise example in accordance with the present invention.

Using FIG. 22, which includes the same measures as in the tap example shown in FIG. 21, an example of navigating using cruise is shown. In this case, at the first beat 2200 a cruise event 2202 is input. Music system 106 starts playing at the underlying tempo and the timer starts counting. At the current tempo, the next beat will occur at 2204. 2203A and 2203B represent a definable window within which a cruise event must be captured in order to be valid. Second beat 2204 is encountered and passed, still playing at the underlying tempo. Cruise event 2210 arrives very soon after the second beat 2204, and now the system must do some calculations.

First, the timer stops and provides a delta time 2211 from first cruise input 2202 to the location of the next cruise event 2210. Note that this time is greater than the time of the movement from beat 1 to beat 2. Therefore the tempo is going to be slower. The system makes the assumption that the location of the cruise event 2210 is the desired location of the second beat, and from this makes a prediction about the desired location of the third beat 2212. This is done by extrapolating forward 2213 by the delta time 2211, and from this a predicted third beat 2212 can be plotted.

The current location of the sequence has already moved into the next beat, and therefore slightly less than a beat 2216 needs to be stretched so that the arrival of beat 3 information will coincide with the predicted third beat 2212. Note that since less than a beat must fill the time of an entire beat, the tempo for this region 2216 must be even slower than the established tempo would be, and therefore a tempo multiplier must be calculated which compensates for this difference. Once this new multiplier has been calculated, and if no additional cruise events occur, then a new tempo multiplier is calculated for arrival at the fourth beat 2218. Because cruise does not rely on an externally delivered tap for each beat, the cruise external events can be more sporadic. Music system 106 also refers to the underlying tempo map.

Another tap feature is called ramping tap. Instead of immediately modifying the tempo map multiplier, the tempo map multiplier is gradually moved to the new value over the length of the next tap subdivision. Consider the jitter of the resultant tempo map offset that would occur with human tapping.

Figure 21B:
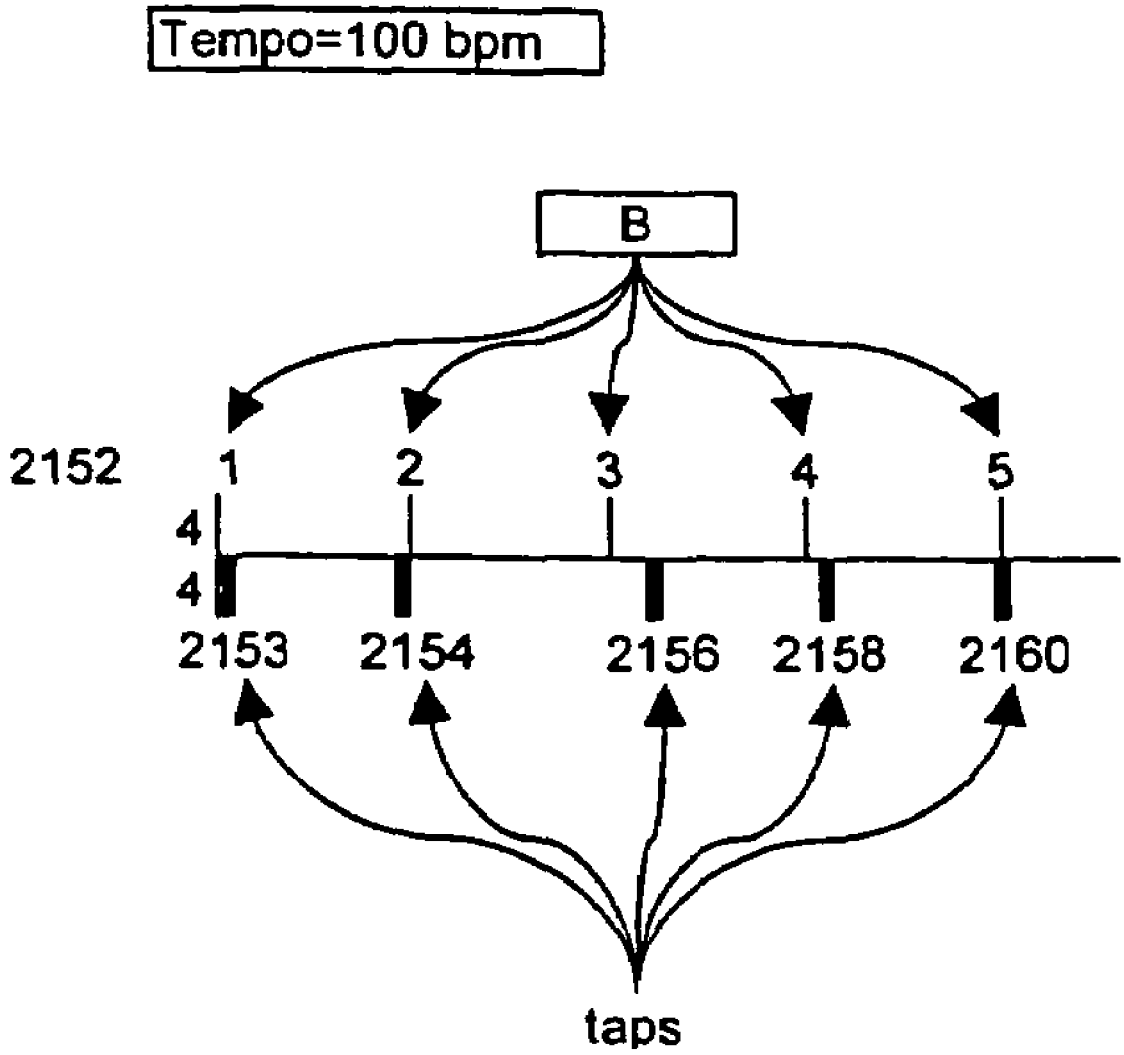
FIG. 21B is a schematic timeline diagram of a preferred embodiment of a tap example in accordance with the present invention.

A tempo map with this jitter pattern is shown at FIG. 21B. Assuming 100 beats per minute, and because no human can tap exactly correctly, sometimes the tap comes before or after the beat location, even though the average of the tap is at the correct tempo. The desired beat locations B, also referred to as the pristine tempo 2512, is shown in FIG. 21B.

Various tap occurrences are shown in FIG. 21B, including first tap 2153, second tap 2154, third tap 2156, fourth tap 2158 and fifth tap 2160. In the example shown in FIG. 21B, first tap 2153 occurs a little late, second tap 2154 is a little early, and third tap 2156 is quite a bit late. Note that the final tap, 2160, arrives at the same time as that indicated by the original tempo 2152, and therefore that there is no difference in overall tempo. However, the length of time between each tap is different (between taps 2153 and 2154, 2154 to 2156, 2156 to 2158, and 2158 to 2160). In this case, even though each beat has a different tempo, the overall tempo will still be 100 bpm 2152.

The average tap is approximately at the tempo of 100 beats per minute. Note that there are four sixteenth notes per quarter note, and a traditional tap algorithm would therefore group the sixteenth notes into groups of four per tap. Each group would exist at the same tempo within itself but at a different tempo to each of the other groups. Since the updated tempo map multiplier would be used on the succeeding beat, we can see that the actual required tempo lags by one tap subdivision. There is no way around this without resorting to beat prediction, which requires more information than that supplied by single tap subdivision events. This is as close as a system can come to exact tracking. Each group is therefore a little slower or a little faster depending on the relative tap positions of the previous beat. The human ear is very good at detecting patterns or errors in the time domain, and therefore the groups become isolated from each other, and the resulting performance suffers. Instead, if each tap subdivision modifies the tempo map multiplier over the range of the next beat, by slowly changing the value until it reaches the new value, then these groupings become more subtle, and a smoother performance results.

Therefore, in ramping tap, the tempo map modifier is dynamically modified through the entire beat, so that by the time the next beat arrives, the system is at the new tempo. This provides much smoother transitions. Every single sixteenth note is slowly going to get a little bit faster or a little bit slower. This provides smoother, more human sounding tempo transitions and this helps to eliminate the jitter associated with these types of taps.

The algorithm for this is as follows: First, the new tempo map multiplier for the next beat is calculated. Next, the number required subdivisions is determined (This would be in a definition file, but for purposes of this example, assume a resolution of four). Divide the multiplier difference (from the previous multiplier value) by the resolution. Every resolution, add the resultant to the multiplier value.

The following is a numerical example. Assume a tempo of 100. The tap provides an updated tempo of 110. The tempo map multiplier is therefore 1.1 The difference is 0.1 Dividing by the resolution (4) results in a value of 0.025. Resolution of 4 with a tick value of 480 per quarter note means a tempo map multiplier update every 120 ticks. At tick 0, the tempo map multiplier becomes 1.025. At tick 120 the multiplier is 1.05, at tick 240 the multiplier is 1.075, and at tick 360 the multiplier is 1.1. This algorithm will work for any resolution and any multiplier change.

The difference between cruise and tap is that if another cruise event is not sent, then the system continues playing, as opposed to tap where tap waits for every beat to be input. A difference between the two is that cruise has a tendency to lag a bit behind tap, and is therefore not as precise. So that means if a certain musical passage requires very precise tapping or tempo, for example, because of a big fermata (pause), than it is best to use tap as discussed in FIG. 21. If it is desired to gently influence the performance, when the tempo is smoothly coordinated with the information from the musical director, or if the performer wants to take advantage of the underlying tempo map information, then cruise would be preferred. Everything is happening in a much smoother way with cruise. Even with this improved smoothness, the system still identifies particular locations, and the system in cruise has time to smooth the next beat.

With tap, the final component of the tap subdivision is either truncated or elongated, depending upon where the tap arrived in relation to the beat. This means that the change in tempo occurs within the final part of each tap subdivision. In cruise, there is no truncation, only a change in the tempo value. This creates a smoother set of transitions, since the relationships within the tap subdivision maintains a linear relationship.

The present invention also permits performers to switch between tap, cruise and play seamlessly and at any point.

Figure 23:
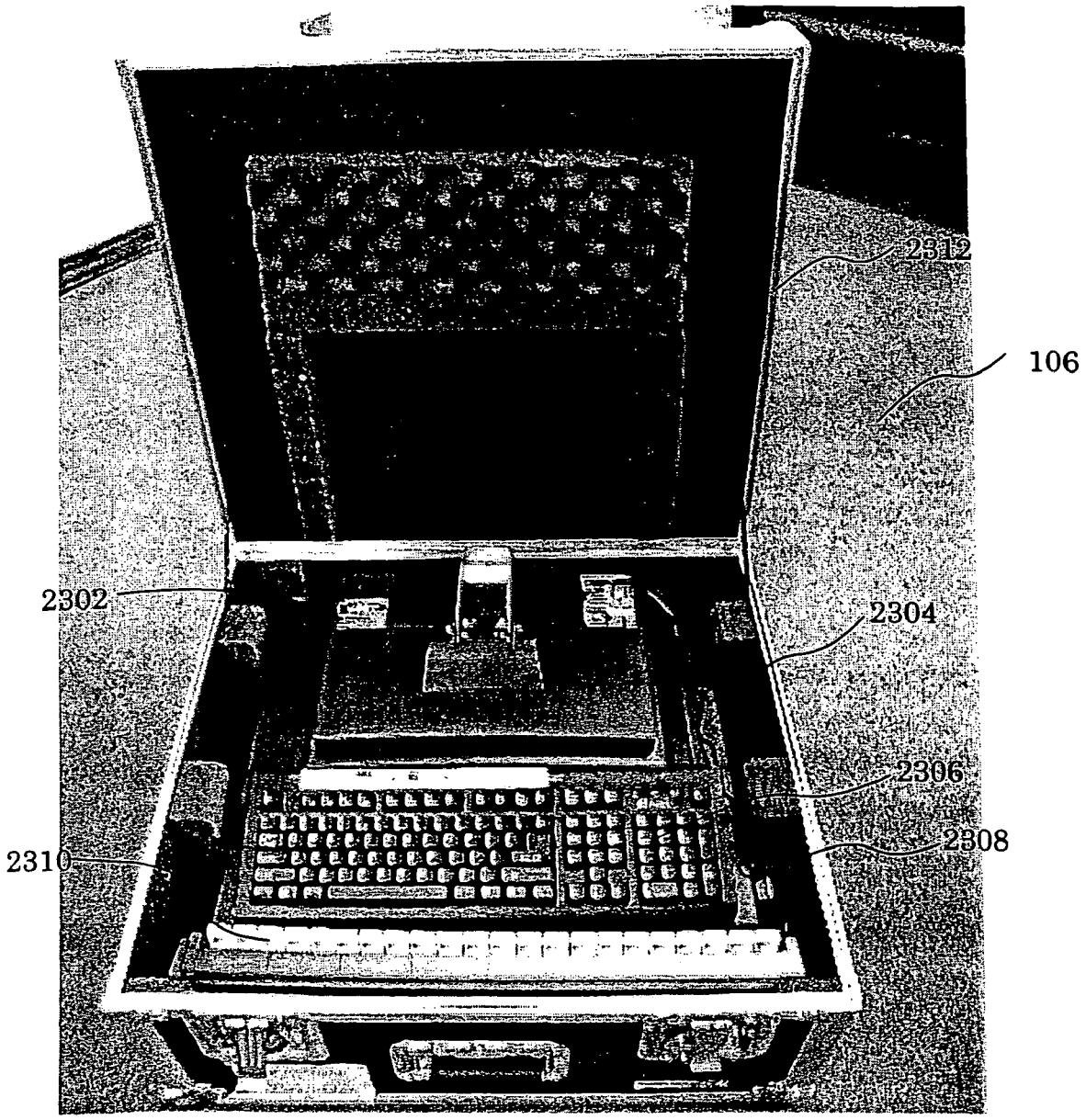
FIG. 23 is an isometric top view of a preferred embodiment of a music system in a storage position in accordance with the present invention.
Figure 24:
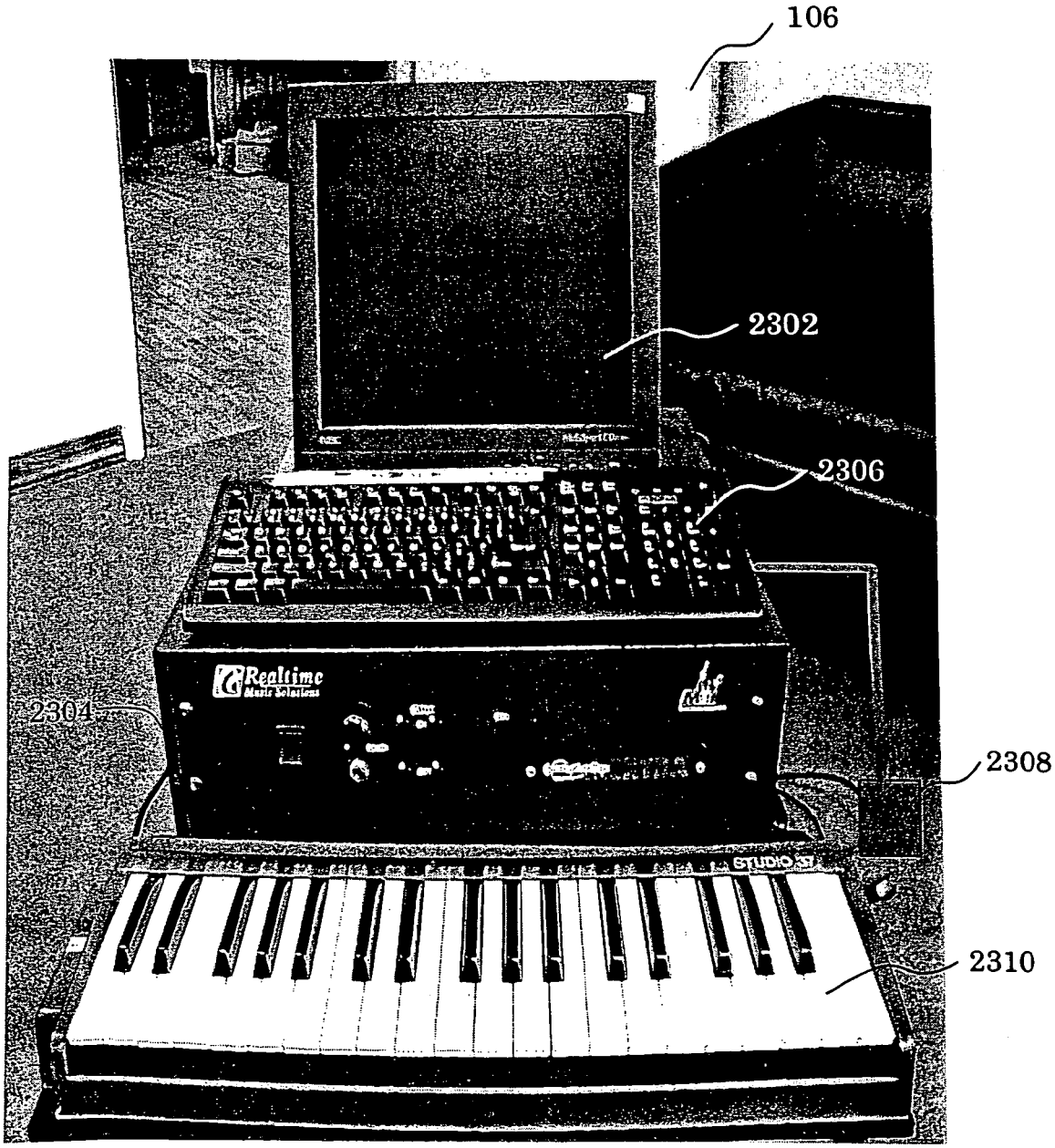
FIG. 24 is an isometric front view of a preferred embodiment of a music system in a deployed position in accordance with the present invention.

Operation of music system 106 will now be disclosed from the perspective of the user interacting with and operating music system 106. FIG. 23 illustrates a system according to a representative embodiment of the present invention. As shown in FIG. 23, music system 106 includes a display 2302, a processor 2304, a first keyboard 2306, a mouse 2308, and a second keyboard 2310. Display 2302, first keyboard 2306, mouse 2308, and second keyboard 2310 are in connection with processor 2304. Music system 106 may be stored in a housing 2312. Music system 106 is set up by placing the music system on a secure surface, lowering second keyboard 2310, and deploying display 2302. FIG. 24 shows music system 106 after set up has been completed.

Figure 25:
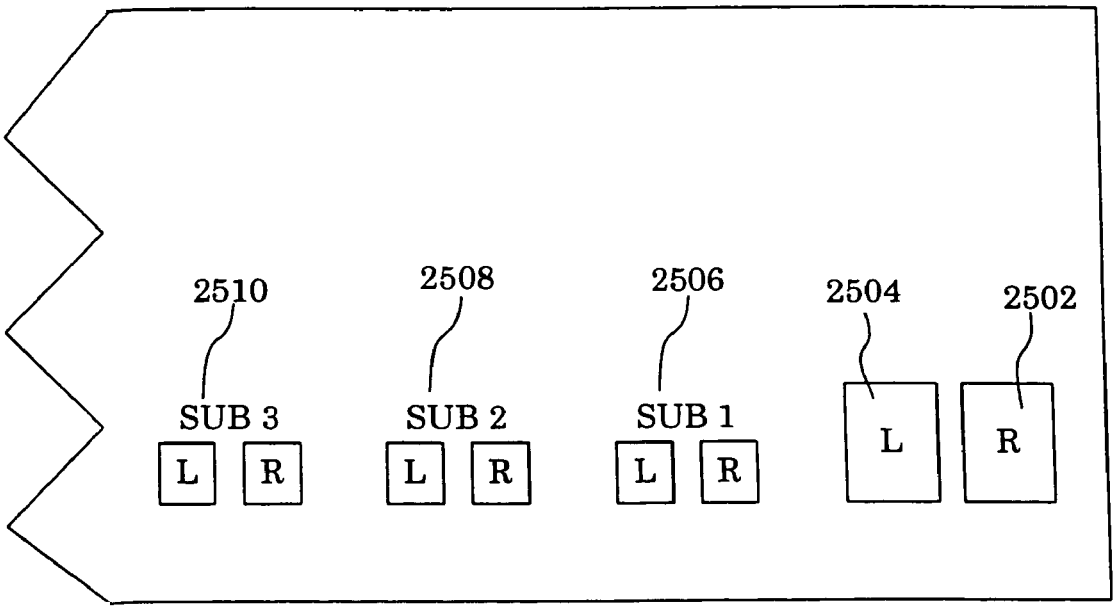
FIG. 25 is a schematic diagram of a preferred embodiment of a portion of a rear portion of a music system in accordance with the present invention.

FIG. 25 shows a portion of the rear portion of music system 106. As shown, music system 106 includes outputs. Preferably, in the embodiment shown in FIG. 23, music system 106 includes a main right output 2502, a main left output 2504, and sub output jacks, sub1 2506, sub2 2508, and sub 3 2510. Music system 106 can also include additional outputs. Each of the sub output jacks can include left and right channels. In some embodiments, the various sub output jacks can be associated with certain instruments or instrument groups. Preferably, sub1 output jack 2506 can be associated with reeds and brass, sub2 output jack 2508 can be dedicated to strings, and sub3 output jack 2510 can be associated with keyboards, guitars and percussion. Sub output jacks, sub1 2506, sub2 2508 and sub3 2510, provide more control of the overall mix by separating the reeds/brass, strings, and keyboards/guitar/percussion sections. Music system 106 can be associated with a sound system, including a mixer and/or speakers, by placing the various output jacks of music system 106 in communication with the sound system. In some embodiments, main right output 2502 and main left output 2504 can be connected to the sound system. By connecting through main right output and main left output, a well balanced stereo mix with a light reverb setting can be achieved. In some embodiments, sub output jacks, sub1 2506, sub2 2508, and sub3 2510, can be connected to the sound system for more control of the overall mix. Additional reverb can be added by connecting the main right and left outputs and adjusting the mix accordingly.

Figure 26:
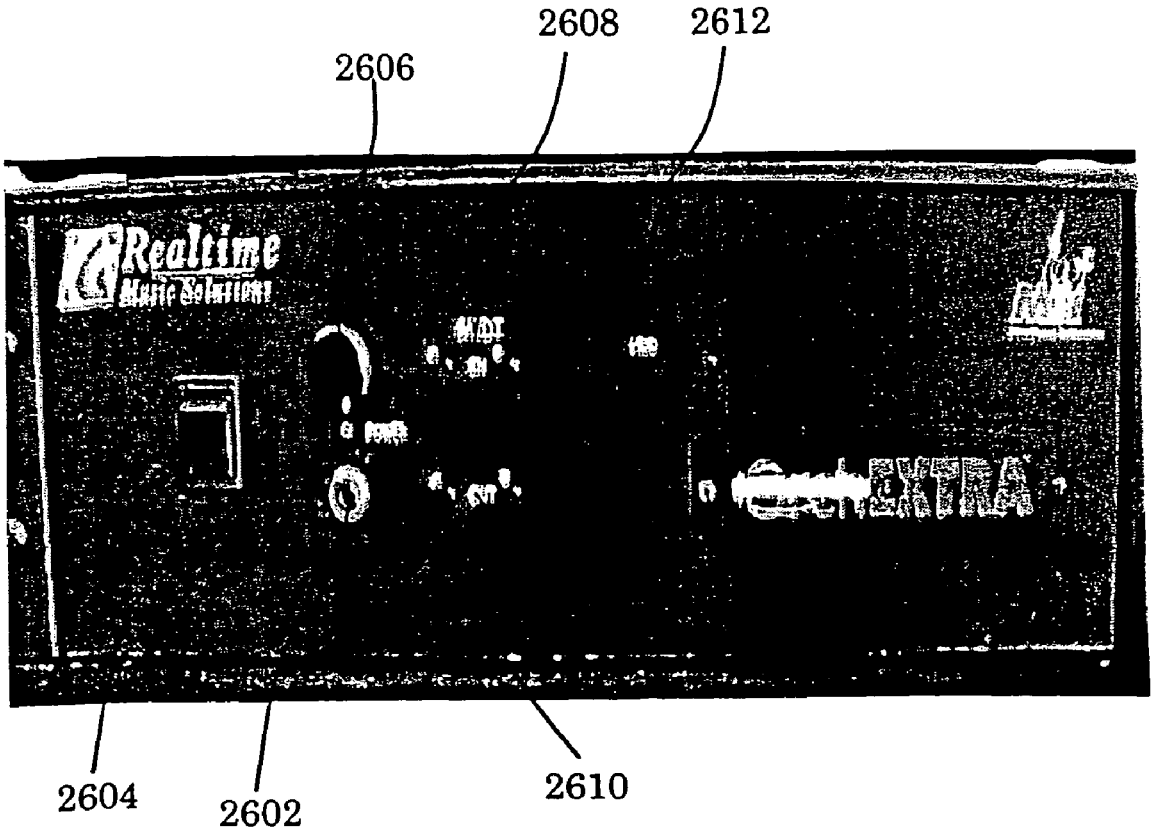
FIG. 26 is a schematic diagram of a preferred embodiment of a portion of a front portion of a music system in accordance with the present invention.

FIG. 26 shows a front portion of processor 2304. As shown, processor 2304 includes indicators. Preferably, in the embodiment shown in FIG. 26, processor 2304 includes a power switch and light 2604, a volume control 2606, and MIDI activity lights including MIDI IN 2608 and MIDI OUT 2610, and a hard drive activity light 2612. MIDI IN 408 indicates the use of tap and MIDI OUT 410 indicates whether a sound module is working. Hard drive activity light 2612 indicates hard drive activity, such as system loading. Processor 2304 can also include additional switches and/or indicators. Also, processor 2304 can include a headphone jack 2602.

Figure 27:
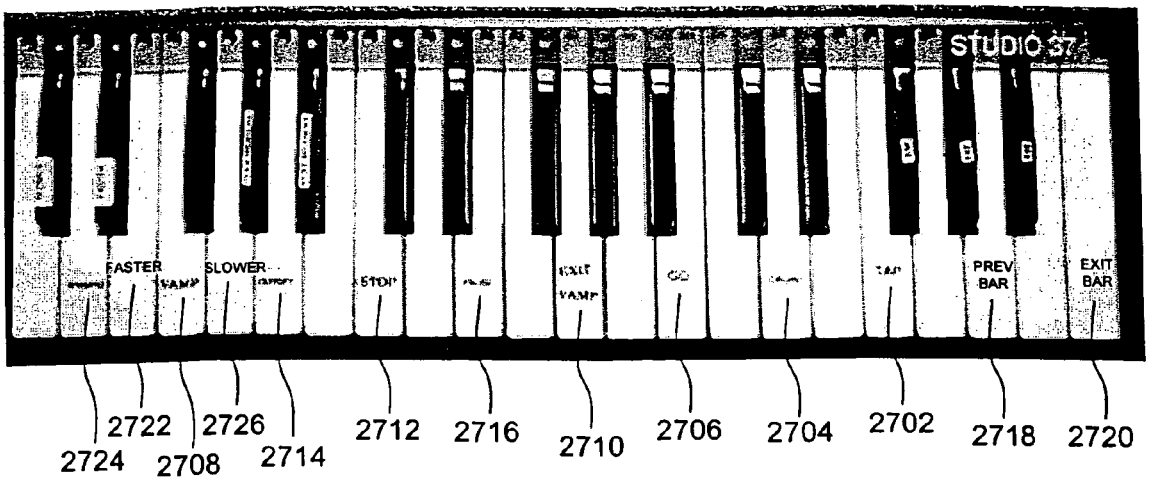
FIG. 27 is a top view of a preferred embodiment of a keyboard in a deployed position in accordance with the present invention.

FIG. 27 shows an exemplary second keyboard 2310. Preferably, in the embodiment shown in FIG. 27, second keyboard 2310 is a musical keyboard and keys on second keyboard 2310 are labeled as follows: TAP 2702, CRUISE 2704, GO 2706, VAMP 2708, X-VAMP 2710, STOP 2712, CUTOFF 2714, PAUSE 2716, NEXT BAR 2718; PREV BAR 2720, FASTER 2722, A TEMPO 2724, and SLOWER 2726.

TAP key 2702 allows the user to 'tap' the music. By tapping at desired tempo, the user can perform the music according to individual interpretation. The user can speed up or slow down the tempo to follow the performance. The user can create deep rubato passages or taut accelerandos. The TAP key can be assigned a tap value, such as quarter, eighth or half note. Preferably, tap indicator 2818 (see FIG. 28) on display 2304 (see FIG. 24) displays the current tap resolution. Also, the piano-conductor score, indicates the beat assigned to the TAP key in any given measure. As known in the art, a piano-conductor score is a book that contains a reduced version of the music for the show, usually a piano reduction line and a vocal line, with certain instrument use indicators. The score would also contain markings of value to the use, such as tap subdivision changes, pauses, attaccas, atempos, and other indicators. Most songs preferable be tapped in one duration throughout the entire song, unless certain time signatures or musical phrases make a change in the tap beat. Once a song has been loaded, the user may choose to begin tapping the song by pressing TAP key in a rhythm following the conductor or performer.

CRUISE key 2704 is similar to TAP key 2702 because each time the CRUISE key is pressed, the music moves to the next beat subdivision and calculates tempo information. However, CRUISE key 2704 allows the user to establish a tempo with a few key strokes and then lift off from the keyboard to set the music in motion at the established tempo. The user does not have to press Go after tapping in cruise mode. CRUISE key 2704 allows the user to change the tempo gradually. More extreme tempo changes can be handled with TAP key 2702. The user can switch back and forth between CRUISE key and TAP key by simply pressing the appropriate CRUISE, TAP or PLAY key.

GO key 2706 places the music system in play mode. GO key 2706 allows music to be played at an established tempo. If tempo has not been set with either TAP key 2702 or CRUISE key 2704, the music is performed on autopilot at a preprogrammed tempo. If a desired tempo is established with TAP key or CRUISE key, GO key 2706 causes music to continue playing at the established tempo. To change the tempo, the user can tap at any time.

VAMP key 2708 creates an immediate vamp in a song. The length of the vamp is equal to the number of times the VAMP key is pressed. This can be useful when a scene change has not happened as quickly as anticipated or a piece of scenery has gotten 'hung-up.' For example, if the conductor gives the sign to "vamp measures 22 through 25," the user would press VAMP key four times from measure 22, one press for each measure, so the music system would vamp measures 22, 23, 24, 25. The "on-the-fly" vamp would appear in action event window.

X-VAMP 2710 is an exit vamp key. X-VAMP key 2710 allows the music system to exit the vamp—a pre-programmed vamp or a vamp that was created on-the-fly—on the next pass. Vamping will be continued until X-VAMP key is pressed. For example, with 4-measure vamp, pressing X-VAMP key in measure 4 of the vamp causes the music system to exit the vamp immediately. However, if X-VAMP key is pressed in measure 1 of 4-measure vamp, the music system will complete the vamp, playing through measures 2, 3, and 4 before exiting.

STOP key 2712 takes the music system out of any mode where the music is still playing and puts the music system into stop mode. Any note currently playing is turned off. Another function of STOP key 2712 is to inform processor 2304 of a stoppage while the user is tapping. It is essential to press STOP key when tapping is finished, but the user is still in the middle of a song. Instances like this can occur in many varieties: during rehearsal the user may be tapping a sequence and the rehearsal is momentarily stopped.

CUTOFF key 2714 differs from STOP key 2712 in that the CUTOFF key allows the user to cut off a held or paused note, while keeping the music system in play mode. This is the preferred way to cutoff a chord held by PAUSE key 2716. The user can resume play by pressing TAP key 2702 or GO key 2706.

PAUSE key 2716 causes the music system to hold in place until another key is pressed. Any note currently playing continues to play. This is especially useful in long fermatas the user may want to take, such as going from the "Tomorrow" theme into "Hard-Knock Life" in the ANNIE Overture, or at the end of big numbers where a longer hold is desired. PAUSE key 2716 can be used in conjunction with CUTOFF key 2714.

NEXT BAR key 2718 provides a quick way to jump to the first beat of the next measure in the score in play mode. Pressing NEXT BAR key several times advances the user though the score bar by bar. NEXT BAR key can be used when the user is getting behind and wants to jump immediately a bar ahead.

PREV BAR key 2720 is previous bar key. PREV BAR works similar to NEXT BAR key 2718, except in reverse. PREV BAR key can be used when the user is getting ahead and wants to jump immediately a previous bar.

FASTER key 2722 allows the user to speed up the tempo while in play mode. Tempo change is preferably displayed on a display a tic or two at a time.

A TEMPO 2724 allows music system to revert to the preset tempo in the file which corresponds to the tempo markings in the score, while in go mode.

SLOWER 2726 allows the user to slow down the tempo while in play mode. Tempo change is preferably displayed on a display a tic or two at a time.

Second keyboard 2310 can also include additional keys to provide additional functions. Additionally, first keyboard 2306, which can be a computer keyboard, can accomplish many commands that are also be accomplished by second keyboard 2310 or mouse 2308. For example, function keys on first keyboard 2306 can be assigned to following commands:

F1=SLOWER
F2=A TEMPO
F3=FASTER
F4=CUT OFF
F5=REWIND
F6=STOP
F7=PAUSE
F8=GO
F9=RESET
F10=EXIT VAMP
F11=VAMP
F12=CRUISE
Shift F1=QUIT
Shift F2=REINIT
Shift F3=EDITOR
Shift F4=ALL NOTES OFF
Space Bar=TAP Music system 106 can be powered up by turning on power switch 2604 shown in FIG. 26. Once music system 106 has been powered up, the music system may go through a series of startup processes and messages may also appear. For example, once the series of startup processes are completed, a message may appear to notify the user to press <ENTER> key in order to launch the application. Once the <ENTER> key is pressed, a message indicating that samples are loading may appear. After the sample loading is completed, main window 2802 may appear with the main load, with the default show. Once the performance is completed, music system 106 can be shut down. For example, the user can select an option to shut down in main window 2802. The music system may go through a series of shut down processes and messages may also appear. For example, once the series of shut down processes are completed, a message may appear to notify the user to turn off the music system. The user can turn off power switch 2604 and shut off all other electronic components.

Main window may include indicators and/or fields. Main window may include indicators to indicate what piece is to be performed, what beat the user is in and a list of songs. Main window may also include indicators to indicate a current meter, a current beats per minute played, and a current beat subdivision controlled by TAP key. Main window 2802 can also include additional indicators and/or fields.

Figure 28:
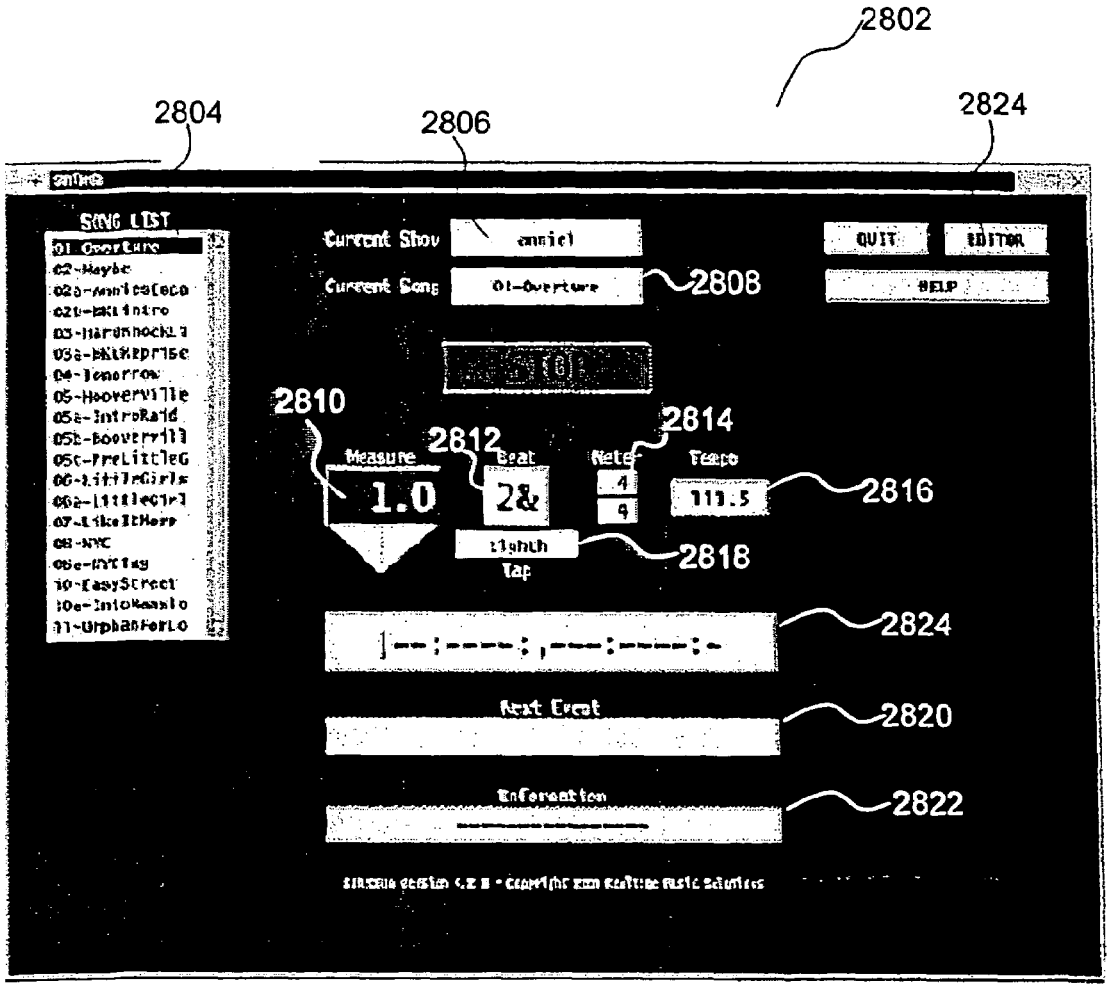
FIG. 28 is a schematic diagram of a preferred embodiment of a main screen in accordance with the present invention.

FIG. 28 shows an exemplary embodiment main window 2802. Preferably, main window 2802 includes indicators and/or fields. Preferably, main window 2802 includes a song list field 2804, a current show field 2806, a current song field 2808, a measure field 2810, a beat field 2812, a meter field

2814, a tempo field 2816, and a tap field 2818. Song list field 2804 lists a series of songs and current show field 2806 and current song field 2808 indicate what is currently being performed. When music system 106 is first launched, the music system may automatically load the first song and the first song in song list field 2804 may be highlighted. The highlight of a song in the song list field 2804 is another indicator of the current song.

The default show is set to Act1 of whatever show the user has licensed. For example, if the user is performing Annie something along the lines of annie1, will appear in current show field 2806 in main window 2802, with all the songs in the first act of Annie present in song list field 2804. Measure field 2810 indicates the current measure and beat field 2812 indicates the current beat. Off beats (i.e. alternate eighth notes in 4/4 time, alternate quarter notes in 2/2) can be denoted with a special character, for example, an '&' symbol in beat field 2812. Meter field 2814 indicates the current meter, tempo field 616 indicates the current tempo in beats per minute, and tap field 2818 indicates the current beat subdivision associated with the TAP key.

As the user plays, music system 106 counts off the bars and measure numbers. The measure number s correspond to the conductor score measure numbers. They are not necessarily consecutive. If the score measure numbers include letters, for example, 13*a* and 13*b*, music system 106 preferably displays those measure numbers as 13.1 and 13.2, respectively. Additionally, main window 2802 may include next event field 2820 and information field 2822.

Next event field 2820 can be used for the songs that have pre-programmed events (that exist in the score, for example, repeats or vamp and/or other actions). As each event passes, the next event preferably appears in next event field 2820. For example, there may be a repeat of bars 5 to 11. As soon as the music system finishes playing bar 11 for the second time, for example, the next action event preferably appears, for example, bar 111 to 112. This event remains in the main window until the measure in which that next event occurs.

Information field 2822 preferably displays input information. For example, to jump to measure 45, the number and/or command preferably appears in Information field 2822 as the user types it. Further, main window 2802 may also includes a field 2824. Most of the time, field 2824 functions as a symbolic timeline, giving a high level view of the entire song and events, such as repeats, cuts and/or other events. However, if certain arbitrary activities are initiated, such as a cut to an alternate measure location or a vamp-on-the-fly, field 2824 indicates this process. Field 2824 can be thought of as warning lights for certain critical real-time activities. Main window 2802 shown in FIG. 28 can also include additional indicators and/or fields.

Music system 106 includes several possible modes. For example, possible system modes may include play, stop, tap, cruise, pause, and vamp. Music system 106 can also include additional modes. These modes are entered or exited depending on the way the song is performed via first keyboard 2306 or second keyboard 2310 (see FIG. 24). The mode that the user is in at any given time during the operation of the music system can be displayed in main window 2802 (see FIG. 28).

There are many ways to begin playing the song with music system 106. Preferably, the user can begin playing the song by pressing GO key 2706 (see FIG. 27) on second keyboard 2310 or [F8] on first keyboard 2306. Music system 106 can play the song at the preprogrammed tempo as defined in the score. Alternatively, music system 106 can follow a tempo of conductor or singer—acting like any other instrument and sounding like many instruments or instrument groups playing at one time.

In some embodiments, the up and down arrow keys on first keyboard 2306 may allow the user to select other songs. Preferably, if music system 106 is already in play mode, the arrow keys can also act as a stop button. Preferably, if the current song ends, the User needs to arrow to another song, usually the next song in the show or go to an earlier spot in the current song to continue playing. Alternatively, the song can be stopped while it is being played by pressing STOP key 2712 (see FIG. 27) on second keyboard 2310 or [F6] on first keyboard 2306.

Figure 29:
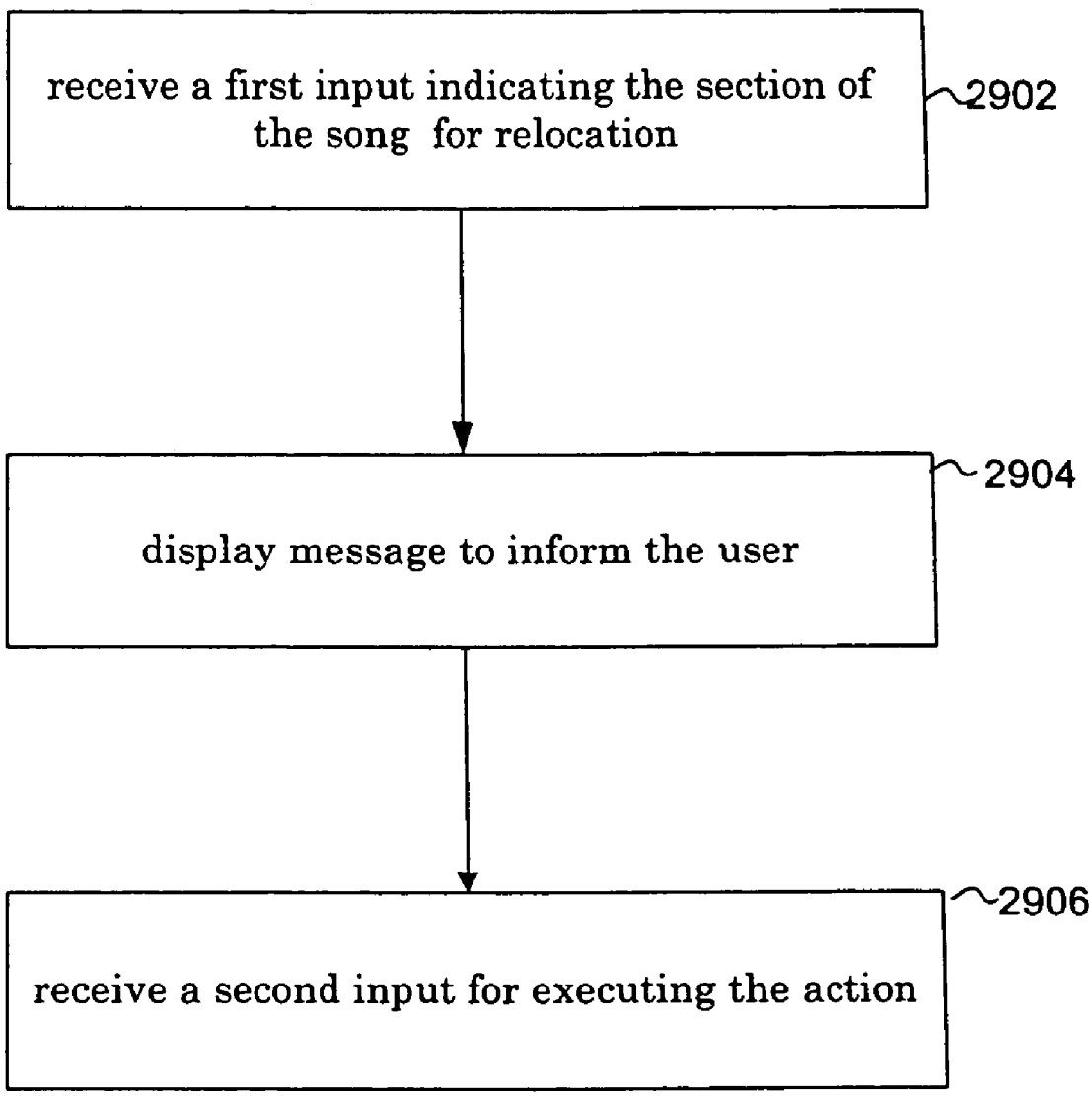
FIG. 29 is a flow diagram of a preferred embodiment of a navigation process in accordance with the present invention.

Music system 106 allows the user to navigate within a song. There are many ways to navigate. Many commands and/or processes can be used. Preferably, this can be established by providing a way to execute an action that would relocate within a song. FIG. 29 shows an exemplary flow diagram of steps of a process that can be used to relocate within a song in one embodiment of the present invention.

In step 2902, the user can indicate the section of the song that the user wants to move to. For example, the user can indicate the section of the song in main window 2802. Preferably the measure of the song can be used to indicate the section of the song. Preferably, lettered measures, for example, 45*b*, 2*c* and *a*, can be treated with relative numbers after a decimal point, for example, 45.2, 12.3 and 0.1, respectively. In step 2904, preferably information field 2822 in main window 2802 can display the entered measure number and messages may appear. For example, "GO TO [measure number] ARMED!!!" can be appeared to inform the user to prepare for a jump during the performance. In step 2906, the user can execute the action. For example, the user can execute the action by pressing GO key 2706 (see FIG. 27) on second keyboard 2310 (see FIG. 24) or [F8] on first keyboard 2306. If the action is executed while the music is playing, the music continues from the jump point without disruption.

Preferably, if these steps are performed after a STOP command, the music system waits for the user's instructions to play. The user can also move to the beginning of the currently selected song using first keyboard 2306. For example, the user can use [F5] key on the first keyboard. Other commands and/or processes can also be used to navigate within the song.

Music system 106 allows the user to customize a show and/or song. Music system 106 provides the options to the user to customize the show and/or song. There are many ways to provide the options to the user. For example, editor window can be used.

Figure 30:
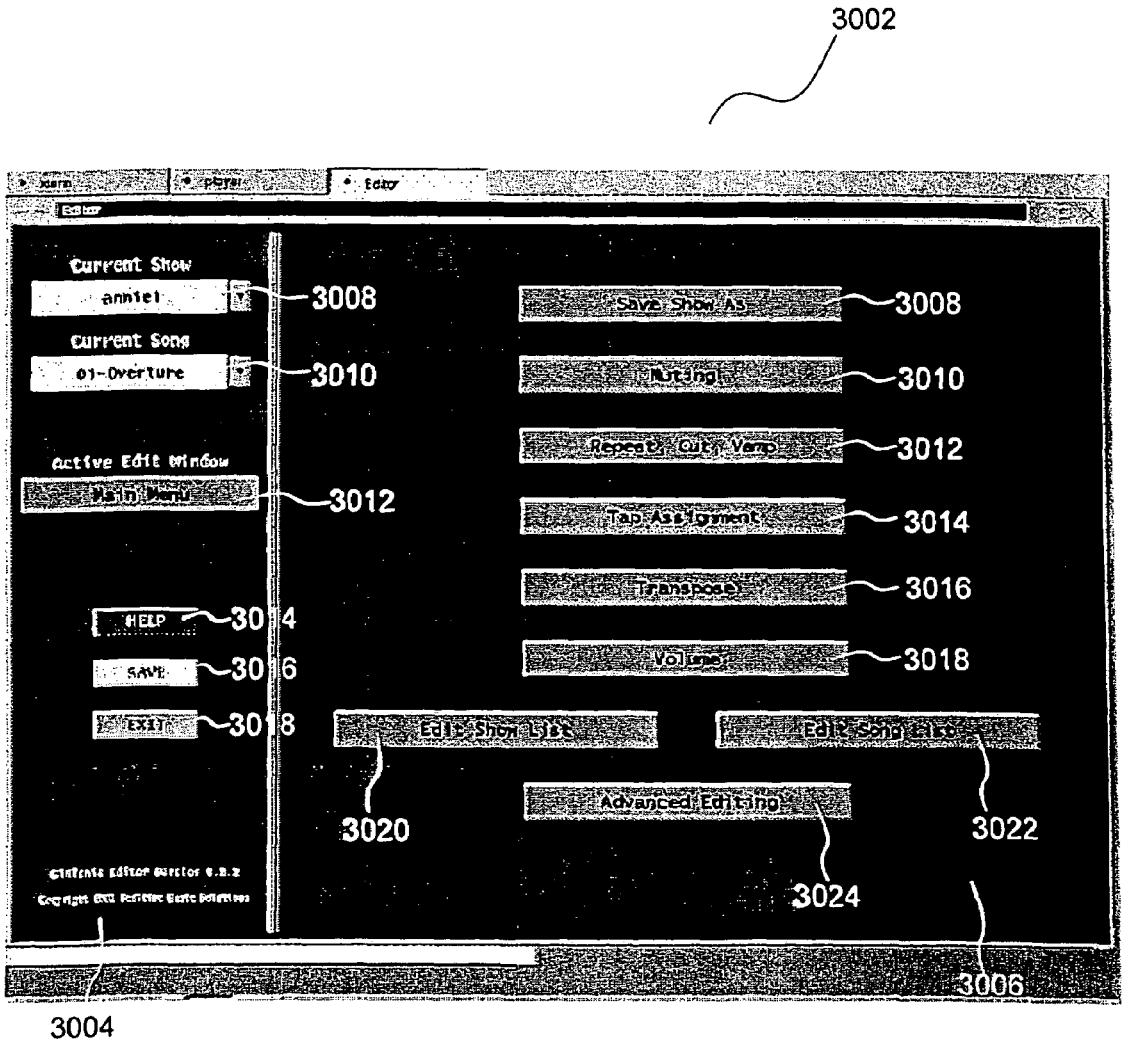
FIG. 30 is a schematic diagram of a preferred embodiment of an editor window in accordance with the present invention.

FIG. 30 shows an exemplary editor window 3002. Preferably, editor window 3002 can be accessed from main window 2802. Editor window 3002 can include many options, functions and/or fields. For example, editor window 3002 can include an editing options section 3006. Editing options section 3006 can allow the user to select the specific editing action.

Preferably, editor window 3002 can also include an information and navigation section 3004. Preferably, information and navigation section 3004 can allow the user to identify and select a show and/or song to edit and identify the currently active editing actions. Information and navigation section 3004 can also allow the user to obtain help and save the work. For example, information and navigation section 3004 can include a current show field 3008, a current song field 3010, an active edit field 3012, a help field 3014, a save field 3016, and an exit field 3018.

Current show field 3008 can display the currently active show. Preferably, if multiple versions of a particular show have been created, the user can select one of the alternate versions using an arrow key on first keyboard 2306. Current song field 3010 can display the song that is ready to be edited. Preferably current song field 3010 can display the available songs in the show. The user can then select a new song title for editing. Active edit field 3012 can display the currently active editing. Help field 3014 can provide additional help and save field 3016 can allow the user to save the work. Exit field 3018 allows the user to exit editor window 3002.

Music system 106 provides many functions and tools to edit and customize the songs and/or shows. Following disclosure describes exemplary functions and tools. However, music system 106 may also includes additional functions and tools.

Figure 31:
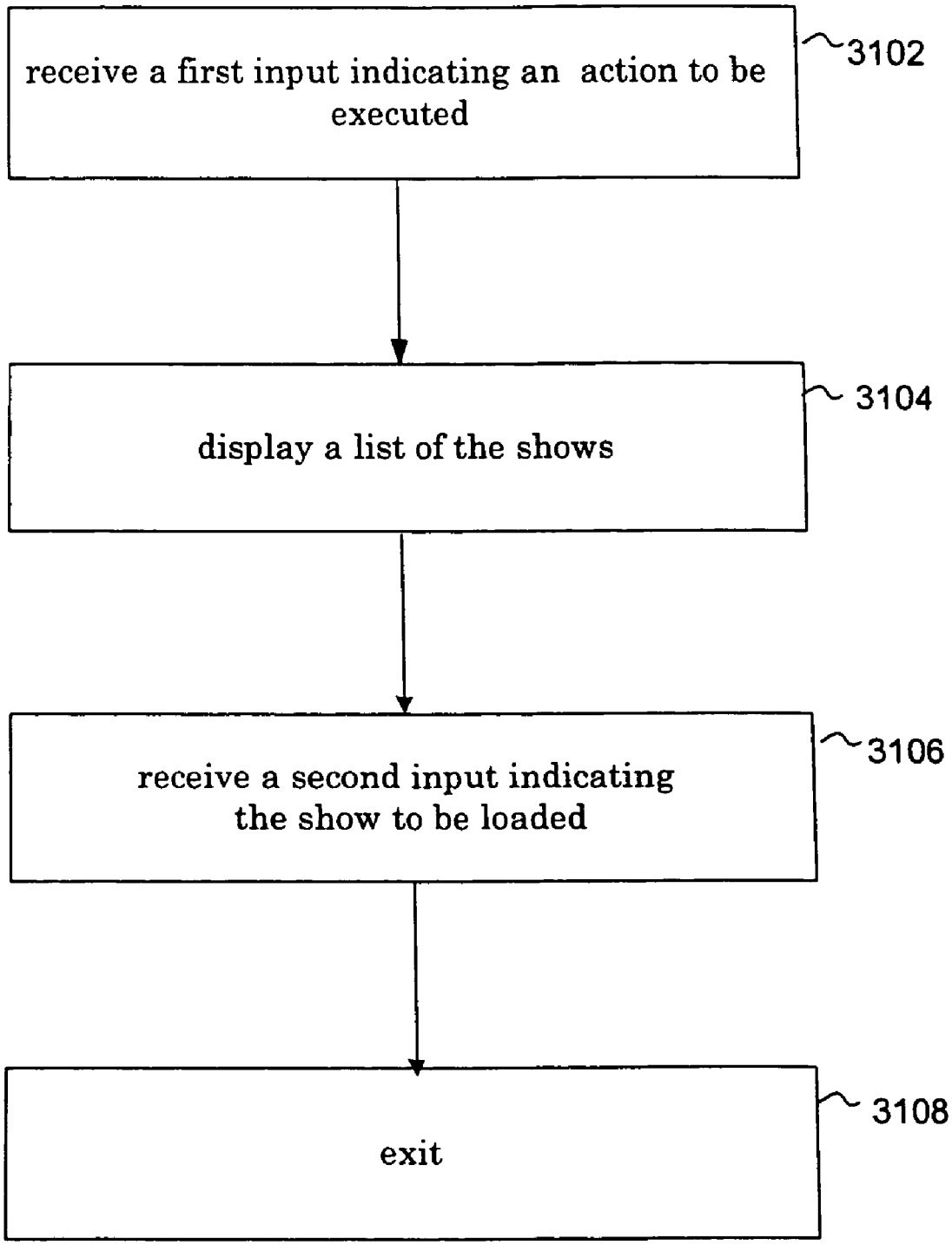
FIG. 31 is a flow diagram of a preferred embodiment of a load process in accordance with the present invention.

There are many ways to load a new show. Many commands and/or processes can be used. FIG. 31 shows an exemplary flow diagram of steps of a process that can be used to load a new show.

Figure 32:
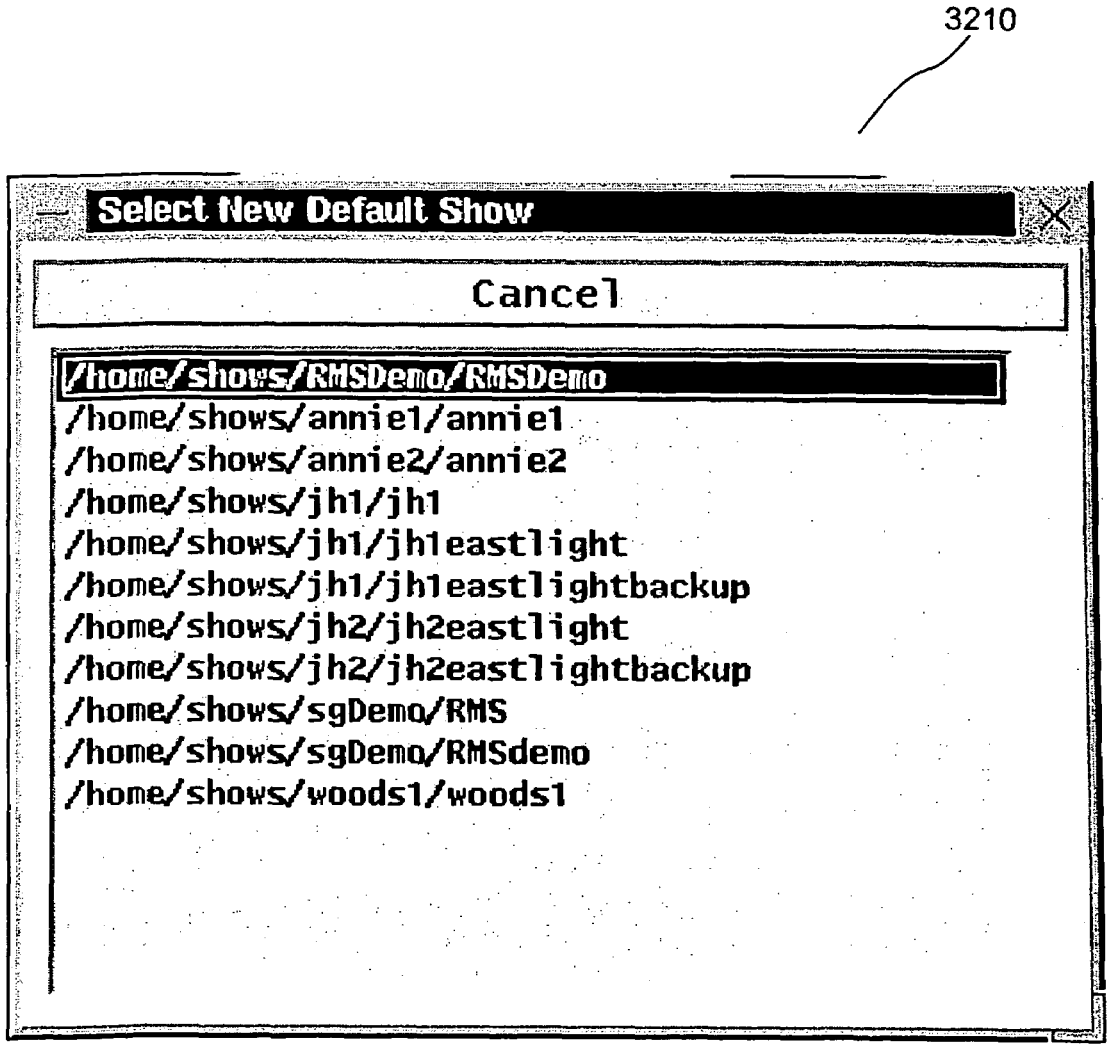
FIG. 32 is a schematic diagram of a preferred embodiment of a show selection window in accordance with the present invention.

In step 3102, the user selects a tool to load a new show. Preferably, main edit window 3002 (see FIG. 30) can be used. Main edit window 3002, for example, can be selected from main window 2802 (see FIG. 28). From main edit window 3002, the user can select the action to be executed. For example, to load a new show, the user can select 'Edit Show List' field 3020 in main edit window 3002 (see FIG. 30). This takes the user to the area where general housekeeping for show files takes place, including selecting the next show. In step 3104, the user can review a list of the shows. For example, the user can review a list of the shows by selecting "New Default Show" field. Preferably, display 2302 (see FIG. 24) displays a window containing a list of the shows. FIG. 32 shows an exemplary window 3210 containing a list of the shows displayed in display 2302.

In step 3106, the user can select the show to be loaded. For example, if the user wanted to load the second act of Annie, the user can select the third line in window 3210 in FIG. 32. In step 3108, the user can exit editor window 3002 and return to main window 2802. Preferably, 'Exit' field 3018 can be used to exit editor window 3002.

Music system 106 allows the user to save a new version of the currently active show. This way, if the user makes a mistake during the editing, the user can easily return to a previous or alternate version. This can be achieved in many ways. For example, 'Save' field 3018 in main edit window 3002 can be used. 'Save' field 3018 can allow the user to quickly save a new version of the currently active show. It can also automatically select the newly created show as the default show. Preferably, a show title can contain letters and numbers. Preferably, a show title can contain up to 14 characters.

Music system 106 allows the user to mute instruments. In some cases, the user can mute instruments that are being performed by traditional instruments. This allows the user to play only the parts that are not present in the user's usual ensemble. Preferably, the user can mute instruments on a show basis, on a song basis or for a portion of a song. The user can also unmute instruments that may have been previously muted. There are many ways to establish this. Preferably, this can be established by providing a mute/unmute action as one of the options provided in editor window 3002. Preferably, the mute/unmute action can be established in a muting edits window. Preferably, the user can access the muting edits window from editor window 3002.

Figure 33:
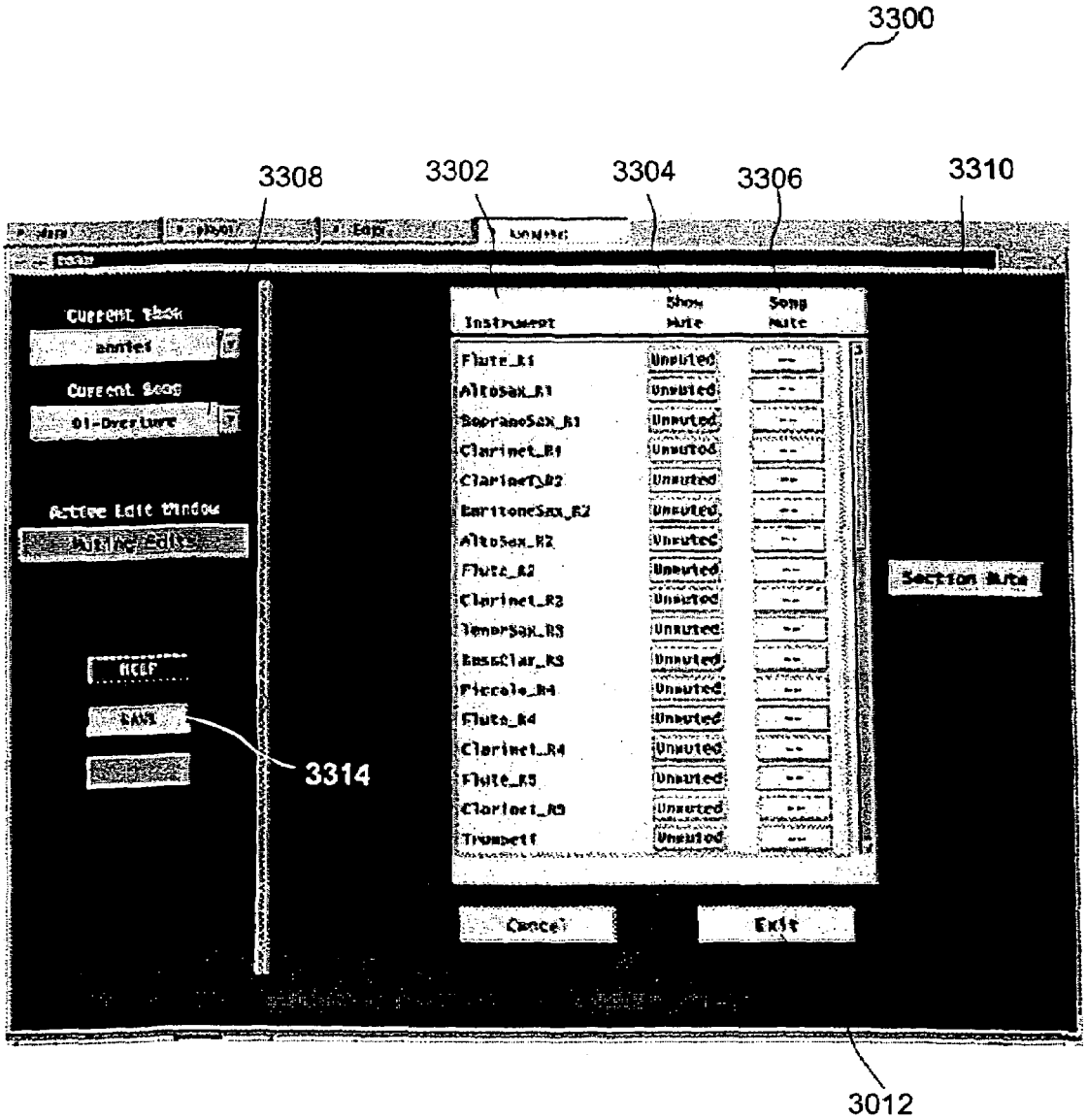
FIG. 33 is a schematic diagram of a preferred embodiment of a muting edits window in accordance with the present invention.

FIG. 33 shows an exemplary muting edits window 3300. Muting edits window 3300 can include columns. For example, muting edits window 3300 can include a first column 3302 including a list of instruments scored in the show, a show mute column 3304 and a song mute column 3306. The user can mute instrument or instruments for the entire show. For example, the user can mute an instrument for the entire show by selecting the instrument's corresponding show mute field in show mute column 3304. Preferably, an indicia is used to indicate the mute state of an instrument. In an exemplary embodiment, the word in show mute column 3304 preferably changes from 'Unmuted' to 'Muted.' The user can also mute an instrument for an individual song. For example, the user can mute an instrument for an individual song by selecting the instrument's corresponding song mute field in song mute column 3306 when the user's desired song is in current song field 3308. Preferably, an indicia is used to indicate the mute state of an instrument. In an exemplary embodiment, the word in the Song Mute field preferably changes to 'Muted'.

Music system 106 also allows the user to mute and unmute instruments or instrument groups for just a portion of a song. For example, if the user is performing a musical with four reed books, but the user only has two reed players, the user can show-mute Reeds 1 and 2 in the system and give these parts to the user's available players. There might be a 16 bar section of one song where there is a particularly interesting phrase written for Reeds 3 & 4, while Reeds 1 & 2 are tacit. The user may then want to move the two reed players to the Reed 3 & 4 books just for that section. Section muting allows the user to specify a duration of muting or unmuting and automatically performs the step of re-muting or re-unmuting of the instrument at the end of the duration. Section muting also allows the user to perform similar mutes or unmutes on a group of instruments. For example, the user can mute Reeds 3 & 4 together from measures 10 to 27 conveniently using section muting. There are many ways to establish section muting. Preferably, this can be established by using a section mute window.

Figure 34:
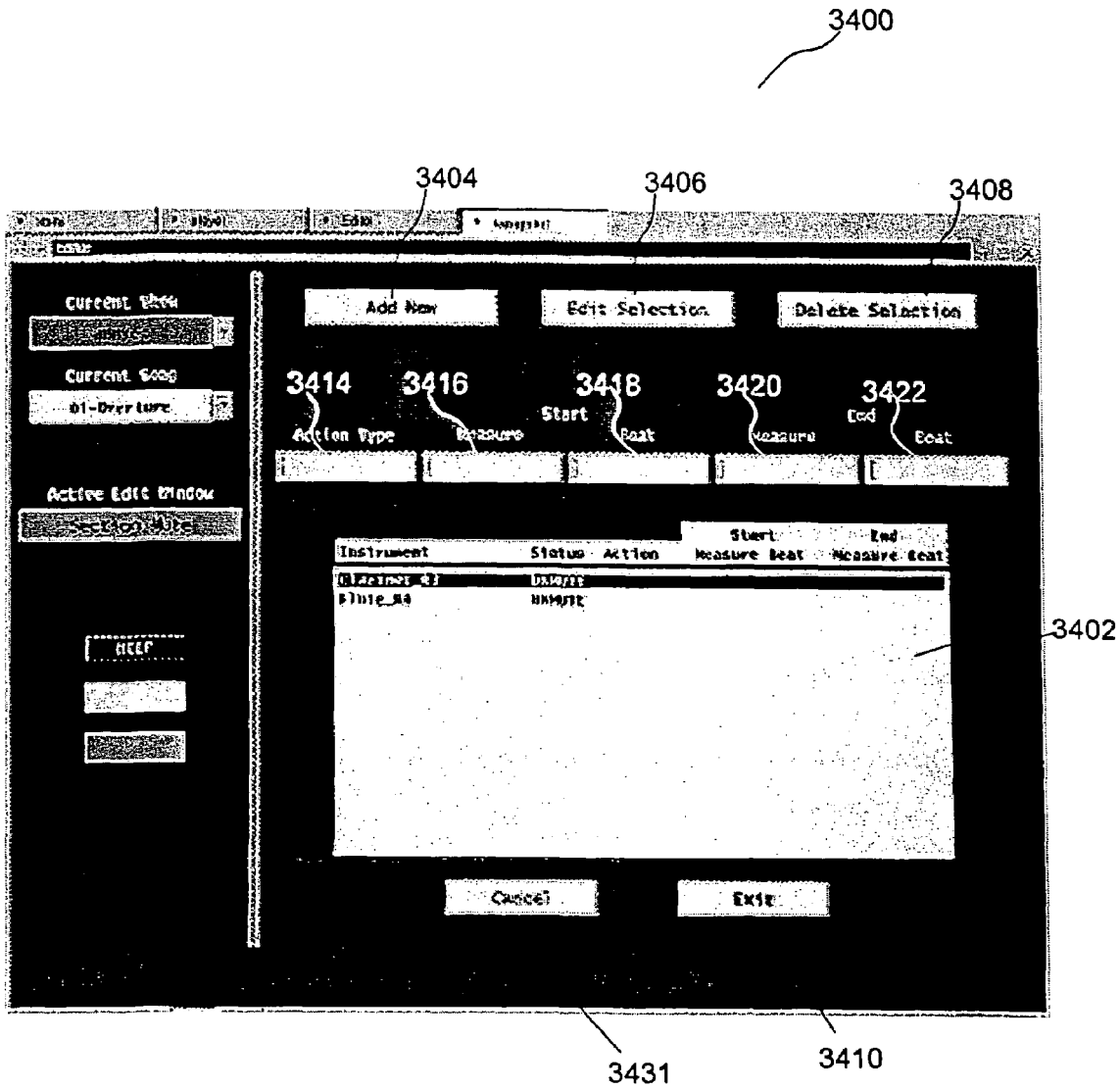
FIG. 34 is a schematic diagram of a preferred embodiment of a mute window in accordance with the present invention.
Figure 35:
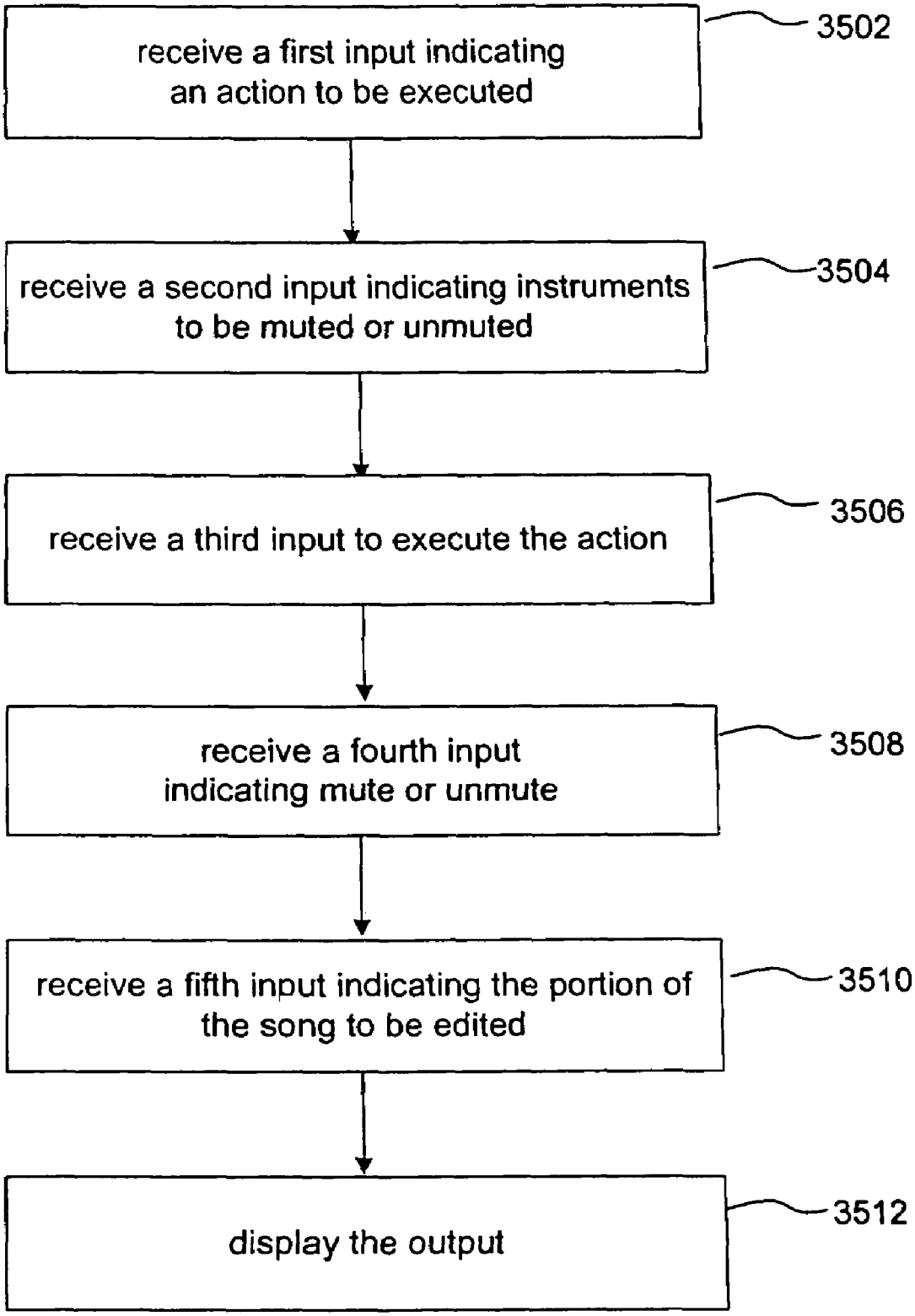
FIG. 35 is a flow diagram of a preferred embodiment of a mute process in accordance with the present invention.

FIG. 34 shows an exemplary section mute window 3400 and FIG. 35 shows an exemplary flow diagram of steps of a process that can be used to accomplish section muting.

In step 3502, the user can select a tool to establish section muting. For example, section mute field 3310 in muting edits window 3300 (see FIG. 33) can be selected. Preferably, this allows the user to access a section mute selection window (not shown in Figure). In step 3504, the user can select instrument or instruments to mute or unmute in the section mute selection window. Preferably, this allows the user to access a section mute edit window 3400. Preferably, the selected instrument(s), as well as its current mute status can be displayed in main field 3402. In step 3506, the user can select the options to execute select muting. For example, add new field 3404 can be selected. Preferably, at this point, the options, mute or unmute, can appear in selection mute edit window 3400 for the user to select. In step 3508, the user can select either mute or unmute. In step 3510, the user can specify the portion of the song to be muted or unmuted. For example, the user can specify the portion of the song with a start measure number, a starting beat, an end measure number, and an ending beat of the portion in fields 3416, 3418, 3420, and 3422, respectively, in select mute window 3400. Preferably, a corresponding decimal point can be used for a lettered measure.

In step 3512, preferably, the mute or unmute the user is creating can be displayed. For example, this can be displayed in section mute field 3402. If the user is satisfied, the user can exit section mute edit window 3400. This can be done by selecting a section mute exit field 3410 to exit section mute edit window 3400. Preferably, this returns the user to an intermediate section mute select window (not shown). From this window, the user can select additional instruments for different mutes/unmutes. The user can also exit this window and return to the edit window 3002 by selecting an appropriate exit button or field.

If the user is not satisfied with selected mute or unmute, the user can select a cancel field to erase the selection and start over. Preferably, the user can also make changes to the selection or delete the selection. For example, the user can make changes to the selection by highlighting individual mutes/unmute commands and selecting an edit selection field 3406 in section mute edit window 3400 or delete it by selection a delete selection field 3408. Preferably, <Enter> key on first keyboard 2306 can advance the user to the next field in editing. Preferably, the user can exit muting edits window 3300, for example, by selecting a muting edits exit field 3312 in muting edits window 3300. The user can also save the work by selecting a save field 3314.

Music system 106 allows the user to quickly shorten or extend a song. There are many ways to accomplish this. Preferably, this can be accomplished by providing a way to execute an action that would easily repeat a passages, cut the song short and/or permit the use of vamps.

Figure 36:
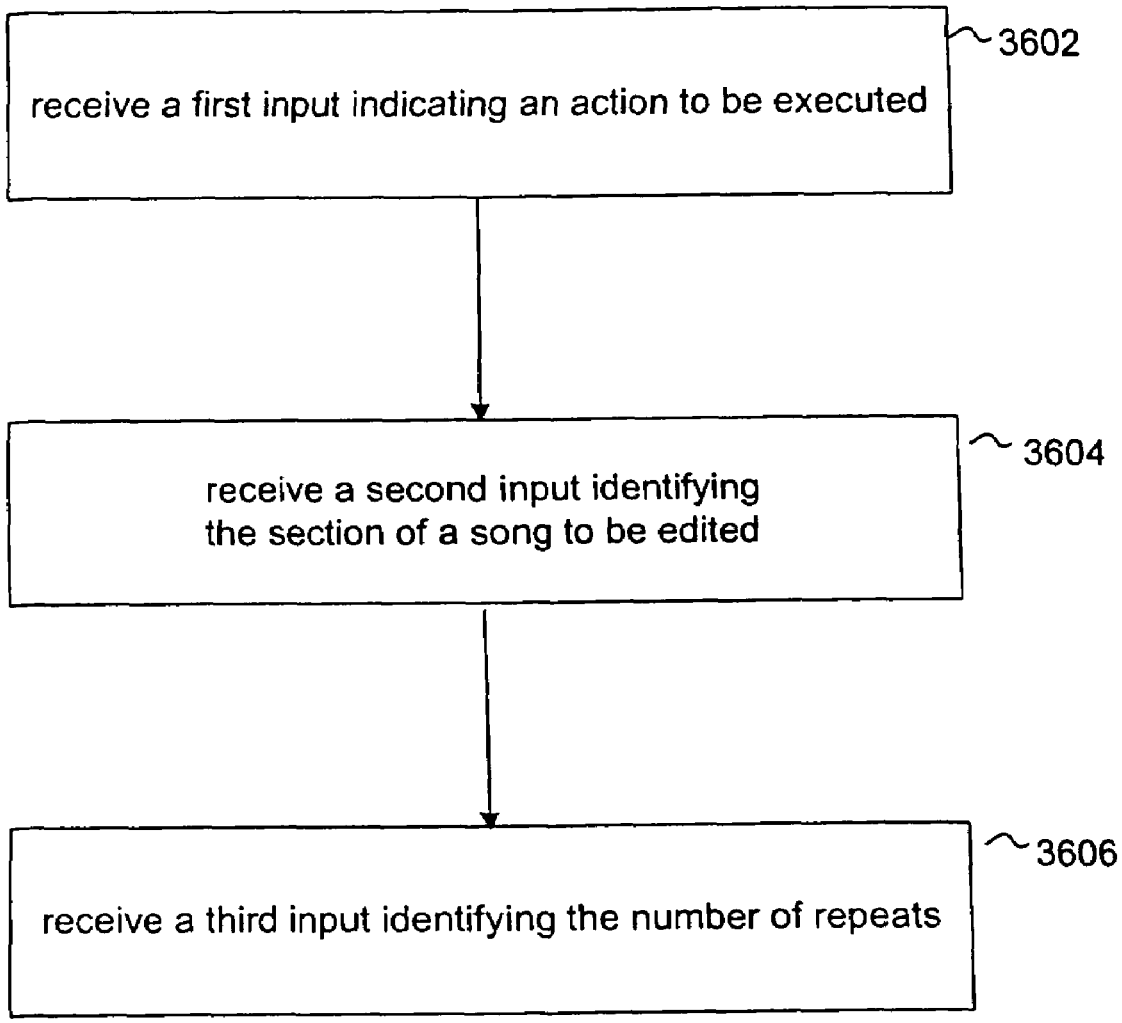
FIG. 36 is a flow diagram of a preferred embodiment of various edits in accordance with the present invention.
Figure 37:
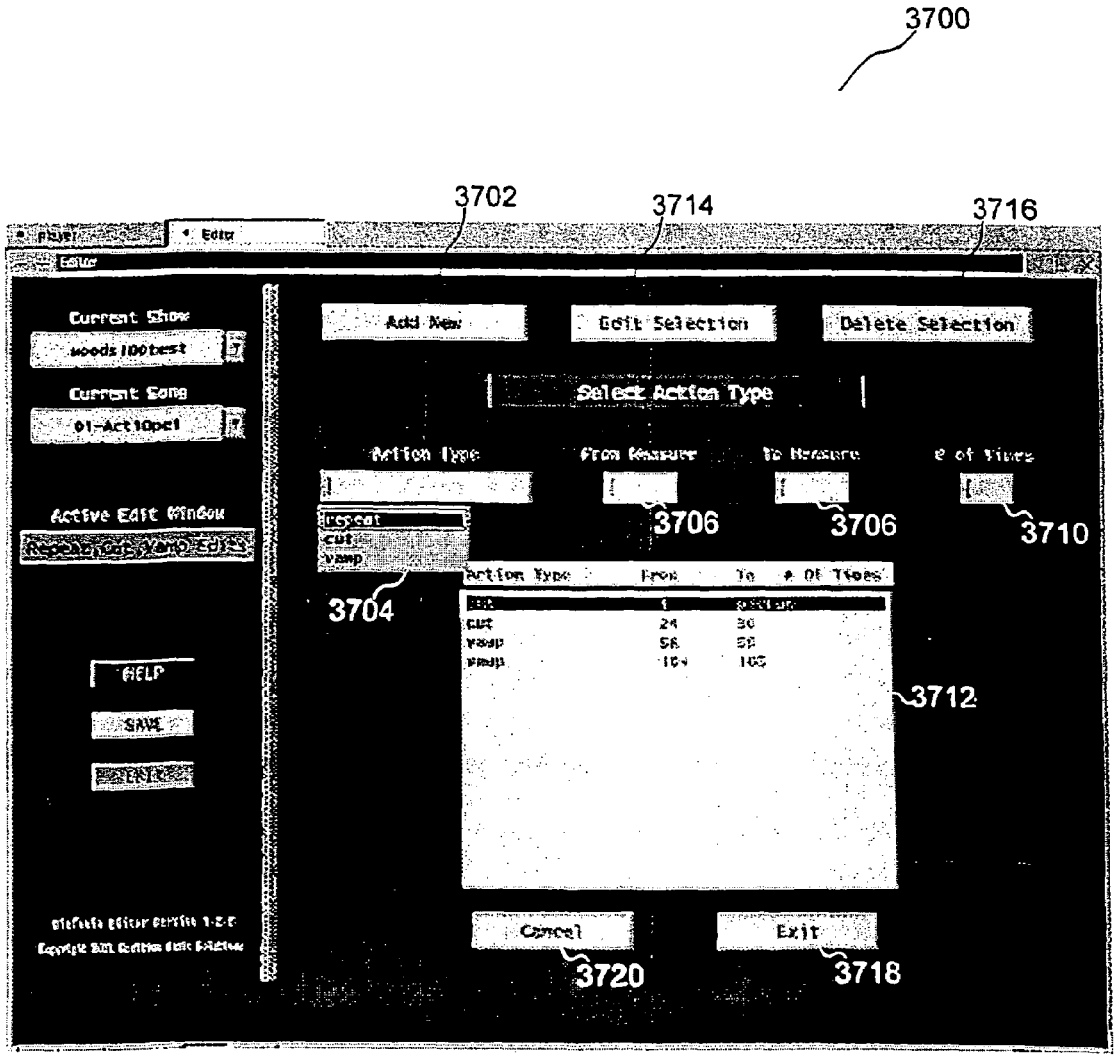
FIG. 37 is a schematic diagram of a preferred embodiment of a repeat, cuts, vamp edit window in accordance with the present invention.

FIG. 36 shows a flow diagram of steps of a process that can be used to establish repeat, cut, and vamp edits, and FIG. 37 shows an exemplary repeat, cut, vamp edits window 3700.

In step 3602, the user can select an action to be executed. For example, add new field 3702 in repeat, cut, vamp edits window 3700 can be selected to display the user options. Preferably, the user options include a repeat, cut or vamp. The user can select the action to be executed from the user options. In step 3604, the user can identify the section of a song to be edited. For example, the user can define the location of the beginning of the action in a 'from measure' field 3706 and the end point of the action in a 'to measure' field 3708. Preferably 'from measure' field 3706 is the start of the repeated or vamped section of music for repeats and vamps, and the jumping point for cuts. Preferably 'to measure' field 3708 is the end of the repeated or vamped section of music for repeats and vamps and the arrival point for cuts.

In step 3606, the user can specify the number of repeats. Preferable, the user can specify the number of repeats in a '# of Times' field 3710. If the user is creating a vamp or cut, the user can leave '# of Times' field 3710 blank. Preferably, the value in '# of Times' field 3710 is one less then the total number of times the user wants to play the music. For example, to play a section of music twice, the user can enter a 1 in '# of Times' field 3710.

Preferably, the user can execute an additional action to repeat a passages, cut the song short and/or permit the use of vamps or make the changes. For example, the user can make the changes by highlighting an action shown in a listing field 3712, selecting edit selection field 3714, and following the above process. The user can delete the actions by highlighting the actions and selecting a delete selection field 3716. The user can also save the executed actions by selecting save field 3720.

Music system 106 is performed by tapping the beat subdivision of the song. When music is initially crafted for the music system, many choices and selections can be made. For example, the choices can be made as to logical and organic beat subdivisions to be used to drive the tempo. For example, a quarter note tap can be assigned for a brisk walking tempo, dotted quarter tap can be assigned for a fast 6/8 march, or eight note tap can be assigned for a particularly expressive rubato melody. Preferably, the tap assignment can be changed within a song as its character changes. Preferably, these assignments can be indicated in a tap bible for the show the user is producing, as well as in a tap field 2818 of main window 2802 (see FIG. 28). Preferably, as one of the many edit functions music system 106 provides, music system 106 can allow the user to customize the way the user plays the music system. There are many ways to achieve this. For example, a tap subdivision can be edited. Editing a top subdivision can be establish in many ways. For example, this can be established with a tap subdivision edits window.

Figure 38:
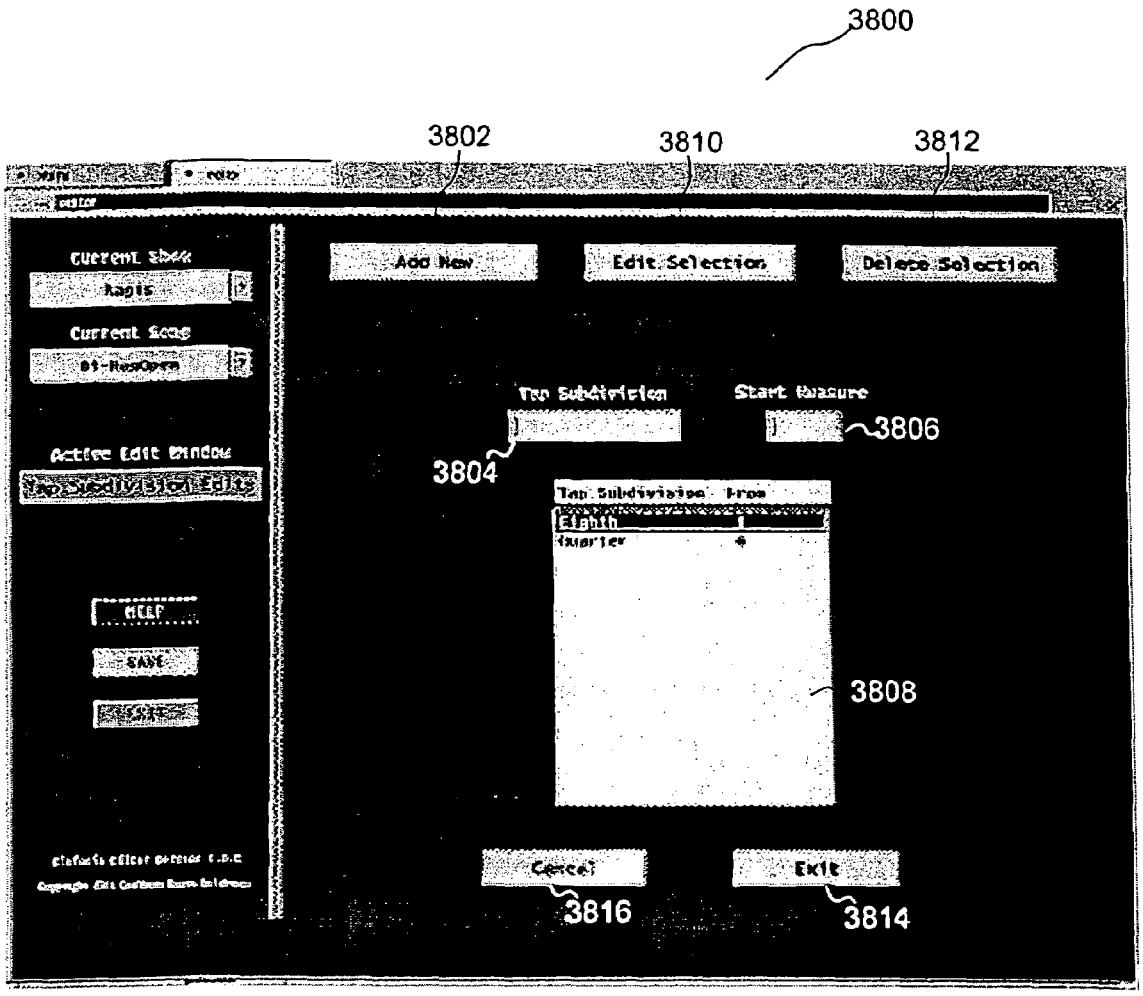
FIG. 38 is a schematic diagram of a preferred embodiment of a tap editing window in accordance with the present invention.
Figure 39:
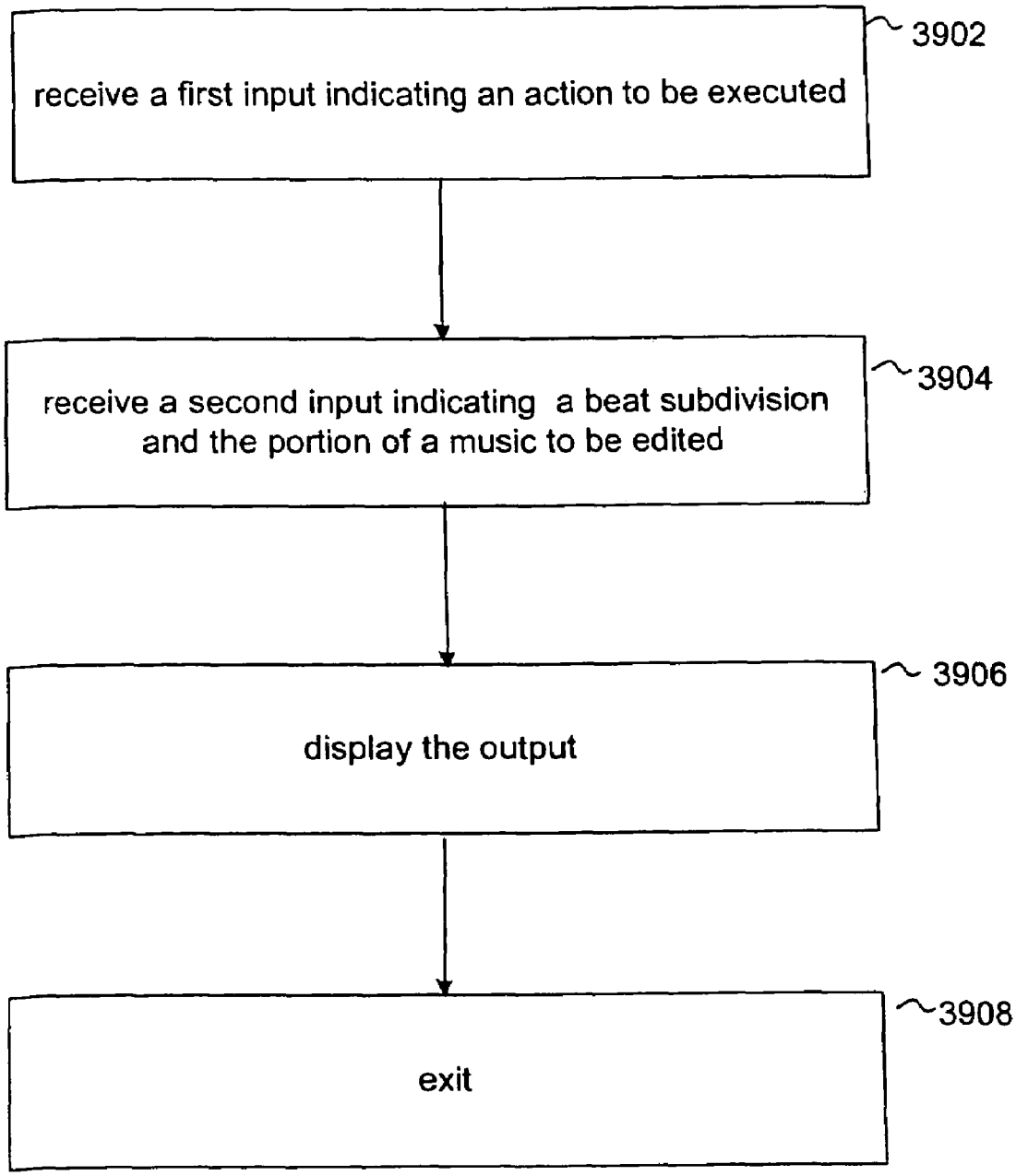
FIG. 39 is a flow diagram of a preferred embodiment of a tap editing process in accordance with the present invention.

FIG. 38 shows an exemplary tap subdivision edits window 3800, and FIG. 39 shows an exemplary flow diagram of steps of a process that can be used to establish tap subdivision edits. Preferably, tap subdivision edits window 3800 can be accessed from main edit window 3002. For example, tap subdivision edits window 3800 can be accessed by selecting a tap assignment field 3014 in main edit window 3002.

In step 3902, the user can select an action to be executed. For example, add new field 3802 in tap subdivision edits window 3800 can be selected to add a new tap subdivision changes. Preferably, various beat subdivision options appears in tap subdivision edits window 3800 for the user to select. In step 3904, the user can provide the input. For example, the user can select a desired beat subdivision. The user can also specify the portion of a music to be edited. Preferably, the user can specify the measure where the user wants the new tap subdivision to take effect. Preferably, a corresponding decimal point can be used for a lettered measure. For example, 12.3 can be used for 12*c*.

In step 3906, preferably, a new tap subdivision may be displayed. For example, the new tap subdivision may be displayed in a display field 3808. Preferably, the user can add additional tap subdivision changes. For example, the user can add additional tap subdivision changes by highlighting tap subdivisions displayed in display field 3808, selecting an edit selection field 3810, and following the above process. The user can also delete tap subdivisions by highlighting the tap subdivisions displayed in display field 3808 and selecting a delete selection field 3812. In step 3908, the user can exit tap subdivision edits window 3800. For example, the user can exit tap subdivision edits window by selecting an exit field 3814. The user can also save the work, for example, by selecting a save field 3816.

Music system 106 allows the user to change the key easily when a song is too high or low for a particular performer. This can be accomplished in many ways. Preferably, this can be established by providing a way to transpose a song. For example, transpose edits can be used.

Figure 40:
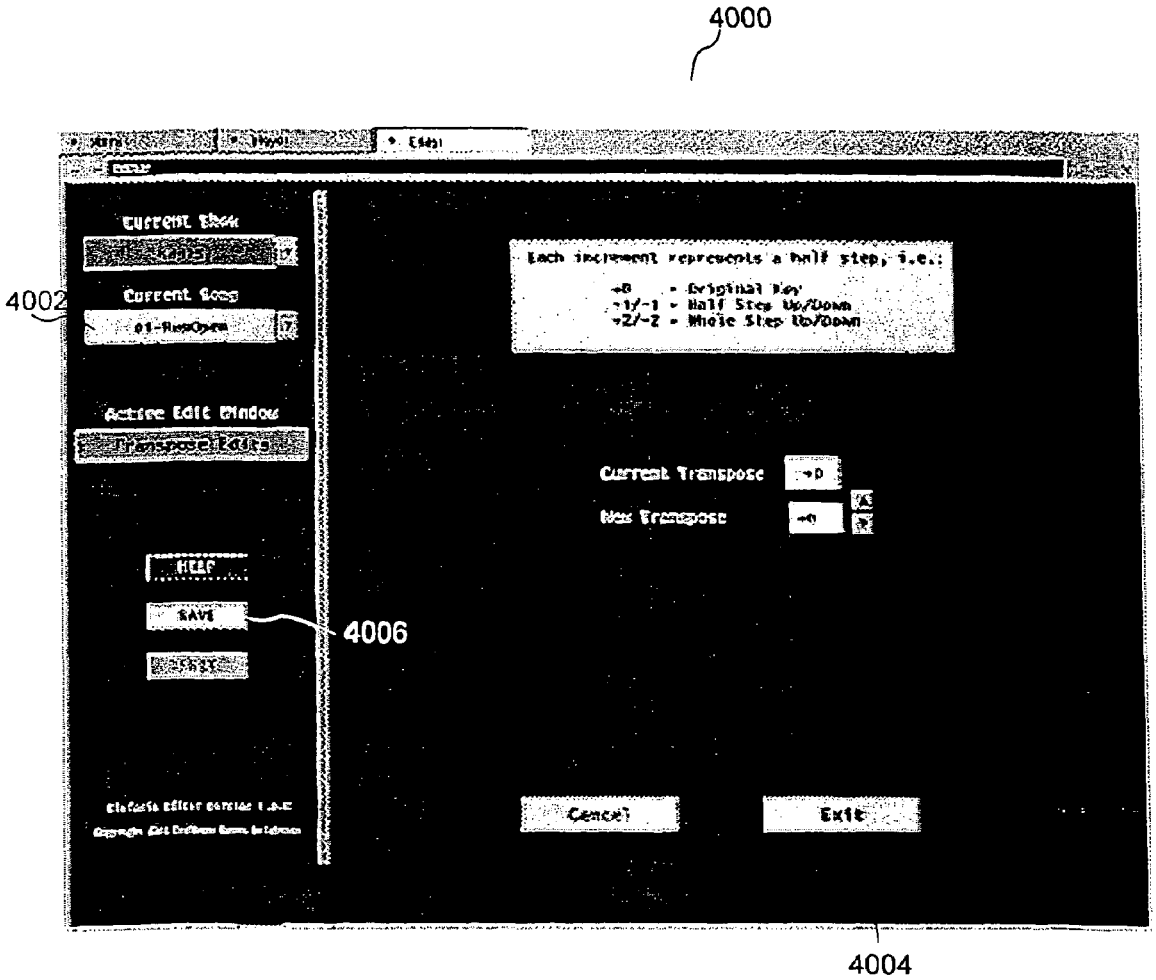
FIG. 40 is a schematic diagram of a preferred embodiment of a transpose edits window in accordance with the present invention.
Figure 41:
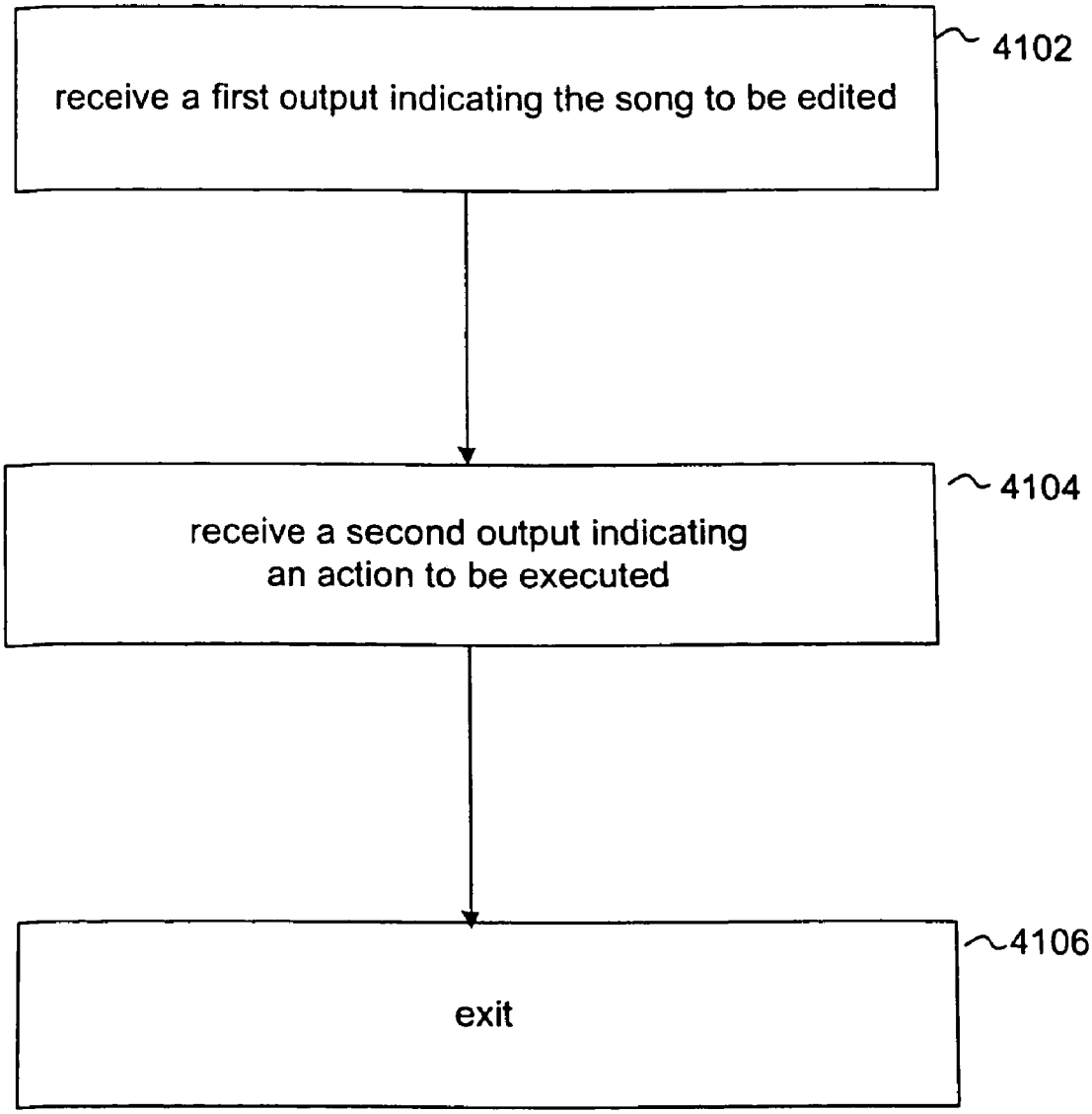
FIG. 41 is a flow diagram of a preferred embodiment of a transpose edits process in accordance with the present invention.

FIG. 40 shows an exemplary transpose edits window 4000, and FIG. 41 shows an exemplary flow diagram of steps of a process that can be used to transpose a song.

In step 4102, the user can select the song to be edited. For example, the user can select the song in current song field 3010 (see FIG. 30) in main editor window 3002 (see FIG. 30). In step 4104, the user can select an action to be executed. For example, a transpose field 3016 in main edit window 3002 can be selected. Preferably, this allows the user to access transpose edits window 4000. Preferably, the user can select up or down arrows, 4008 or 4020, respectively, to raise or lower the user's song choice in transpose edits window 4000. Preferably, each increment represents a half step. In step 4106, the user can exit from transpose edits window 4000. For example, the user can select a exit field 4004 to exit transpose edits window 4000. The user can also save the work, for example, by selecting a save field 4006.

Figure 42:
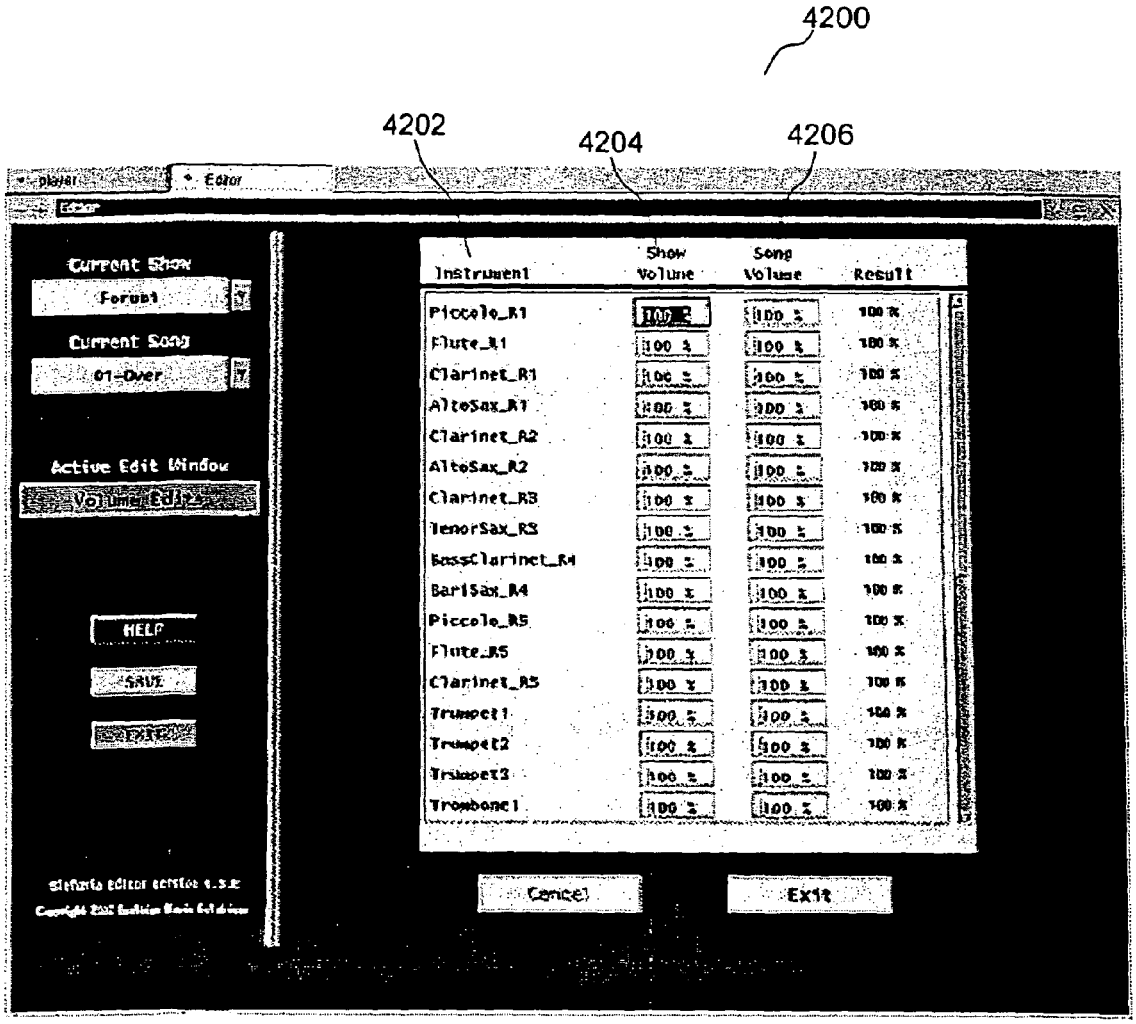
FIG. 42 is a schematic diagram of a preferred embodiment of a volume edits window in accordance with the present invention.

Music system 106 allows the user to adjust the mix of the orchestra on a show or song basis. There are many ways to establish this. Preferably, this can be established by editing a volume. FIG. 42 shows an exemplary volume edits window 4200. Volume edits window 4200 can include columns. For example, volume edits window 4200 can include a first column 4202 including a list of instruments, a show volume column 4204 and a song volume column 4206. Preferably, the user can change a relative volume of instrument or instruments. For example, a relative volume of the instrument can be changed by changing the percentage value in the instrument's corresponding show volume field 4202 or song volume fields 4204, Preferably, a volume can range in value from 0 (completely off) to 127 (loudest possible). For example, if the user is raising a volume of an instrument with a pre-programmed value of 106, the maximum amount the user can increase is 27%.

Figure 43:
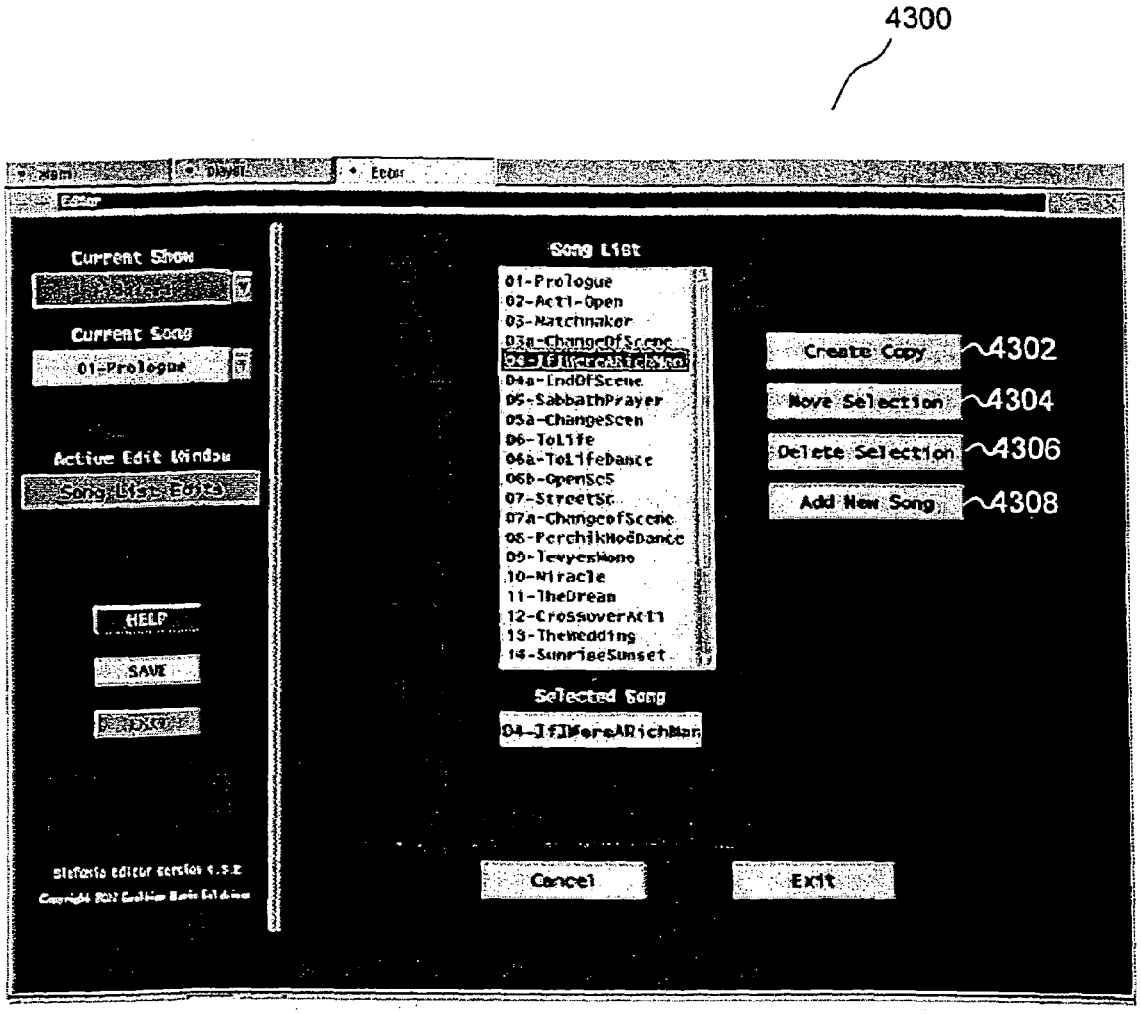
FIG. 43 is a schematic diagram of a preferred embodiment of a song list editor window in accordance with the present invention.

Music system 106 allows the user to modify a song list. For example, the user can reorder songs, delete songs, and add copies of existing songs or clone copies of pre-edited songs. Preferably this can be established with a song list editor. FIG. 43 shows an exemplary song list editor window 4300. For example, the user can create a copy of song by highlighting the song and selecting a create copy field 4302 in song list editor window 4300. Preferably, the created copy of the song includes the edits performed on the song. Preferably, the user can create an edit window from which the user can move the selected song higher or lower on the song list. For example, a move selection field 4304 in song list editor window 4300 can be used. Preferably, the user can remove a song from the song list. For example, the user can remove a song from the song list by highlighting the song and selecting a delete selection field 4306. The user can also create a new selection field, from which the user can choose a song copy to add to the song list. For example, an add new song field 4308 can be used to create the new selection field. Preferably, add new song field 4308 can add original versions of the selected song.

In a preferred embodiment, music system 106 also include an advanced editor to allow detailed and unique customization. Preferably, the advanced editor can allow the user to perform the edits discussed previously with a greater degree of precision. Preferably, the advanced editor can include additional commands. For example, the advanced editor can includes commands that inform the music system how to navigate through a repeat or cut, which instruments to mute and when to mute, which beat subdivision is to be tapped, etc. Preferably, when changes are made in the other editing areas, these commands, which are called meta events, can be automatically written into the music system show file. Preferably, the user can see the meta events for a given song, including the ones that were written from any edits the user may have made, in the advanced editor. While different editing tasks involve different arguments and parameters, preferably the commands, as meta events, share a common syntax. Preferably the advanced editor can list the syntax elements for the user, so that the metaevent can be constructed in a consistent fashion. For example, these syntax elements can appear as separate fields in an advance editor window.

Figure 44:
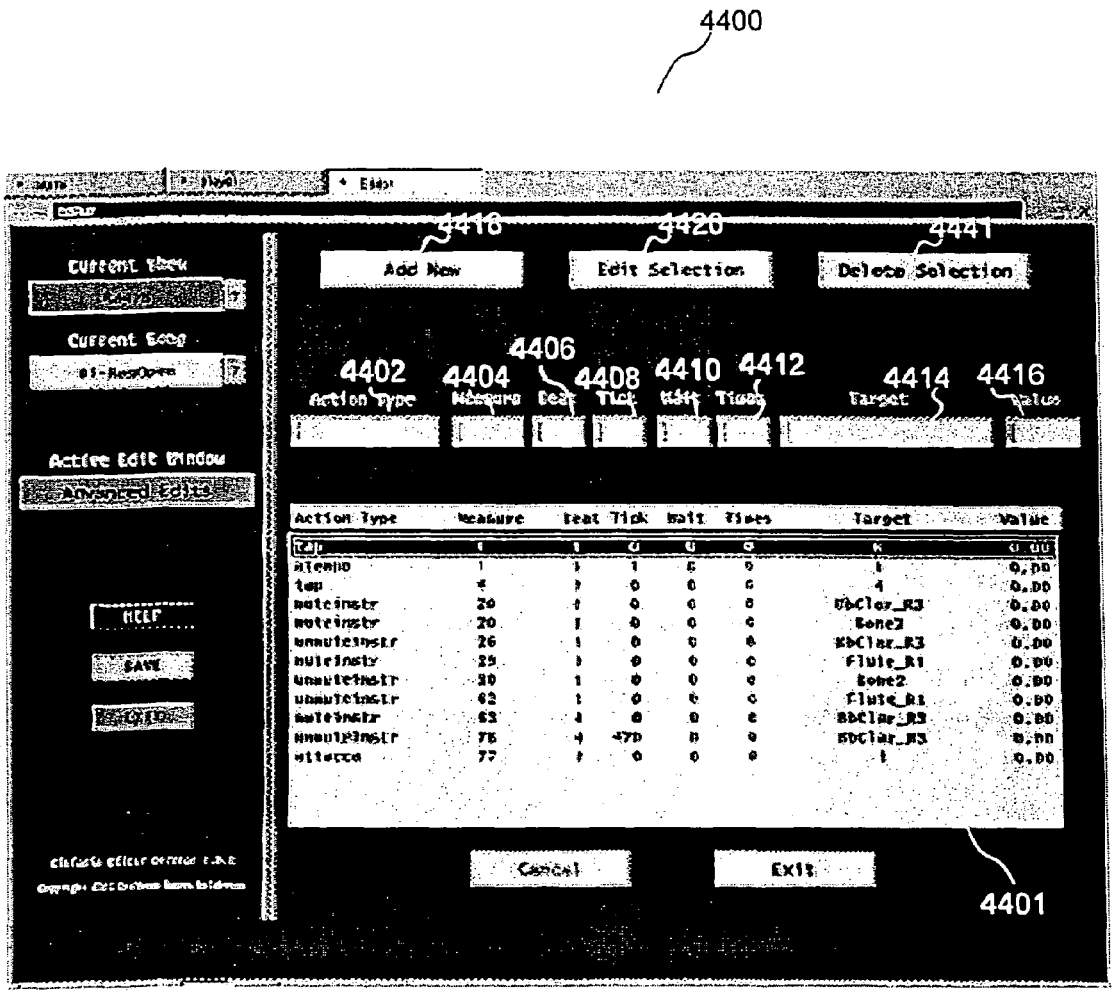
FIG. 44 is a schematic diagram of a preferred embodiment of an advanced editor window in accordance with the present invention.

FIG. 44 shows an exemplary embodiment of an advanced editor window 4400. Advanced editor window 4400 can include following elements:

Action type field 4402 includes a basic command title, such as mute, repeat or cut. Measure field 4404 indicates the measure where the action occurs. Preferably, a corresponding decimal point can be used for a lettered measure. Beat field 4406 indicates the beat where the action occurs. If the beat field is left blank, the music system preferably assumes a value of 1 (or the first beat in the selected measure).

Tick field 4408 specifies where the action occurs within a beat. Preferably, each quarter note beat includes 480 ticks. For example, an action that happens on the second sixteenth note of a quarter note beat would be placed at tick 120. If the tick field is left blank, the music system preferably assumes a value of 0 (or the very start of the selected beat).

Wait field 4410 allows the user to specify a number of times to wait before perform an action when the actions are placed within a repeated section of music. For example, if the user repeat measures 10-20 three times, the user can tell the music system to mute the flute the second time around by specifying a wait value of 1 (the music system waits one time before performing the action). If the wait value is 0 or left blank, the music system preferably assumes that the user wants the action to be performed every time. If the user specify a wait value other than 0 and the user's action is not placed within music that is repeated, preferably the action would not be performed.

Times field 4412 indicates the music system how many times to perform an action. After the music system has fulfilled its obligation and performed the action for the specified number of times, it preferably ignores the metaevent on subsequent passes. Preferably, time field 4412 can be used with repeat. Preferably, time field 4412 can be used for other use. For example, if measures 10-20 are repeated three times and there are commands to mute the flute two times at measure 19 and unmute the flute at measure 20 within the repeated section, the music system preferably plays the flute at measure 19 on the third pass after skipping it the first two times. If the number in times field 4412 is 0 or the times field is left blank, the music system preferably performs the action every time it is encountered.

Target field 4414 represents an object of a given action. Targets may vary according to action. Preferably, for song navigation actions, such as cut, vamp, repeat, relocate, firstend, and secondend, a target can be the measure number where the user jumps to when the action is performed. Preferably, for show navigation actions, such as attacca and relseq, a target can be the song to which the user relocates to when the action is performed. Preferably, for instrument actions, such as muteinstr, unmuteinstr, and instrvolume, a target can be the instrument the user wish to manipulate. Preferably, the targets can be outlined with their corresponding action type.

Value field 4416 is used with the instrvolume metaevent. Preferably, this can be a number expressed relative to 1 with two decimal points. For example, the value 1 indicates an unchanged volume level (or 100% of the preprogrammed value). Preferably, the value above or below 1 instructs the music system to play a selected instrument relatively louder or softer. For example, if an instrvolume action is added for the flute with a value of 1.25, the music system preferably plays the flute 25% louder than the preprogrammed level.

Preferably the user can edit actions using advanced edit window 4400. For example, the actions can be created, edited or deleted. For example, the user can edit or delete an action by highlighting the action in a central display field 4401 in advanced edit window 4400 and selecting an edit selection field 4420 or a delete selection field 4422.

Preferably advanced edit window 4400 includes a list of action types. User can review the action type by selecting an add new field 4418. The action types can be listed in an action type field 4402 in advanced edit window 4400. A drop down window or pick list can be associated with action type field 4402 to display the various actions. Preferably, the possible action types are as follows:

Stop: When the music system arrives at a Stop action event, the music system stops. Notes are cut off and the tempo clock halt so that the music system would not think that the user is switching to an extremely slow tap tempo (as it would if the user simply stopped tapping). A stop metaevent is equivalent to pressing Stop on first keyboard 2306 or second keyboard 2310. This can be useful if the user wants the music system to stop at a specific spot for a bit of stage action. Stop events do not have a target or value. When creating stops, the user can leave these fields blank.

Pause: Pause event causes the music system to pause. Pause event causes a forward motion of the song to stop, but allows the notes that were playing when the user arrived at the pause event to continue play until the user gives the music system further instructions, such as additional taps or a cut-off command from first keyboard 2306 or second keyboard 2310 (see FIG. 24). The tempo clock freezes so that the music system doesn't think the user has shifted to a very slow tapping pattern. Pause events can be useful in musical fermatas or rubato passages. Pause events do not have a target or value. When creating stops, the user can leave these fields blank.

Relocate: The relocate command can be used to move around a song. Relocate can accomplish the same tasks as any of the other song navigation commands (cut, repeat, vamp, etc.). The placement of the relocate action denotes the spot from which the music system jumps to a new location. The target is a new measure to which the music system jumps to. The user can leave the value field blank on relocate events.

Vamp: Vamp events establish a new vamp, or section of music that is repeated for indefinite number of times. The vamped music repeats until the main tells the music system to exit the vamp. The vamp action is placed at the ending boundary of the vamped section of music and the target is the beginning. For example, if the user wants to add a new vamp of measures 1 through 4, the user can place a vamp action at measure 5, beat 1, tick 0—the place where measure 4 is completed, the barline to the right of m4. The target would then be 1 (for measure 1). The times value would be 0 or left blank since the user would want the action to be performed indefinitely. It is possible, though uncommon, that the user might want a wait value—if for example this vamp fell within a larger repeated section of music. The user can leave the value field blank on vamp events.

Repeat: Repeat events establish a new repeat. Like vamps, the repeat action occurs at the end point of the repeated section and the target is the beginning. The user can leave the value field blank on vamp events.

The user can accomplish repeat or vamp from advanced editor window 4400 (see FIG. 44) or from repeat, cut, vamp editor window 3700 (see FIG. 37). The user can enter a repeat or vamp in repeat, cut, vamp editor using a more common parlance and the music system converts it into a metaevent with the syntax it needs. However, advanced editor, where more specialized repeats and vamps are created, requires the proper syntax upfront. The advanced editor focus on where the action will actually occur.

Firstend: The firstend action, which is used in tandem with a corresponding secondend action, allows the user to create repeated sections of music with different endings, for example, Ending #1 and Ending #2. The firstend action is placed at the beginning of the first ending and its target is the beginning of the second ending. It's equivalent to a relocate metaevent with a target that is the second ending start measure number and a wait value of 1. It performs the action on the second pass. In this way, the firstend action defines the front boundary of the first ending. The user can leave the wait and times field blank with firstend events since these mechanisms are already built into the command. The user can also leave the value field blank on firstend events.

Secondend: The secondend action is used with the firstend action to establish a repeated section of music with two different endings. Place the secondend action at the end of the first ending for the repeated music, which is usually—though not always—also the beginning of the second ending, with a target that is the measure number for the repeated section of music. The user can leave the wait and times field blank with secondend events since these mechanisms are already built into the command. The user can leave the value field blank on secondend events.

For example, if the user wants to repeat measures 10-20 with a first ending at measure 19 and a second ending at measure 21, the user can create two events:

| Action Type | Measure | Beat | Tick | Wait | Times | Target | Value |
|---|---|---|---|---|---|---|---|
| firstend | 19 | 1 | 0 | | | 21 | |
| secondend | 21 | 1 | 0 | | | 10 | |

Relseq: The relseq action allows the user to go immediately and automatically to a new song from a specific point in the current song. When the relseq is performed, the music system will relocate to the selected song, stop and wait for further instructions (i.e. tap, go, etc.). The user can place the relseq action at the point the user want to switch songs. The target will be the new song to which the user wish to relocate. When creating or editing relseq actions, the user can select the user's target choice from a drop down list of the various songs in the show from target field. The user can leave the value field blank on relseq events.

Attacca: The attacca action allows the user to segue between two songs without stopping. Usually this happens at the end of a given song such that the music flows from the end of one song into the beginning of the next song. However, attacca can be placed anywhere in a song and to segue into any song in the show. The user can place the attacca action at the point the user wish to segue with a destination song as the user's target. The available choices will appear in a drop down list when the user is at a target field. The user can leave the value field blank on attacca events.

Reset: For actions that have either wait or times arguments, the actions will stop functioning or will function differently based on the number of times the music system has passed. If the user have a repeat to measure 10 that lives at measure 21 and it has a times of 2, than the music system will relocate to measure 10 the first two times it hits measure 21 and ignore the command on the third and subsequent times. A reset action will reset all the action counters to their original values. If the music system encounters a reset action and then relocates to places including previously expired actions, the music system will perform these actions as if they are being passed for the first time. The user can leave the target and value fields blank on reset events. The user can also rest all the action events by leaving and returning to the current song with the arrow keys in Main window 602 (see FIG. M6)

Muteinstr: A muteinstr action will mute a selected instrument. Muteinstr can be performed by placing the muteinstr action at the desired location and selecting the target instrument from the drop down window at target field. The user can leave the value field blank.

Unmuteinstr: An unmuteinstr action will unmute a previously muted instrument. Unmuteinstr can be performed by placing the unmuteinstr action at the desired location and selecting the target instrument from the drop down window at target field. The user can leave the value field blank.

Atempo: When the music system encounters an atempo command, it will reset the tempo clock to the preprogrammed tempo. This can be useful if the user want to perform an extreme ritardando section of music followed by an quick shift back to the original tempo. Without the atempo action, the music system would take a few taps to realize the user's intentions and catch up. The atempo action allows the user to give the music system a heads up. The user can leave target and value blank for atempo events.

Instrvolume: Instrvolume actions allow the user to adjust the relative volumes of instruments over the course of a song. Instrvolume can be performed by placing the instrvolume event at the desired location and specifying the instrument target in a drop down list at the target field. A decimal figure above 1 in value field will make the instrument relatively louder. A decimal figure below 1 will make the instrument relatively softer. Thus a instrvolume with a flute target and a value of 1.20 will make the flute 20% louder, while a value of 0.80 will make the flute 20% softer.

Tap: The tap metaevent allows the user to change the tap beat subdivision. The target is the tap value choice. The options appear in a drop down list at target field. The user can leave the value field blank for tap events.

Cutoff: When the music system encounters a cutoff action, it will turn off all riotes that are playing at the time. The user can leave the target and value fields blank for cutoff events.

Cut: The cut action is a relocate action, usually used to skip sections of music. The user can place the cut action at the desired jumping point with a target destination measure number. The user can leave the value field blank.

The foregoing disclosure of the preferred embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A method of producing a musical performance comprising the steps of:

accessing a first data structure representing a plurality of musical pieces, wherein the first data structure includes digital music information that represents musical notes of the musical pieces, wherein at least one of the musical pieces is comprised of music from a plurality of instruments stored on respective tracks;

retrieving a second data structure that includes information different from the first data structure, the second data structure including instructions for selecting from among and arranging the plurality of musical pieces including arranging music on the respective tracks; and applying the second data structure to the first data structure to produce the musical performance, wherein the second data structure is operable to control a plurality of instruments and music information associated therewith, the music being disposed across a plurality of channels, and wherein each instrument and its associated music information can be modified separately by the second data structure.

2. The method of producing a musical performance according to claim 1, wherein the first data structure includes information that conforms to a pre-selected digital format and wherein the second data structure includes information that does not conform to the pre-selected digital format.

3. The method of producing a musical performance according to claim 1, wherein the second data structure is a show file.

4. The method of producing a musical performance according to claim 1, wherein the first data structure includes information that conforms to a MIDI specification.

5. The method of producing a musical performance according to claim 1, wherein the second data structure is operable to effect at least one of dynamic control, velocity control, and articulation control.

6. The method of producing a musical performance according to claim 1, further comprising outputting modified MIDI information.

7. The method of producing a musical performance according to claim 1, wherein at the time of the musical performance both the first and the second data structures are in use.

8. The method of producing a musical performance according to claim 1, wherein the second data structure comprises at least one of mute maps, volume maps, navigation maps, tap subdivision maps, and hot key maps.

9. The method of producing a musical performance according to claim 1, wherein the second data structure comprises instructions to control at least one of the number of times a particular event is to be performed, the number of times the particular event is to be encountered before it activates, and a pattern of event activation.

10. The method of producing a musical performance according to claim 9, further comprising overriding said instructions via external control or from an internal command.

11. The method of producing a musical performance according to claim 1, wherein a plurality of second data structures are made available to apply to the first data structure.

12. The method of producing a musical performance according to claim 1, where in the second data structure comprises layered maps that result in a composite map.

13. The method of producing a musical performance according to claim 12, further comprising recording multiple performances and applying weighting or averaging techniques to create a resultant map.

14. The method of producing a musical performance according to claim 1, further comprising enabling at least one of tap, cruise and play on the fly.

15. The method of producing a musical performance according to claim 1, further comprising declaring a vamp via the second data structure at any time during the musical performance by sending a command, such that a number of times that the command is sent determines the number of measures that the vamp will enclose.

16. The method of producing a musical performance according to claim 15, further comprising exiting at least one of the vamp and a repeated section of the musical performance by initiating an exit vamp command.

17. The method of producing a musical performance according to claim 16, further comprising activating a plurality of conditions, defined in the second data structure, as last time through conditions when the exit vamp command is initiated.

18. The method of producing a musical performance according to claim 1, further comprising generating a map that allows a user to program different tap subdivisions into different portions of a selected piece.

19. The method of producing a musical performance according to claim 18, further comprising overriding an underlying tap subdivision by issuing a command for a specific tap subdivision.

20. The method of producing a musical performance according to claim 1, further comprising providing the first data structure to an entity, and further providing a system to the entity that enables the entity to perform the method.

21. The method of producing a musical performance according to claim 1, further comprising providing a system to an entity that enables the entity to perform the method and allowing the entity to provide the first data structure.

22. The method of producing a musical performance according to claim 1, further comprising supplying digital files that include musical scores to a plurality of entities, wherein the entities subsequently modify the scores to create individualized performances without changing the supplied digital files.

23. The method of producing a musical performance according to claim 1, wherein the velocity of a tap release can be applied to an instrument property or properties such that the resultant musical output of a plurality of instruments is modified.

24. The method of producing a musical performance according to claim 1, wherein the first and second data structures are stored together in a single file or separately in a plurality of files, and the first and second data structures are extracted at load time.

25. The method of producing a musical performance according to claim 24, further comprising storing metaevents as markers within a standard MIDI file, and extracting and decoding the metaevents at load time.

26. The method of producing a musical performance according to claim 1, further comprising accepting an external command that allows for a plurality of different events to be activated based on a definition of a hot key.

27. The method of producing a musical performance according to claim 1, further comprising creating a map that allows an activity of a particular hot key to change during the performance of a show based on the cuffent location within the show or on other parameters.

28. The method of producing a musical performance according to claim 1, further comprising exiting a vamp immediately or upon arrival at an end of a predetermined vamped section.

29. The method of producing a musical performance according to claim 1, further comprising, using patch change information within the first data structure to map into an instrumental definition, such that a plurality of different resultant patch changes can be output based on a current state of the performance.

30. The method of producing a musical performance according to claim 1, further comprising employing arbitrary measure numbers based on embedded tags within the first data structure, and using the arbitrary measure numbers to relocate a given measure.

31. The method of producing a musical performance according to claim 1, further comprising inserting section names within the first data structure such that display and relocation can use the section names as labels.

32. The method of producing a musical performance according to claim 1, further comprising declaring inertia as an instrumental property such that a resultant output of volume or other data will change more slowly than a change designated by original data within the first data structure.

33. The method of producing a musical performance according to claim 1, further comprising allowing a plurality of external events to be accepted as a tap event.

34. The method of producing a musical performance according to claim 1, further comprising declaring a list of tap patterns, such that the second data structure can reference these patterns when determining the a correct cuffent tap subdivision within a performance.

35. The method of producing a musical performance according to claim 1, further comprising defining a map of external commands such that each separate event on an input is associated with an operable external event of a user's choice.

36. The method of producing a musical performance according to claim 35, further comprising storing a plurality of personalized input keyboard maps such that each user can have a different keyboard layout when performing a given show.

37. A method of reusing a MIDI file in the course of generating a musical performance, comprising the steps of:

retrieving a MIDI file;

applying a first show file to the MIDI file to produce a first modified musical output; and applying a second show file to the MIDI file to produce a second modified musical output;

wherein the first and second show files include at least one command that modifies at least one of a pitch associated with the musical output, establishes a vamp during the playing of the musical output and modifies a tempo associated with the musical output, wherein the same MIDI file is employed to produce both the first modified musical output and the second modified musical output at the time of the musical performance, wherein the MIDI file remains intact such that it is itself not modified, and wherein the first modified musical output is different from the second modified musical output.

38. The method of claim 37, wherein the first and second show files include at least one map.

39. The method of claim 37, wherein the first and second show files include at least one group.

40. The method of claim 37, wherein the first and second show files include at least one command that changes a play sequence order of the MIDI file.

41. The method of claim 37, wherein the first and second show files include at least one command that changes a playback mode among a play mode, a tap mode or a cruise mode.

42. The method of claim 37, further comprising generating a map that contains commands for an instrument or group of instruments to join or quit any other group of instruments, either at a specific metric time point, over a pattern of encounters of that metric time point or region thereof, or by activation from an external command.

43. The method of claim 37, further comprising declaring an instrument that can precisely control external devices, including at least one of light boards and video projectors, so that the external devices are synchronous with an underlying metric structure, and can be modified using the same mapping techniques applied to defined MIDI instruments.

44. The method of claim 37, further comprising labeling every measure with an arbitrary measure identifier, so that a numbering convention of an original hard copy score can be used without needing to alter that score.

45. The method of claim 37, further comprising identifying at least one mistake and emendation in the MIDI file, and providing an updated MIDI file that is subsequently used in the retrieving step.

46. The method of claim 37, further comprising declaring a selected instrument as nontransposing such that any general transpose event sent to that instrument will be ignored by any data belonging to that instrument.

47. The method of claim 37, further comprising providing the MIDI file to an entity, and further providing a system to the entity that enables the entity to perform the method.

48. The method of claim 37, further comprising supplying MIDI files that include musical scores to a plurality of entities, wherein the entities subsequently modify the scores to create the first and second modified musical outputs without changing the supplied MIDI files.

* * * * *